US006672815B2

(12) United States Patent
Parker et al.

(10) Patent No.: US 6,672,815 B2
(45) Date of Patent: Jan. 6, 2004

(54) APPARATUS AND METHOD OF BINDING SOFT COVER BOOK

(75) Inventors: Kevin P. Parker, Berkeley, CA (US); Wayne Kasom, San Francisco, CA (US); Evelyn Steiner, Walnut Creek, CA (US); William M. Elliott, Larkspur, CA (US)

(73) Assignee: Powis Parker Inc., Berkeley, CA (US)

( * ) Notice: Subject to any disclaimer, the term of this patent is extended or adjusted under 35 U.S.C. 154(b) by 0 days.

(21) Appl. No.: 09/854,005

(22) Filed: May 11, 2001

(65) Prior Publication Data

US 2002/0007901 A1 Jan. 24, 2002

Related U.S. Application Data

(60) Provisional application No. 60/204,220, filed on May 15, 2000.

(51) Int. Cl.[7] ..... B42B 5/00

(52) U.S. Cl. ..... 412/33; 83/879; 156/196; 412/4; 412/8; 412/9; 412/25; 493/61; 493/355

(58) Field of Search ..... 412/1, 4, 7, 9, 412/8, 19, 20, 25, 33, 38; 281/21.1, 29; 83/879, 152, 284; 493/61, 471, 354–356, 372; 156/196

(56) References Cited

U.S. PATENT DOCUMENTS

| | | | | | |
|---|---|---|---|---|---|
| 3,744,384 | A | * | 7/1973 | Jarritt et al. | 493/354 |
| 3,807,261 | A | * | 4/1974 | Couvreur | 83/879 |
| 3,816,866 | A | | 6/1974 | Miaskoff et al. | 11/3 |
| RE29,105 | E | | 1/1977 | Miaskoff et al. | 11/3 |
| 4,299,410 | A | | 11/1981 | Jukola | 281/21 R |
| 4,377,430 | A | | 3/1983 | Bexley et al. | 156/184 |
| 4,391,168 | A | * | 7/1983 | Gerber et al. | 83/34 |
| 4,401,001 | A | * | 8/1983 | Gerber et al. | 83/451 |
| 4,831,909 | A | * | 5/1989 | Peters et al. | 83/425.4 |
| 4,936,818 | A | * | 6/1990 | Holohan, Jr. | 493/396 |
| 5,154,447 | A | | 10/1992 | Tooker | 281/21.1 |
| 5,194,064 | A | * | 3/1993 | Simpson et al. | 493/402 |
| 5,364,215 | A | * | 11/1994 | Snellman et al. | 156/269 |
| 5,409,442 | A | * | 4/1995 | Smithwick, Jr. | 493/468 |
| 5,413,447 | A | * | 5/1995 | Rathert | 198/689.1 |
| 5,488,889 | A | * | 2/1996 | Kang | 83/346 |
| 6,071,225 | A | * | 6/2000 | Kucharski | 493/396 |
| 6,155,763 | A | * | 12/2000 | Parker et al. | 412/19 |
| 6,311,601 | B1 | * | 11/2001 | Love | 83/863 |
| 6,364,590 | B1 | * | 4/2002 | Gayoso | 270/52.08 |

* cited by examiner

*Primary Examiner*—Monica Carter
(74) *Attorney, Agent, or Firm*—Girard & Equitz LLP

(57) ABSTRACT

Apparatus for scoring a cover to be applied to a bound stack of sheets to form a book. A base unit is provided having a surface for receiving the cover, an lower die holder disposed below the surface and an upper die holder disposed above the surface. A lower die is supported on an upper surface of the lower die holder and an upper die is supported on the lower surface of the upper die holder. An actuating structure such as a handle, is used to move the upper and lower die between an open position and a closed where the upper and lower die score the cover. The upper die holder is fabrication using a transparent material so that a user can view the upper die and underlying cover to facilitate proper alignment.

75 Claims, 40 Drawing Sheets

APPARATUS AND METHOD OF BINDING SOFT COVER BOOK

CROSS REFERENCE TO RELATED APPLICATIONS

The present application claims the benefit of the provisional application filed on May 15, 2000 having application No. 60/204,220 and entitled Apparatus and Method of Binding Soft Cover Book pursuant to 35 U.S.C. §119(e).

BACKGROUND OF THE INVENTION

1. Field of the Invention

The present invention relates generally to binding books and, in particular, to preparing and applying book covers to bound stack to provide a soft cover book.

2. Description of Related Art

Bookbinding systems using binder strips are becoming increasingly popular. One such prior art system is disclosed in U.S. application Ser. No. 09/216,281 filed on Dec. 18, 1998 and entitled BOOKBINDING STRUCTURE AND METHOD. As will become more apparent, one disadvantage of the bookbinding structure and associated method disclosed in the '281 application relates to the last step where the cover is attached to the bound stack. This step requires a certain amount of skill and does not lend itself to the manufacture of multiple books.

There is a need for an improved method and apparatus to complete the manufacture of soft cover books. This would permit, for example, a bookstore to maintain a limited inventory of selected soft cover titles. When a customer enters the bookstore to purchase on the selected soft cover books, a clerk can simply download the text off the internet or from some other source. All of the book can then be printed in real time while the customer is waiting. Preprinted soft covers can then be prepared and applied to the book by a store clerk having minimal training and minimal bookbinding skills. In this way, a large number of titles can be made available and can be manufactured essentially on demand without the need of maintaining a large inventory of books.

In order to more fully appreciate the present invention, the prior art bookbinding structure and system noted above will now be described. Referring to the drawings, FIG. 1A is an exploded perspective view of the various layers one embodiment of a prior art bookbinding structure 1. In the this embodiment, the bookbinding structure 1 includes an elongated substrate 6 having a length which corresponds to the length of the stack of pages (not depicted) to be bound and a width which exceeds the thickness of the stack by at least a minimum amount so that the edges of the substrate 6 will extend around the edge of the stack and slightly over the front and back pages of the stack, as will be described. Substrate 6 is preferably made of a formable material such as heavy weight paper.

A layer of pressure activated adhesive 3 is disposed on one surface of the substrate 6, with a heat activated adhesive matrix 4 being disposed facing the opposite substrate surface. The pressure activated adhesive 3 is typically a permanently binding adhesive which, once activated by applying pressure, produces a relatively permanent bond. One such pressure activated adhesive is sold under the designation HL-2593 by H. B. Fuller Company of St. Paul, Minn. The Fuller HL-2593 pressure activated adhesive can be subjected briefly to high temperatures, up to about 425° F., without decomposing. The ability of the pressure activated adhesive 3 to withstand high temperatures is important because the bookbinding structure 1 is subjected briefly to high temperatures during the binding process, which will be described in more detail below. The pressure activated adhesive is preferably 0.003 to 0.005 inches thick.

The pressure activated adhesive 3 is covered with a removable release liner 5, as shown in FIG. 1A, to act as a barrier between the pressure activated adhesive 3 and the environment. The release liner 5 is preferably a silicon coated paper, such as made by Akrosil, Inc. of Menasha, Wis. under the designation Silox™ SBL60SC F1U/F4B. The surfaces of the coated paper can have varying release levels, with a low or easy release level indicating that the paper can be separated with little force and a high or tight release level indicating the separation requires a relatively large amount of force. The designation F4B indicates that the release level of the liner surface contacting the pressure sensitive adhesive layer 3 has a medium release level, with the opposite surface of the liner having a low or easy release level as indicated by the designation F1U.

The heat activated adhesive matrix 4 is comprised of a center adhesive 4A which extends along the longitudinal axis of the substrate 6 and a pair of outer adhesive bands 4B. The center adhesive band 4A, which is a heat activated adhesive of relatively low viscosity, is the primary adhesive for binding the pages together. The center adhesive 4A is typically 0.015 inch thick. An adhesive, sold under the designation Cool Bind 34-1301 by National Starch & Chemical Company of Bridgewater, N.J., has been found to be suitable as the center adhesive band 4A. The center adhesive band 4A preferably extends over slightly less than the full length of the bookbinding structure 1 so that there are end gaps without the center adhesive 4A. In addition, the center adhesive band is at least as wide as the thickness of the stack 13 to be bound so that all of the pages of the stack will be exposed to the low viscosity adhesive.

The outer adhesive bands 4B are comprised of a heat activated adhesive of relatively high viscosity when activated and possesses a high degree of tackiness. The outer adhesive bands 4B function to attach the substrate 6 to the front and back pages of the stack. The outer adhesive bands 4B preferably extend along the entire length of substrate 6 and are 0.010 inch thick. An adhesive sold under the designation HB HL-1777 by H. B. Fuller Company of St. Paul, Minn., may be used for the outer adhesive bands 4B.

The FIG. 1A bookbinding structure further includes an undercoat adhesive layer 7 disposed intermediate the adhesive matrix 4 and the substrate 6. The undercoat adhesive is heat activated and is relatively thin, typically 0.003 inches thick. The undercoat is preferably the same type of adhesive used in the outer adhesive bands 4B and functions to act as a barrier so as to prevent the low viscosity central adhesive band 4A from passing through the substrate 6. In addition, the undercoat adhesive prevents all of the low viscosity adhesive of central band 4A from being drawn up between the pages of the stack which may leave essentially no adhesive intermediate the edges of the pages and the substrate 6.

The manner in which the FIG. 1A bookbinding structure 1 is applied to the stack 13 and used to bind the stack will be subsequently described. However, once the stack of pages has been bound, the structure 1 and stack 13 appear as shown in FIG. 4. As can be seen, the structure 1 is positioned on the bound edge of stack 13. Note that the bound stack 13 does not include a cover at this stage of the sequence, with top of the stack being the first page and the bottom of the stack being the last page.

The pressure sensitive adhesive 3 is exposed by manually removing the release liner 5 as shown in the drawing. A cover assembly or book cover 2 is positioned on a flat surface as shown in FIG. 5. The bound book 13 is then carefully positioned above the cover 2 so that the stack is aligned with the right hand portion of the cover, with the bound edge of the stack being positioned near the center of the cover. After alignment, the stack 13 is lowered on to the book cover 2 so that the bottom portion of the exposed adhesive contacts the cover. Once this occurs, it is not practical to attempt to realign the stack 13 relative to the cover 2 since the adhesive bond is permanent. Accordingly, it is important that the alignment be correct in the first instance. It has been found that an "L" shaped ruler, referred to as a carpenter's square, can be placed on the work surface and used to carry out the alignment. Among other things, the present invention to be described addresses this stage of the book assembly process.

As shown in FIG. 6, once the stack 13 has been properly positioned on the cover assembly 2, the assembly is manually folded around the edge of the bound stack. Pressure is applied to the outer surface of the cover assembly 2 in the spine region to ensure that the cover assembly is secured in all areas where the pressure sensitive adhesive is present. This results in a bound book 14 having a cover assembly 2 forming the front and rear book cover together with the book spine.

FIG. 7 is a cross-sectional end view of the bound book using the first embodiment bookbinding structure 1 which is not shown to scale so that all of the various layers can be seen. Preferably, the cover assembly 2 is pre-scored at the two cover locations so that the cover assembly can easily be folded at these proper locations. A third score can be added to the front cover at a location spaced slightly away from the spine which forms a fold line when the front cover is opened. The cover assembly 2 can be previously printed using any type of process, including printing processes that utilize heat sensitive inks since the cover assembly is never subjected to elevated temperatures when using the first embodiment bookbinding structure 1.

Note that the cover assembly 2 need only cover that portion of the spine which includes the pressure sensitive adhesive 3. FIG. 9A shows a cross-section of a bound book where the cover assembly covers that front and rear pages of the book together with the spine, as previously described in connection with FIG. 7. FIG. 9B shows a bound book where the cover assembly 2 covers only the front page, a very small portion of the back page and the spine. Finally, FIG. 9C shows a bound book where the cover assembly 2 only covers the spine and a small portion of the front and back pages sufficient to cover the pressure sensitive adhesive.

The manner in which the first embodiment bookbinding structure 1 is applied to the stack 13 so as to bind the stack will now be described. One significant advantage of the present invention is that an existing, commercially available binding machine can be used to carry out the binding sequence. One such machine is described in U.S. Pat. No. 5,052,873, the contents of which are hereby fully incorporated herein by reference. The binding sequence set forth in U.S. Pat. No. 5,052,873 uses a conventional binder strip of the type disclosed in previously noted U.S. Pat. No. 4,496,617.

FIG. 2 depicts a conventional binding machine 8 such as described in U.S. Pat. No. 5,052,873. Machine 8 has a stack 13 to be bound inserted into the machine input. The thickness of the stack is automatically measured and the appropriate width binding structure 1 is displayed. As is the case with conventional binder strips, the binding structure 1 is preferably available in three widths to accommodate stacks 13 of varying width. Such widths include "Narrow", "Medium" and "Wide", with the width of the central adhesive band 4A being altered for each binder structure 1 width. Machine 8 will specify a structure 1 width having a central adhesive 4A width that is at least as wide as the measured thickness of the stack 13. A binding structure 1 of the appropriate width is then manually fed into the strip feed input of the machine 8. The machine then automatically carries out the binding sequence by appropriately positioning the structure 1 relative to the edge of the stack 13 and applying a combination of heat and pressure as will be described.

The binding sequence is depicted schematically in FIGS. 3A through 3E. End views are shown of the stack 13 and the binding structure 1. Referring to FIG. 3A, the stack 13 to be bound, after loading, is gripped between a pair of clamps 10 and 11 and is initially supported on a cool platen 9. A strip positioning apparatus (not depicted) positions the binding structure 1 previously fed into the machine so that the adhesive matrix 4 is facing the stack 13. The vertical position of the structure 1 relative to the stack 13 is automatically set in accordance with the thickness of the stack as previously measured. A thin stack 13 will result in the structure 1 being positioned relatively high so that the edges of the structure 1 will extend equally over the front and rear pages of the bound stack. Similarly, a thick stack will result in the structure 1 being positioned somewhat lower. A heated platen having a rotating segment 12A and a non-rotating segment 12B is positioned facing the binding structure 1. The platen segments 12A and 12B are at least as long as the length of the stack and the length of the elongated binding structure 1.

As shown in FIG. 3B, the stack 13 is moved laterally away from the cold platen 9 towards the rotating platen segment 12A. This movement is carried out by way of clamps 10 and 11 which support and move the stack. The lower portion of the stack 13 is forced against the heated rotating platen portion 12A, with one edge of the binding structure 1 being disposed between the platen portion 12A and the stack 13. Note that the binding machine element which supports the opposite side of stack 13 at this point in the sequence is not depicted in the drawings. The resultant heat and pressure applied to one edge of the bookbinding structure 1 results in activation of one of the outer adhesive bands 14B (FIG. 1A). This will cause an adhesive bond or seal to be formed between the structure 1 and the front page of stack 13. Since the outer adhesive bands 14B are high tack when activated, the binding structure 1 remains bonded to the front page of the stack 13 when the stack is moved away from the heated rotating platen portion 12A as shown in FIG. 3C.

As shown in FIG. 3D, the rotating platen segment 12A is rotated 90 degrees so that both the rotating and fixed platen segments 12A and 12B define a flat upper surface. This permits stack 13 to be moved to the right over the platen segments. This causes the bookbinding structure 1 to be folded around the lower edge of the stack 13. The binding machine 8 pauses briefly in this position so that the central adhesive band 4A will have time to become molten and to flow upward by way of capillary action between the individual pages of the stack 13 thereby fulling wetting the pages with the adhesive. The rotating platen segment 12A is then rotated 90 degrees back to the original position as shown in FIG. 3E. This results in the remaining edge of the bookbinding structure 1 to be folded around the edge of the stack 13, with the remaining outer adhesive band 4B being positioned facing the rear page of the stack 13. The stack 13 is then forced against the rotating platen portion 12A thereby activating the outer adhesive band 4B so as to form the final adhesive bond. The bound stack 13 is then removed from the binding machine and permitted to cool for a few minutes so that the adhesives have an opportunity to set. The cover assembly 2 is then secured to the stack as previously described in connection with FIGS. 4, 5 and 6.

Note that the first embodiment bookbinding structure 1 could also be implemented without substrate 6. In that event, undercoat adhesive layer 7 is disposed directly on the pressure activated adhesive layer 3. The release liner 5 then provides the additional function of acting as a substrate and supporting the structure 1 during the binding sequence previously described in connection with FIGS. 3A through 3E.

A further embodiment of the prior art bookbinding structure is depicted in FIG. 1B. The second FIG. 1B structure 1 includes an adhesive matrix 4 similar to that of the first embodiment structure of FIG. 1A. A substrate 6 is provided having the same shape as that of the first embodiment, with there being an undercoat adhesive layer 7 similar to layer 7 of FIG. 1A. The second embodiment structure 1 does not include, among other things, the pressure activated adhesive 3 of the first embodiment.

A stack 13 is bound using the second embodiment structure 1 in the same manner as that of the first embodiment structure. Once the steps of FIGS. 3A through 3E are carried out using the conventional binding machine 8, the bound stack is permitted to cool. The substrate 6 is then manually removed from the stack in much the same manner as the release liner 5 is removed from the stack as depicted in FIG. 4. Thus, the substrate 6 of the second embodiment also functions as a release liner.

Removal of substrate 6 exposes the undercoat adhesive layer 7. Adhesive layer 7 together with the remaining adhesive of the adhesive matrix 4 is then used to attach a cover assembly 2 to the bound stack 13. Since the adhesives are heat activated, it is necessary to reheat the adhesives so that they can be used for this purpose. It is possible to again use a conventional binding machine 8 to carry out the sequence for attaching the cover assembly 2 to the bound stack 13, as will be described.

The cover assembly 2 of appropriate dimensions is first placed on a flat surface and the bound stack 13 is positioned over the assembly in much the same manner as previously described in connection with the first embodiment. The cover assembly 2 is folded around the stack 13 to the desired final position. Preferably, the assembly is pre-scored to facilitate this step. Since the adhesives are not activated at this point, proper positioning is somewhat easier to accomplish as compared to the first embodiment. The cover assembly/stack combination 2,13 is then inserted into the conventional binding machine 8, taking care to hold the cover assembly 2 in place until the combination is gripped by the machine clamps 10 and 11 (FIG. 3A). The binding machine 8 must be slightly modified to carry out the cover assembly 2 attachment sequence since the machine normally requires activation when a binder strip is manually fed into the machine as shown in FIG. 2. Such modification would simply simulate the detection of a binder strip being fed into the machine. Alternatively, it is possible to activate the machine 8 by momentarily inserting a binder strip into the machine so as to initiate the sequence and to then rapidly withdraw the strip from the machine since the strip is not needed and should not be present.

FIG. 8A shows a book 14, which includes the bound stack 13 and the folded cover assembly 2, installed in the binding machine 8 and resting on the cool platen 9 (not depicted). Book 14 is secured by opposing clamps 10 and 11 (not depicted). This point in the binding machine sequence corresponds to that shown in FIG. 3A where the binding structure 1 is being applied to the stack 13. Note that FIG. 8A does not include a binding structure as does FIG. 3A since the structure was previously applied. The stack 13 is then forced against heated platen segment 12A so that one of the outer adhesive bands 4B is activated and compressed between the cover assembly 2 and the front page of the stack 13 as shown in FIG. 8B. This corresponds to FIG. 3B of the binding machine 8 sequence. Thus, a first adhesive seal in created between the stack 13 and the cover assembly 2.

The stack 13 with cover 2 is then moved away from the heated platen segments 12A and 12B as indicated in FIG. 8C and the rotating platen segment is rotated 90 degrees as shown in FIG. 8D. The stack 13 is then positioned over the heated platen sections 12A and 12B so that a seal will be formed between the edge of the stack 13 and that part of the cover 2 which forms the spine. FIGS. 8C and 8D correspond generally to FIGS. 3C and 3D, respectively.

The rotating platen segment 12A is then rotated back 90 degrees, with the stack 13 and platen segment 12A then being forced together as shown in FIG. 8E which corresponds to FIG. 3E. The resultant application of heat and pressure will cause a further adhesive seal to be formed between the cover 2 and the last page of the stack 13. This will complete the binding sequence so that the bound book can be removed from the binding machine and permitted to cool.

Since the cover assembly 2 is heated when the second embodiment bookbinding structure 1 is used, any printing on the cover assembly should be carried out using inks not sensitive to heat. Further, substrate 6 must be made of a material that will support the various molten adhesives applied to the substrate when the bookbinding structure is fabricated and will provide sufficient support during the binding sequence of FIGS. 3A through 3E so that the structure 1 can be manipulated and heated by the binding machine 8 in order to carry out the sequence. Still further, the substrate 6 must be made of a material that has a sufficiently high release value to permit the substrate to be manually separated from the bound book 13. It has been found that the substrate material of the second embodiment should not contain free silicon since this material has been found to contaminate the adhesives and destroy the adhesive properties. Thus, the material must be either fully reacted silicon based or be non-silicon based. The substrate could be fabricated from a liner material having a repositionable adhesive such as a product sold under the designation ReMount 6091 by the Industrial Tape and Specialties Division of 3M located in St Paul, Minn.

FIG. 1C is an exploded view of a third embodiment of the conventional bookbinding structure. The third embodiment is similar to the first embodiment (FIG. 1A) except that a solvent activated adhesive 15 is used instead of a pressure activated adhesive 3. This feature eliminates the requirement for a release liner, such as liner 5 of the first embodiment. The solvent activated adhesive 15 must be able to withstand temperatures up to about 425° F. which are created during the binding sequence as depicted in FIGS. 3A through 3E. One suitable solvent activated adhesive is an adhesive sold under the designation Weldbond by Frank T. Ross and Sons, Inc. in Spring Grove, Ill. The Weldbond adhesive may be activated by either water or alcohol.

The manner in which the stack 13 is bound using the third embodiment bookbinding structure 1 is the same as the first embodiment except that the exposed adhesive 15 must be activated by application of water or alcohol prior to placement of the bound stack 13 on the cover assembly 2. Since the cover assembly 2 is never subjected to elevated temperatures, it is possible to print the cover assembly 2 using printing techniques that require heat sensitive inks.

The present invention greatly facilitates binding a book using the above-described bookbinding structures and similar structure. A technique for accurately and quickly scoring cover 2 is disclosed along with a technique for accurately and quickly positioning the stack 13 on the cover 2 and folding the cover 2 around the stack. These and other advantages of the present invention will become apparent to those skilled in the art upon a reading of the following Detailed Description of the Invention.

SUMMARY OF THE INVENTION

Apparatus and method of scoring a cover to be applied to a stack of sheets are disclosed. A base unit is provided having a cover receiving surface. A lower die holder is disposed below the cover receiving surface and extends across a width of the cover receiving surface. A lower die, also extending across the cover receiving surface is supported at an upper surface of the lower die holder. An upper die holder is disposed above and extends across the cover receiving. An upper die, which is supported at a lower surface of the upper die holder, also extends across the cover receiving surface.

The apparatus further includes an actuating structure configured to move the upper die holder between an open position so that a cover to be scored resting on the cover receiving surface can be inserted between the upper and lower die and a scoring position where the upper and lower die engage the cover for scoring. The upper die holder is fabricated of a material having optical characteristics which permit a user to view the upper die through the upper die holder. In one embodiment, the material is a transparent plastic.

DETAILED DESCRIPTION OF THE INVENTION

Figure 6:
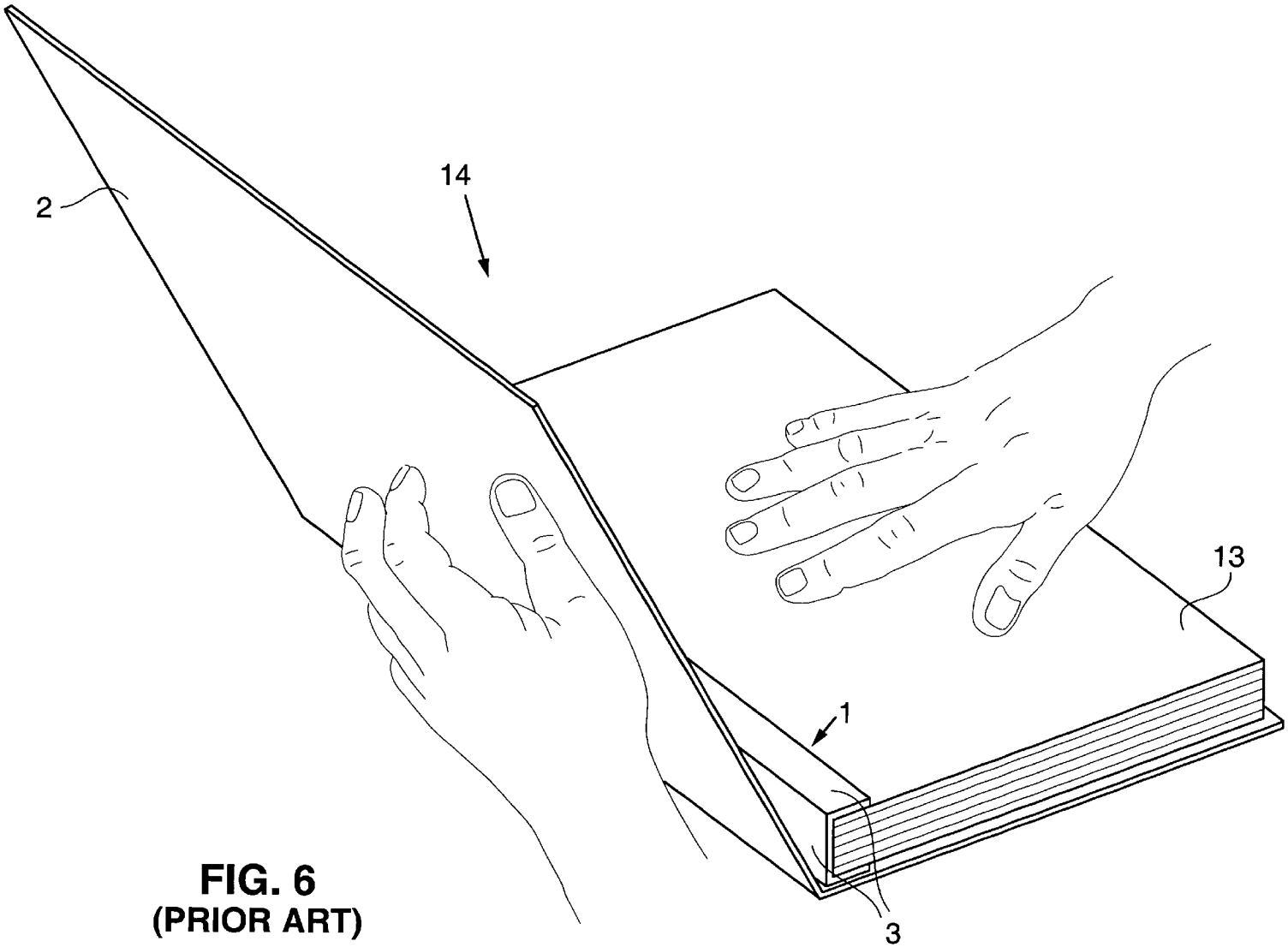
FIG. 6 (PRIOR ART)
FIG. 6 shows the wrap around book cover being folded over the book and adhered to the pressure activated adhesive of the first embodiment of the conventional bookbinding structure.
Figure 7:
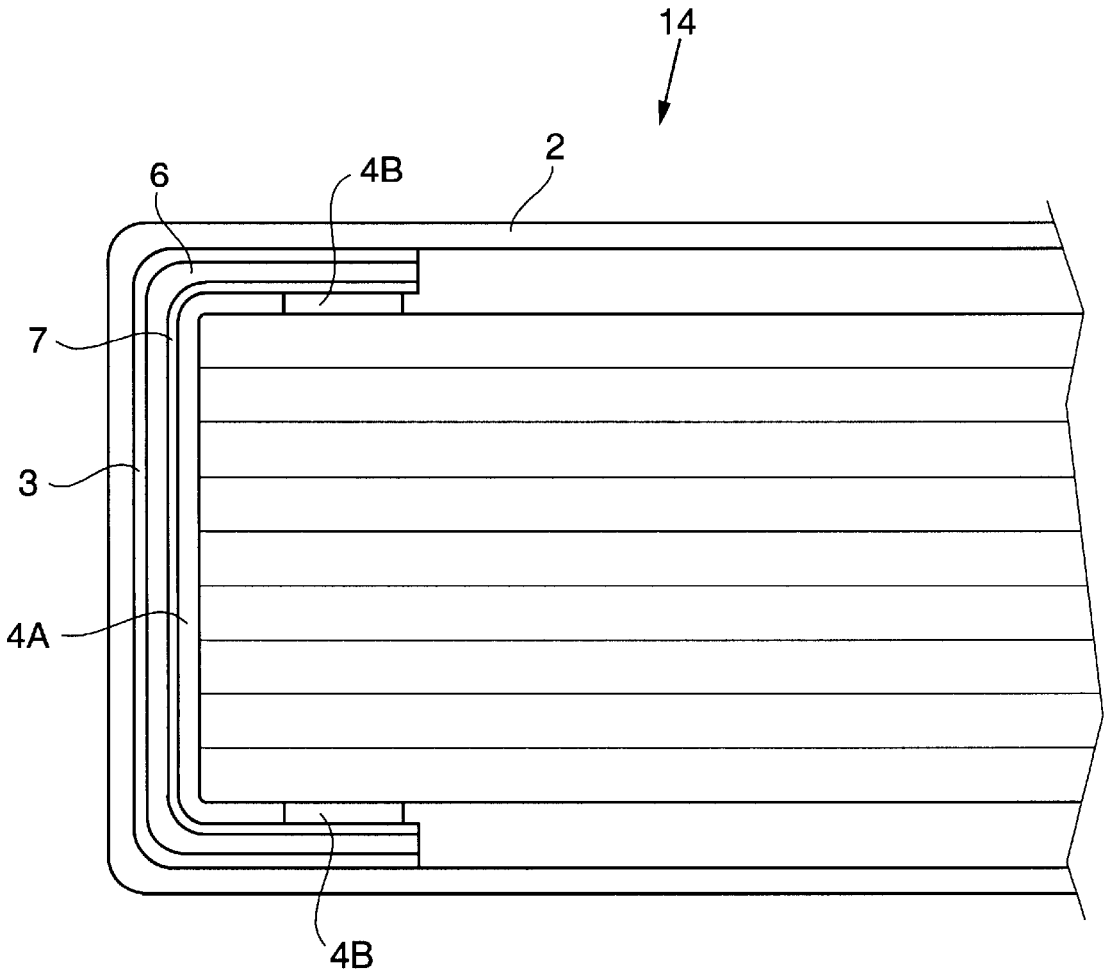
FIG. 7 (PRIOR ART)
FIG. 7 is an end view of the covered book bound with the conventional bookbinding structure of the first embodiment.
Figure 8A:
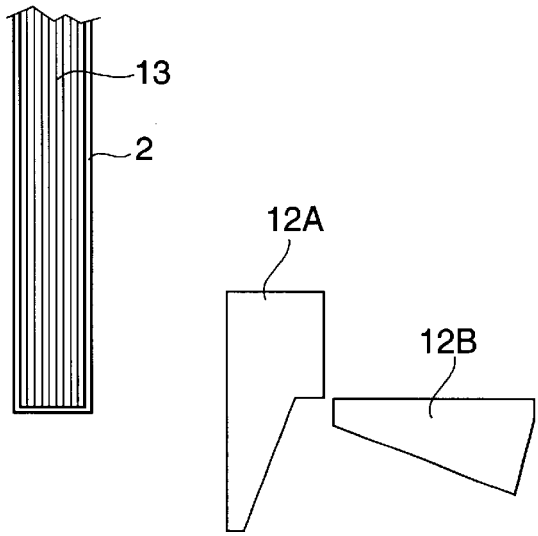
FIG. 8A (PRIOR ART)
FIGS. 8A through 8E show the sequence for attaching the cover to the bound stack using the second embodiment conventional bookbinding structure where the FIG. 2 binding machine is used to activate the adhesive used to attach the cover.
Figure 8B:
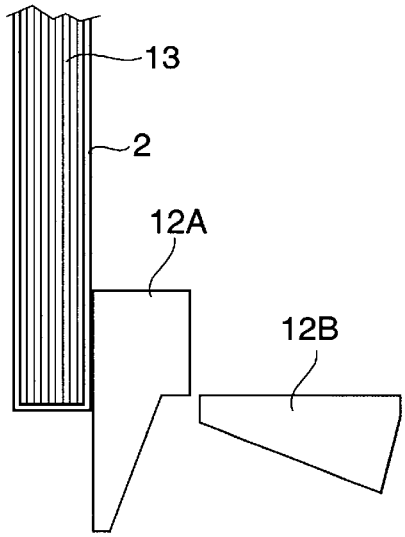
FIG. 8B (PRIOR ART)
Figure 8C:
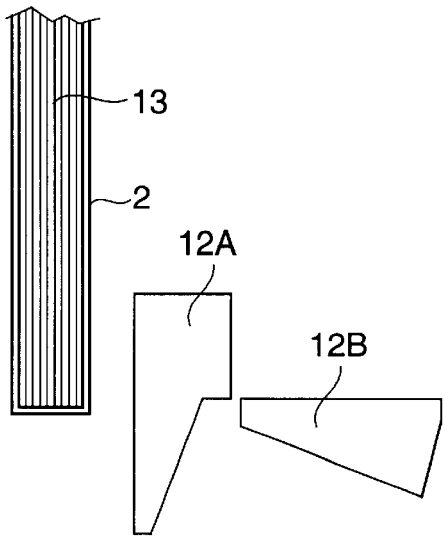
FIG. 8C (PRIOR ART)
Figure 8D:
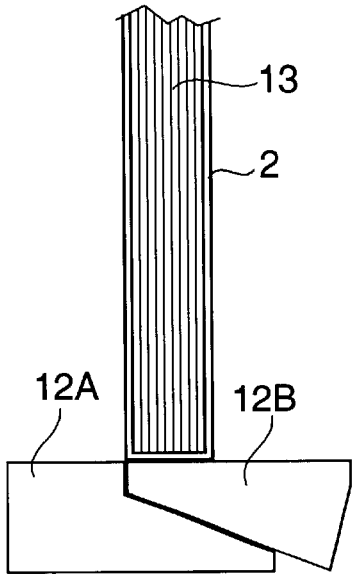
FIG. 8D (PRIOR ART)
Figure 8E:
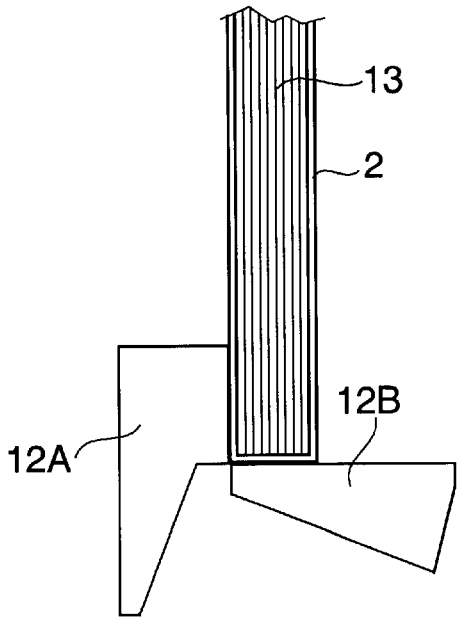
FIG. 8E (PRIOR ART)
Figure 9A:
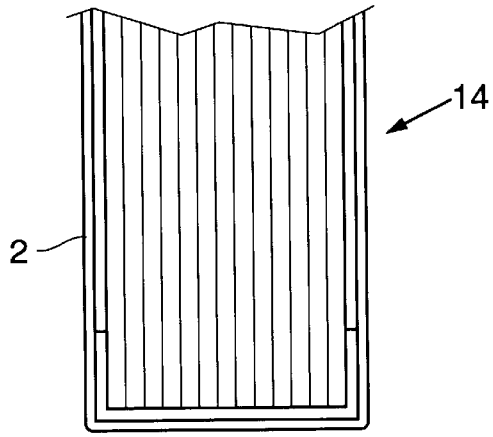
FIG. 9A (PRIOR ART)
FIG. 9A is an end view of a bound book having a wrap-around book cover which extends over the front, back and spine of the book.
Figure 9B:
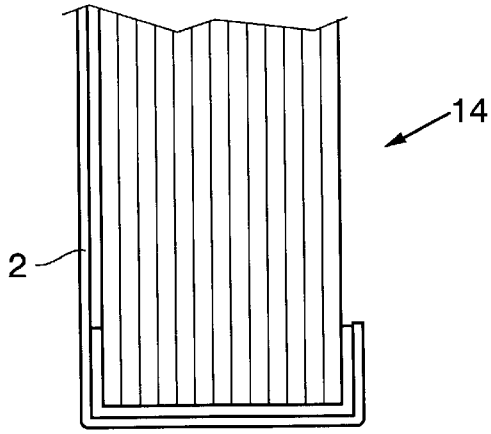
FIG. 9B (PRIOR ART)
FIG. 9B is an end view of a bound book having a wrap-around book cover which extends over the spine, the front and a small portion of the rear of the book.
Figure 9C:
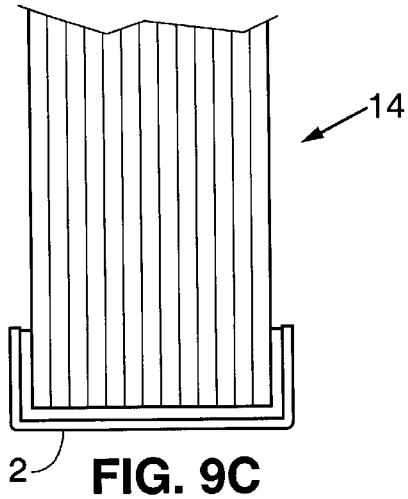
FIG. 9C (PRIOR ART)
FIG. 9C is an end view of a bound book having a cover which extends over the spine and a small portion of the front and rear of the book.
Figure 10:
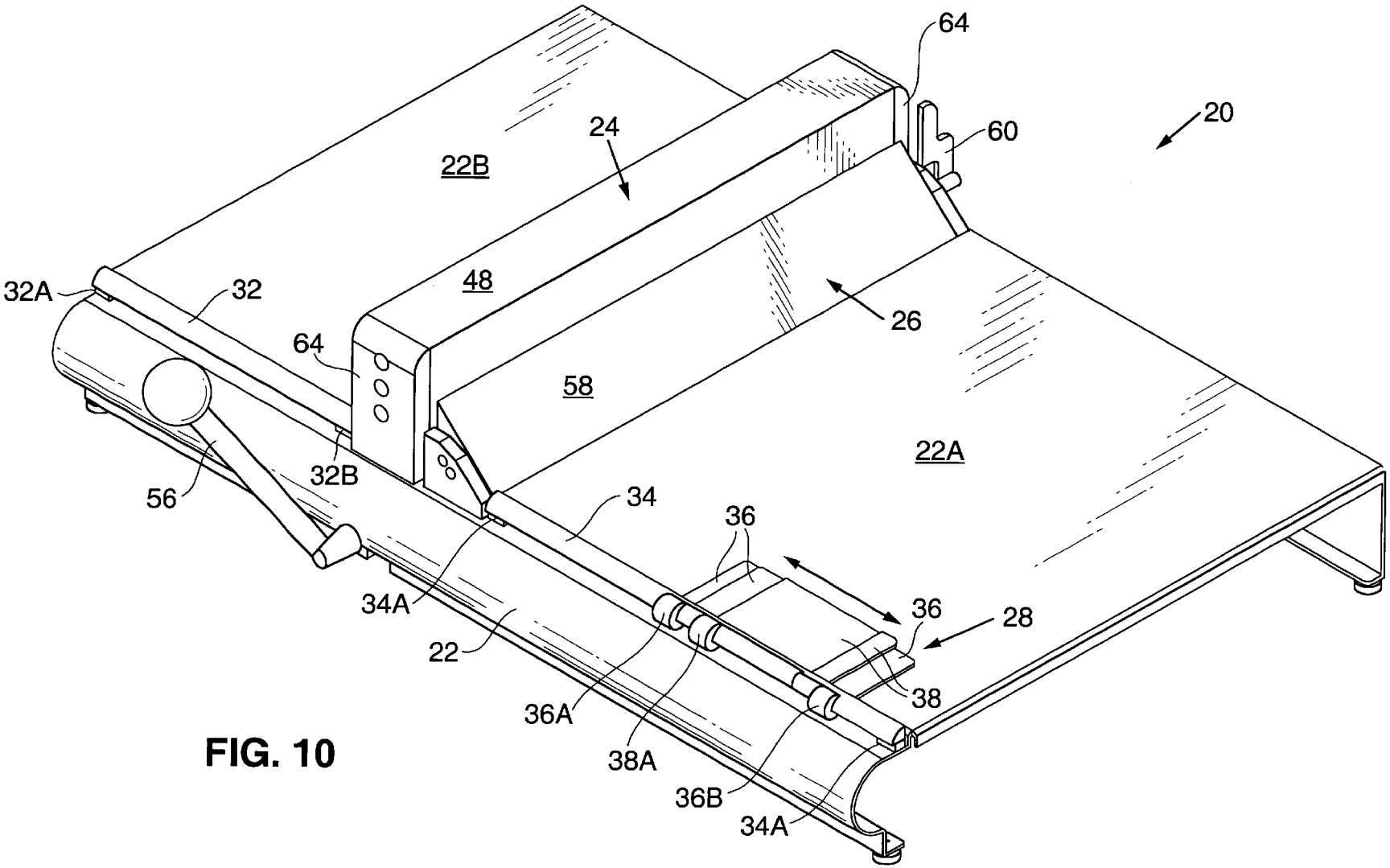
FIG. 10 is an elevational perspective view of the subject binding apparatus.

Referring again to the drawings, FIG. 10 is a perspective view of one embodiment of the subject binding apparatus 20. As will be explained in greater detail, the binding apparatus performs various steps in a binding sequence, including scoring the book cover 2 and securing the scored book cover 2 to the bound stack 13 in a manner superior to that illustrated in FIG. 6.

Figure 11:
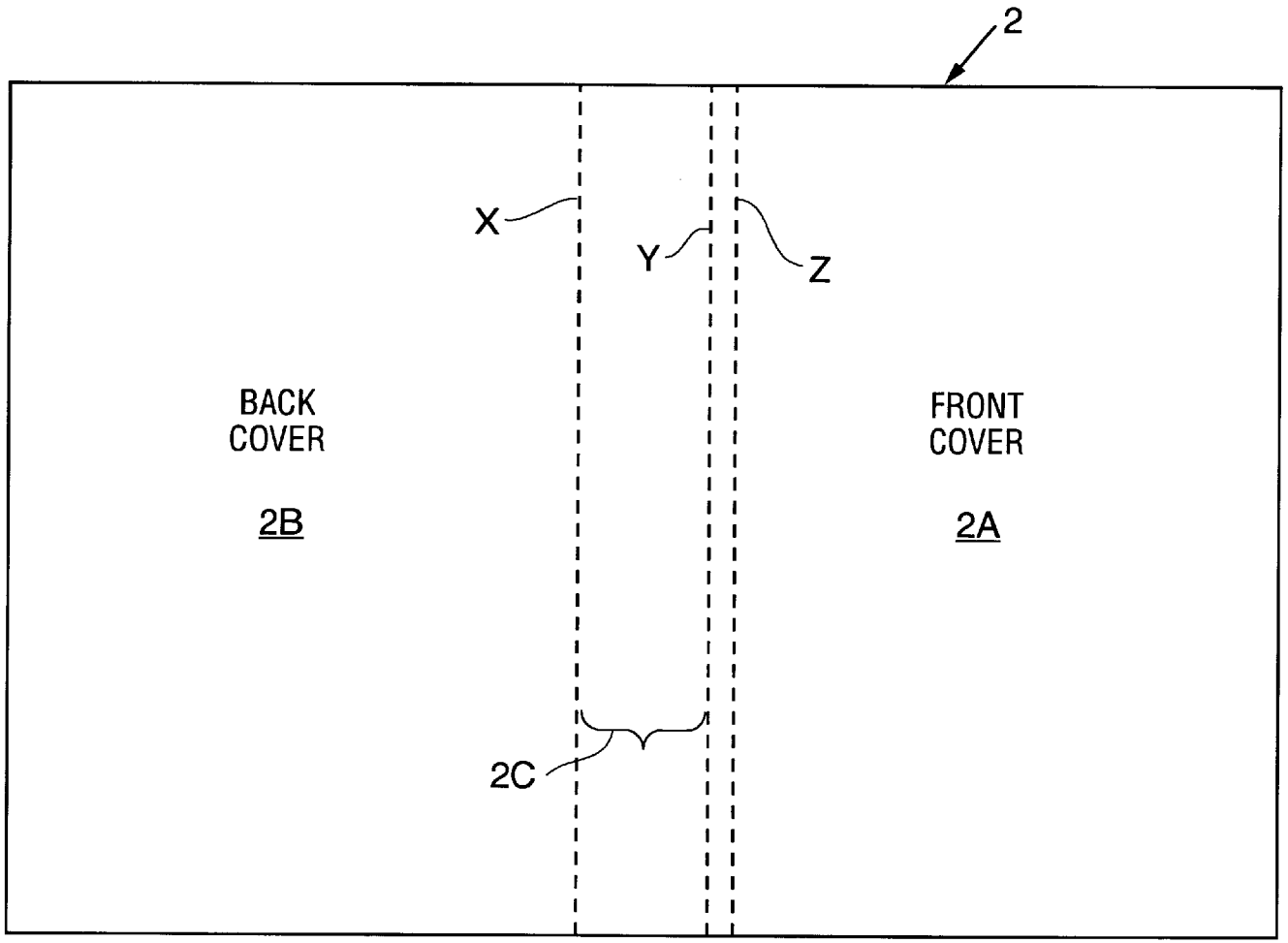
FIG. 11 is a top view of a soft cover which has been scored.

The binding apparatus 20 includes a base unit 22 which is typically 18½ inches long and 14 inches front to back so as to accommodate books of widely varying size. Base unit 22 is preferably primarily fabricated of steel. Base unit 22 includes an upper surface or bed divided into a first cover support surface 22A and a second cover support surface 22B, with the first and second support surfaces for receiving a cover 2. An exemplary cover 2 is shown in FIG. 11. Typically, the front portion of the cover 2, portion 2A, is positioned over the first support surface 22A and the back portion 2B of the cover is positioned over the second support surface 22B during the scoring sequence. The cover 2 is positioned with the printed side (or the side to be printed) facing up. Support surface 22A is preferably longer than support surface 22B by, for example, 7½ inches.

Among other things, the FIG. 10 binding apparatus operates to produce two scores in the cover 2, including score X, which separates the back portion 2B of the cover and the spine portion 2C, and score Y which separates the front cover portion 2A from the spine portion 2C. A third score Z is also preferably formed in the front cover portion 2A, with score Z both facilitating opening of the book and enhancing the appearance of the bound book. As will be described, an alternative embodiment binding apparatus produces a double score in lieu of score X and a double score in lieu of score Y. These double scores, which eliminate the need for score Z, are typically about 3⁄16 of an inch apart, facilitate the folding of the cover and enhance the appearance of the bound book.

The binding apparatus 20 includes a scoring assembly 24 mounted on the base unit 22 which divides the base unit surface into support surfaces 22A and 22B. As will be explained in greater detail, the scoring apparatus 20 includes male and female die. The cover 2 is placed on the base unit cover receiving surfaces 22A/22B and then positioned between the two die. Thus, when the die are forced together, the cover is scored at a predetermined location. A clamp assembly 26 is also mounted on the base unit 22 and operates to clamp the cover 2 down against support surface 22A along score X. This permits a user to fold the cover 2 upwards along score X and to then easily and accurately apply the cover 2 to the stack 13.

A first guide rail 32 is supported on the base unit along the edge of surface 22B. A second guide rail 34 is supported on the base unit along the edge of surface 22A and is in alignment with the first guide rail. The guide rails 32 and 34 have a generally D-shaped cross-section with the flat side of the cross-section facing surfaces 22A and 22B. The guide rails are supported above the base unit surfaces by posts 32A, 32B and 34A.

A stop assembly 28 is slidably mounted on guide rail 34 so that the assembly may be moved along the guide rail towards and away from the scoring assembly 24. The stop assembly 28 in one embodiment preferably includes magnetic elements which cause the assembly to be forced down against steel surface 22A so that the assembly remains in place after having been moved to a desired location. Stop assembly 28 includes a lower stop member 36 and an upper stop member 38, with upper member 38 being movable with respect to lower member 36. The upper and lower stop members are preferably fabricated from steel and have magnetic elements which cause the upper member 38 to remain in place with respect to the lower member 36 after the upper member has been positioned at a desired location relative to the lower member.

Figure 12:
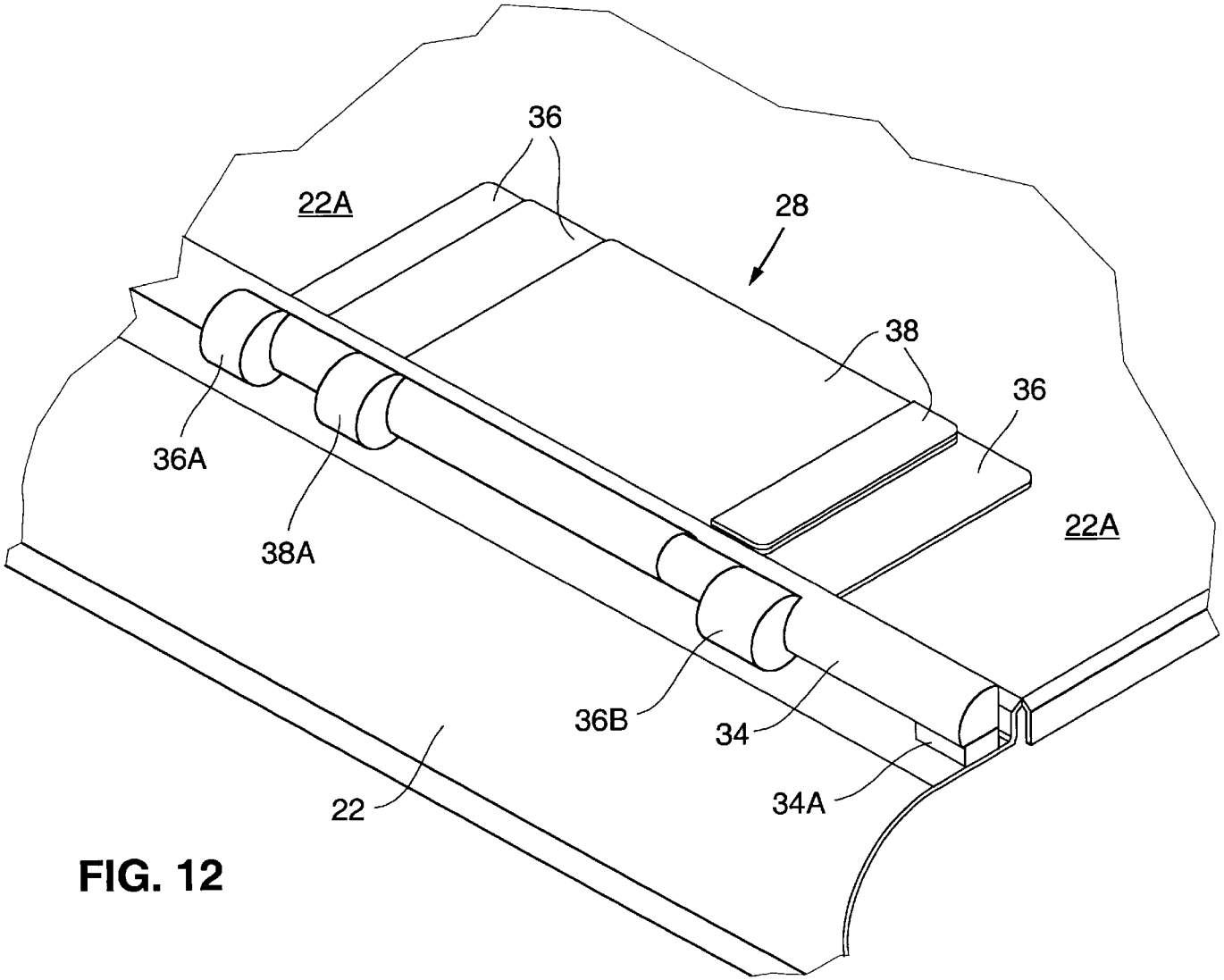
FIG. 12 is a partial perspective view of the stop assembly mounted on the base unit of the subject binding apparatus.
Figure 13:
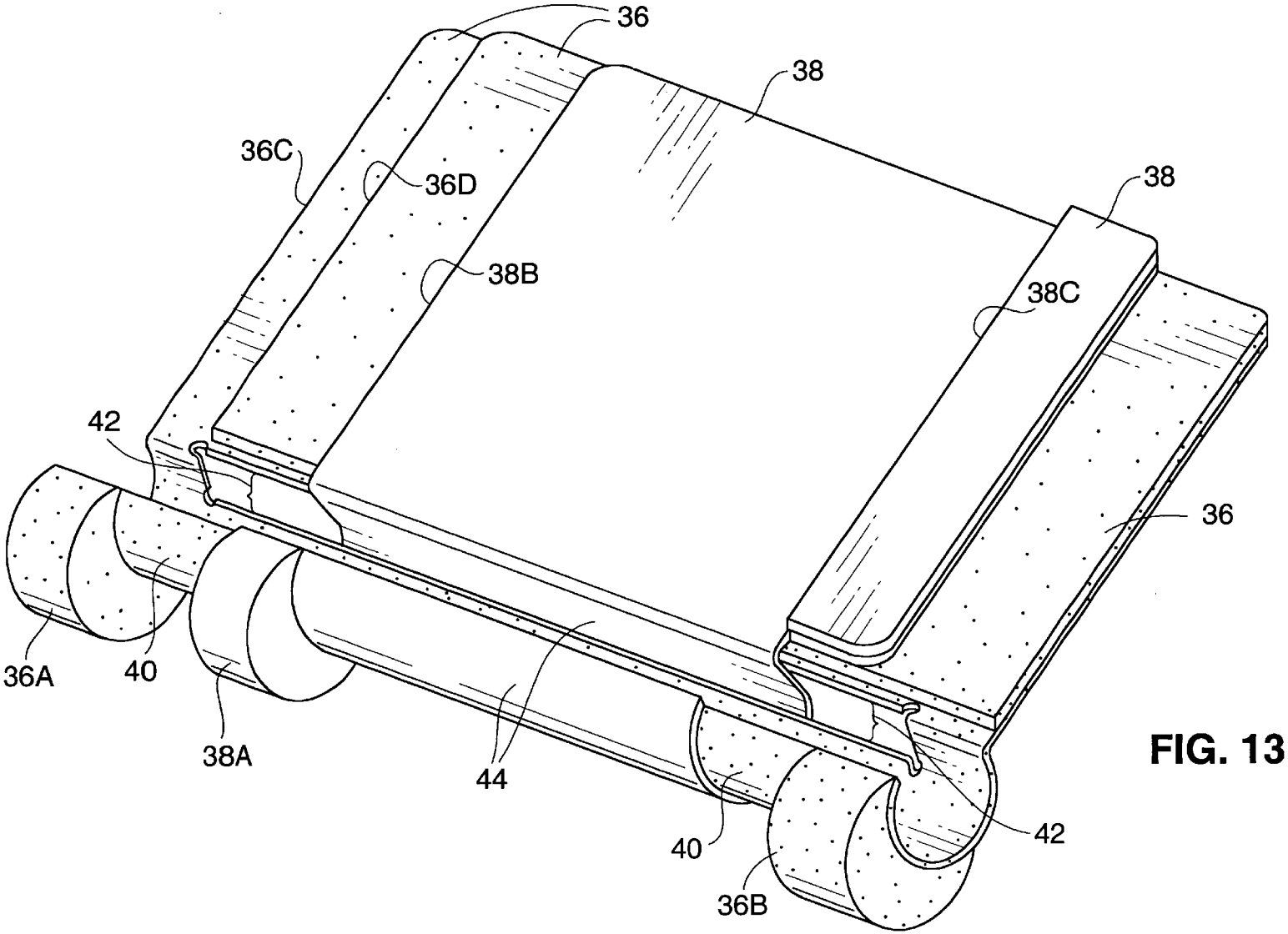
FIG. 13 is a perspective view showing additional details of the stop assembly.

As can best be seen in FIGS. 12 and 13, the lower stop member 36 includes a pair of tabs 36A and 36B which can be gripped by a user in order to move the entire stop assembly 28 along guide rail 34. The upper stop member 38 is provided with a tab 38A for moving the upper stop member relative to the lower stop member 36. In FIG. 13, the components of the lower stop member 36 are marked with stippling to distinguish the lower stop member 36 components from those of the upper stop member 38.

Figure 14:
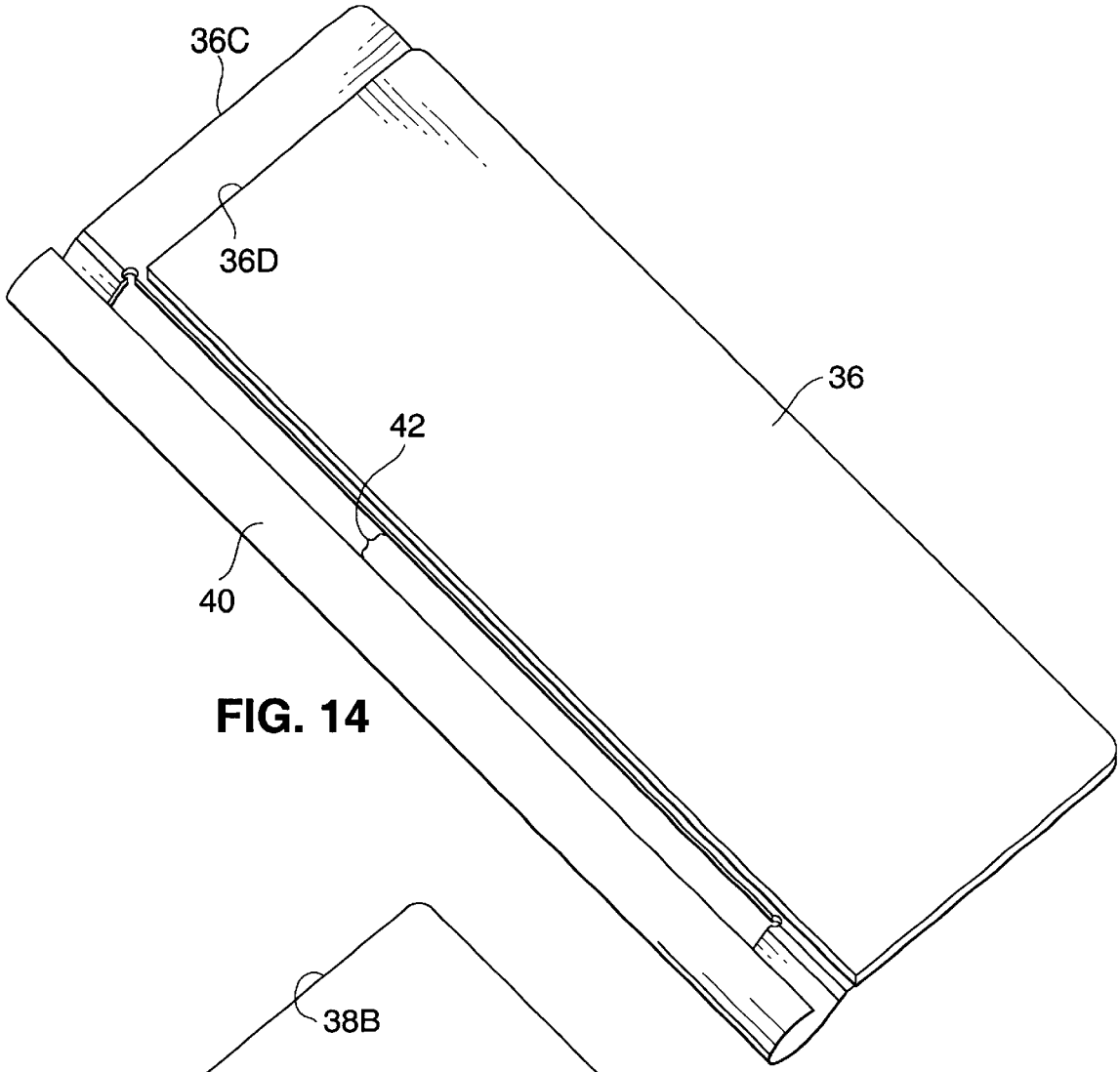
FIG. 14 is a perspective view of the lower stop member of the stop assembly.
Figure 15:
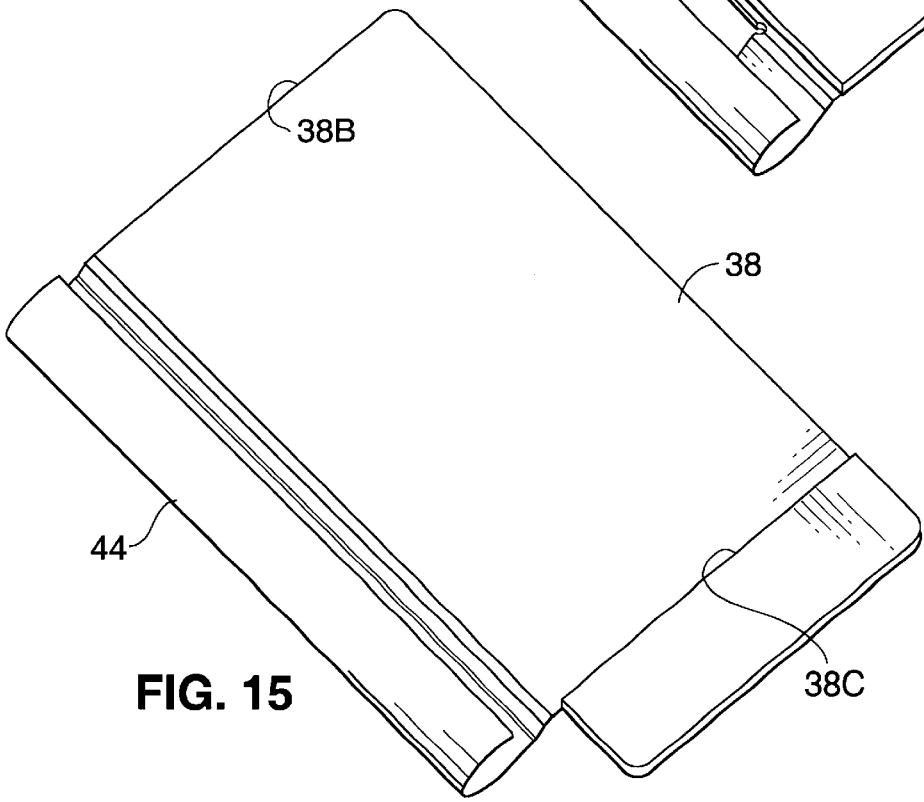
FIG. 15 is a perspective view of the upper stop member of the stop assembly.

FIG. 14 is a perspective view of the lower stop member 36, without tabs 36A and 36B. FIG. 15 is a perspective view of the upper stop member 38, without tab 38A. The lower stop member 36 includes a circular element 40 which extends under and around guide rail 34. The upper stop member 38 also includes a circular element 44 which, when combined with lower member 36, passes through opening 42 formed in lower member 36 and also extends around guide rail 34. Thus, the circular element 40 of the lower stop member 36 is nested within the circular element 44 of the upper stop member 38, intermediate element 44 and guide rail 34. When the upper stop member is moved relative to the lower stop member 36, the upper circular member 44 is translated along the length of opening 42 formed in the lower stop member.

Figure 16A:
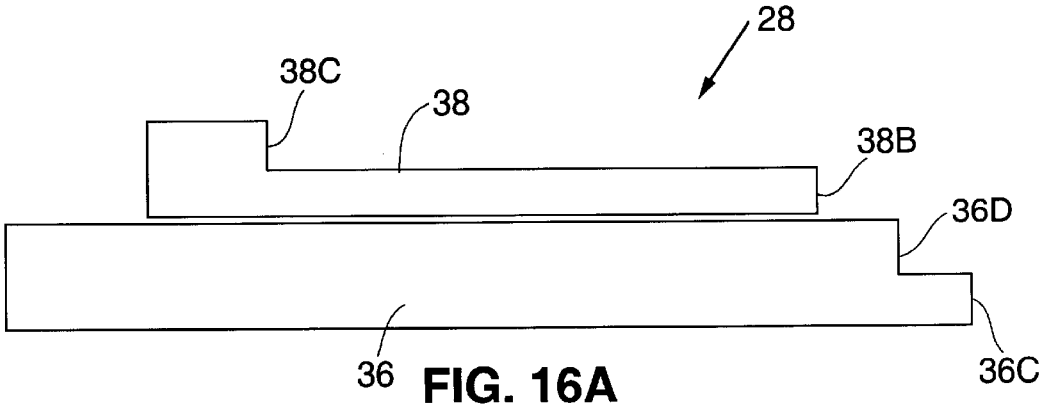
FIGS. 16A and 16B are schematic representations of the stop assembly, with the upper stop member being shown in two different positions.
Figure 16B:
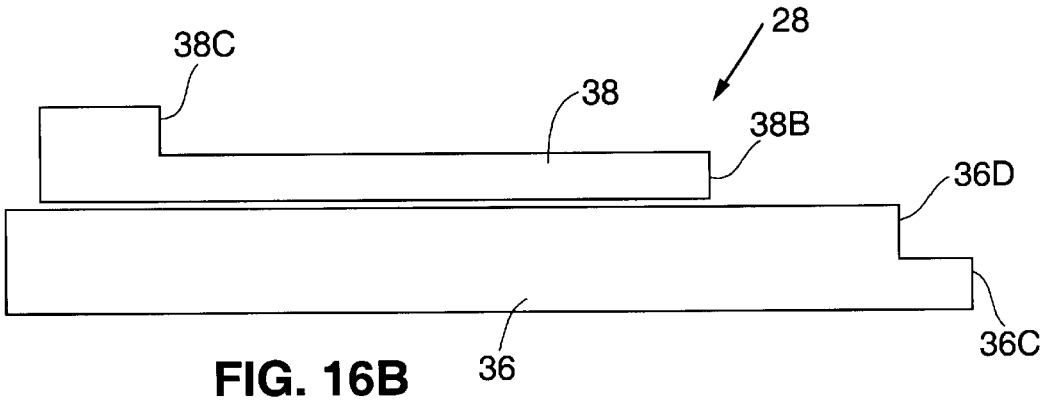

FIGS. 16A and 16B are schematic representations of a side view of the stop assembly 28, including elements that represent the upper and lower members 38 and 36. The figures are not drawn to scale. The stop assembly of FIG. 16A shows the upper and lower members positioned relative to one another for a book 13 which is relatively thin, with the stop assembly of FIG. 16B being positioned for a book that is relatively thick. As will be explained in greater detail, the stop assembly 28 defines four separate stops, against which an edge of the book 2 is positioned. Each stop is typically 0.030 inches high, with the total thickness of the stop assembly 28 being only about 0.120 inches so that the cover 2, when positioned over the stop assembly 28, is lying approximately flat against cover receiving surface 22A (FIGS. 10 and 12) of the base unit. Although not preferred, the stop members could all be implemented with visual stops rather than mechanical stops.

Referring to FIG. 16A, the lower stop member 36 defines a pair of stops 36C and 36D. As will be explained in greater detail, the relative positions of stops 36C and 36B is fixed and defines the spacing between scores Y and Z (FIG. 11). The upper stop member 38 defines stops 38B and 38C. The relative spacing between stops 38B and 36D is controlled by the relative positions of the upper and lower stop members 38 and 36 and is adjusted to correspond to the thickness of the book to be bound. FIG. 16B shows the stop assembly 28 in another position set to accommodate a book 13 some what thicker than the stop assembly shown in FIG. 16A. This is indicated by the larger spacing between stops 38B and 36D.

Figure 17:
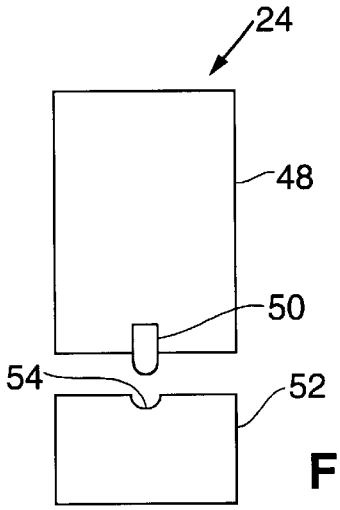
FIG. 17 is a schematic representation of the upper and lower die of the subject binding apparatus.
Figure 18:
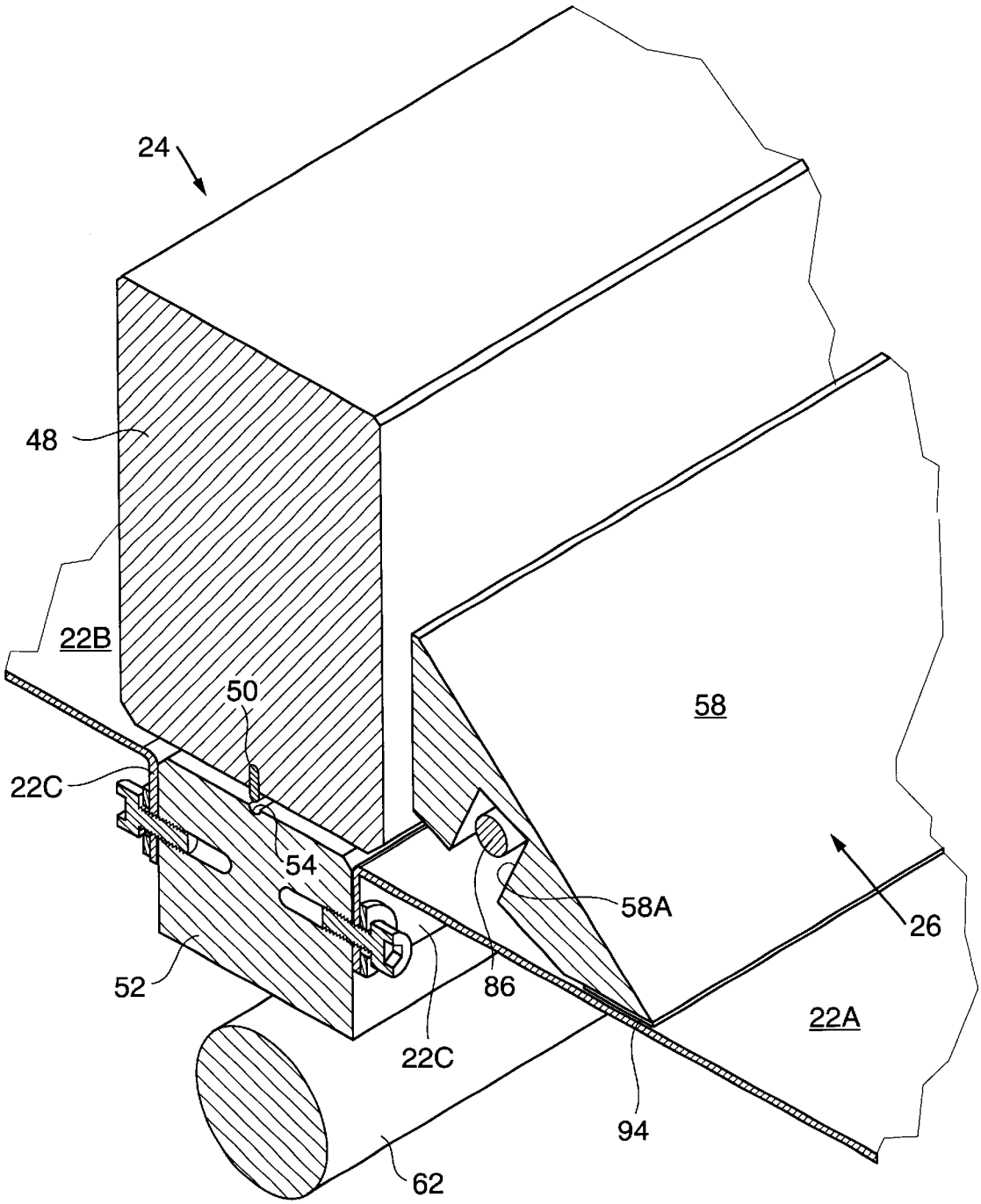
FIG. 18 is a cross-sectional view of the scoring and clamp assembly of the subject binding apparatus.

As previously noted, the scoring assembly 24 extends across the width of the base unit 22. FIG. 17 is a simplified end view of the primary components of the scoring assembly 24. FIG. 18 is a cross-sectional perspective view of the scoring assembly 24 and the clamp assembly 26, both of which are shown mounted on the base unit 22. An upper die holder 48 functions to support a steel male die 50 which extends the full length of the die holder. The die holder 48 is approximately 2 inches wide, 3½ inches high and 16½ inches in length. The die 50 is seated in a groove formed along the length of the die holder 48. Die holder 48 is fabricated from a transparent material, preferably a plastic sold under the trademark Acrylic, so that a user will be able to view the die 50 together with a cover 2 positioned below the die. A translucent, flexible adhesive can be used to secure die 50 within die holder 48 so that the die 50, which is preferably painted a dark color, can be readily viewed through the die holder 48. One such adhesive is manufactured by 3M under the name Scotch-Weld epoxy adhesive 2216B-A translucent. Screws can also be used to secure die 50 to die holder 48. As will be explained, the die holder 48 is mounted for vertical movement relative to the base unit 22 using a novel arrangement which does not interfere with the user's view of the male die 50 through the holder 48.

As can best be seen in FIG. 18, a steel die holder 52 is supported on the base unit 22 below the male die 50 by way of a pair flanges so that the upper surface of die holder 52 is substantially aligned with support surfaces of 22A and 22B of the base unit 22. The die holder 52 includes a semi-circular recess 54 (FIG. 17), typically having a radius of 0.030 inches which forms a female die. The lower portion of the male die 50 has a similar radius. In operation, a user depresses a scoring handle 56 (FIG. 10) which forces the upper die holder 48 and the upper male die 50 in a downward direction towards female die 54. The total force applied is typically on the order of 200 pounds. This will cause the book cover 2 positioned intermediate the two die to be scored along the full length of the two die.

Although a semi-circular die 50 and 54 can be used, it has been found that a female die in the form of an essentially rectangular slot can also be used together with a male die that is essentially rectangular. Typically, the female die has a width of 0.050 inches and a depth of 0.030 inches. The male die is 0.028 inches wide so as to proved a clearance of 0.011 inches between the made die and the walls of the female die. The lower edges of the male die and the upper edges of the female die are slightly rounded so as to avoid cutting the cover 2.

Figure 29A:
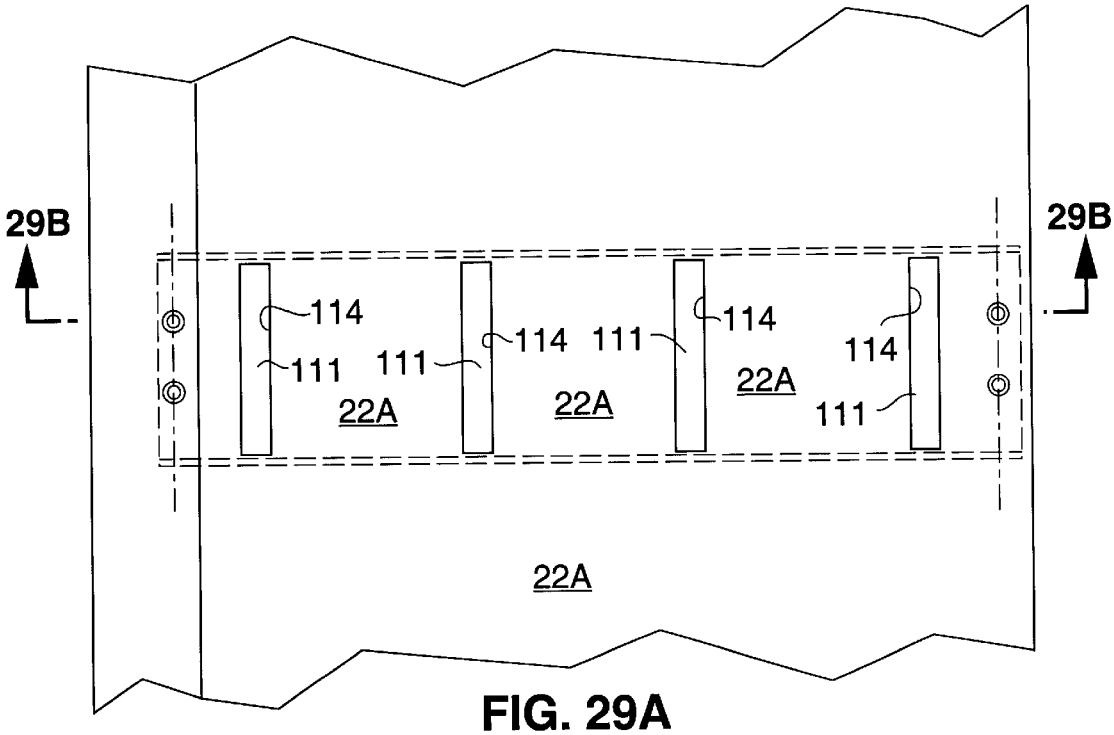
FIGS. 29A through 29D depict details regarding an alternative cover receiving surface which is resistant to adhesion of a book having an exposed adhesive present on the book being covered.
Figure 29B:
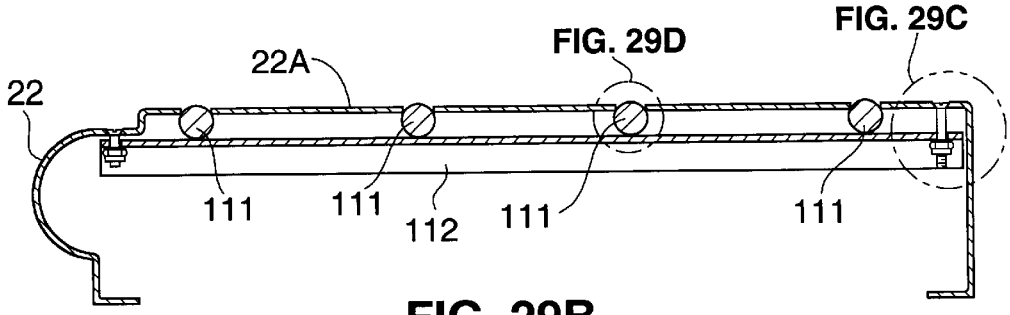

As will be described in greater detail, the pressure activated adhesive 3 on book 13 come in contact with the cover receiving surface 22A in the region adjacent the clamp assembly 26. Depending upon the adhesive 3 and the type of surface 22A, the adhesive may tend to adhere to the surface. FIGS. 29A and 29B show an alternative base unit 22 which includes plastic rods 111, such as Teflon brand plastic rods, which are positioned near surface 22A to eliminate potential adhesion of book 13 to the surface. The plastic rods 111 are positioned at four spaced-apart locations so that the rods are perpendicular to the scoring die, with the rods terminating at the outer edge of clamp bar 58 of the clamp and hold assembly (FIG. 10).

Figure 29C:
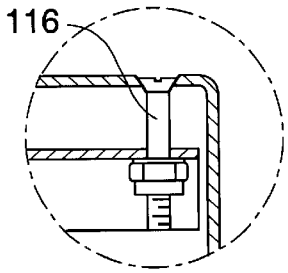
Figure 29D:
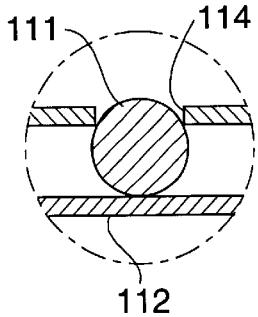
Figure 30:
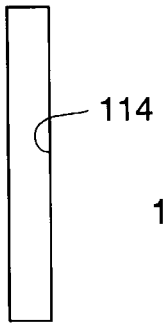
FIG. 30 depicts rectangular openings in the cover receiving surface for receiving plastic rods which reduce the tendency of a book to adhere to the cover receiving surface.
Figure 31:
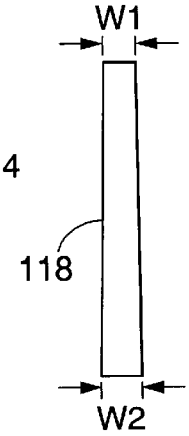
FIG. 31 depicts alternative tapered openings in the cover receiving surface for receiving the plastic rods noted above in connection with FIG. 30.

The rods are supported from below by a support plate 112 secured to the underside of base unit 22 by screws 116 (FIG. 29C). A series of rectangular slots 114 (FIG. 30) are formed in upper surface 22A of the base unit 22. As can best be seen in FIG. 29A, four of the slots 114 are formed in the upper surface 22A for receiving the rods 111. The rods are typically 0.5 inches in diameter, with the slot width being 11/32 of an inch wide so that a portion of the rod 111 will extend up past the surface 22A of the base unit 22, as can best be seen in FIG. 29D. The rods 111 and the slots 114 are typically 4 inches long. The slots can be made tapered as shown in FIG. 31, with the end having width W2 being closest to the clamp bar 58 being greater, 13/32 inches for example, than the width W1, 11/32 inches for example. This results in the height of the bar extending above the surface 22A at end W2 to be 0.040 inches, with the height dropping to 0.010 inches adjacent the clamp bar. This difference in height ensures that the rods 10 near the clamp bar do not interfere with the clamping of the cover 2.

Figure 4:
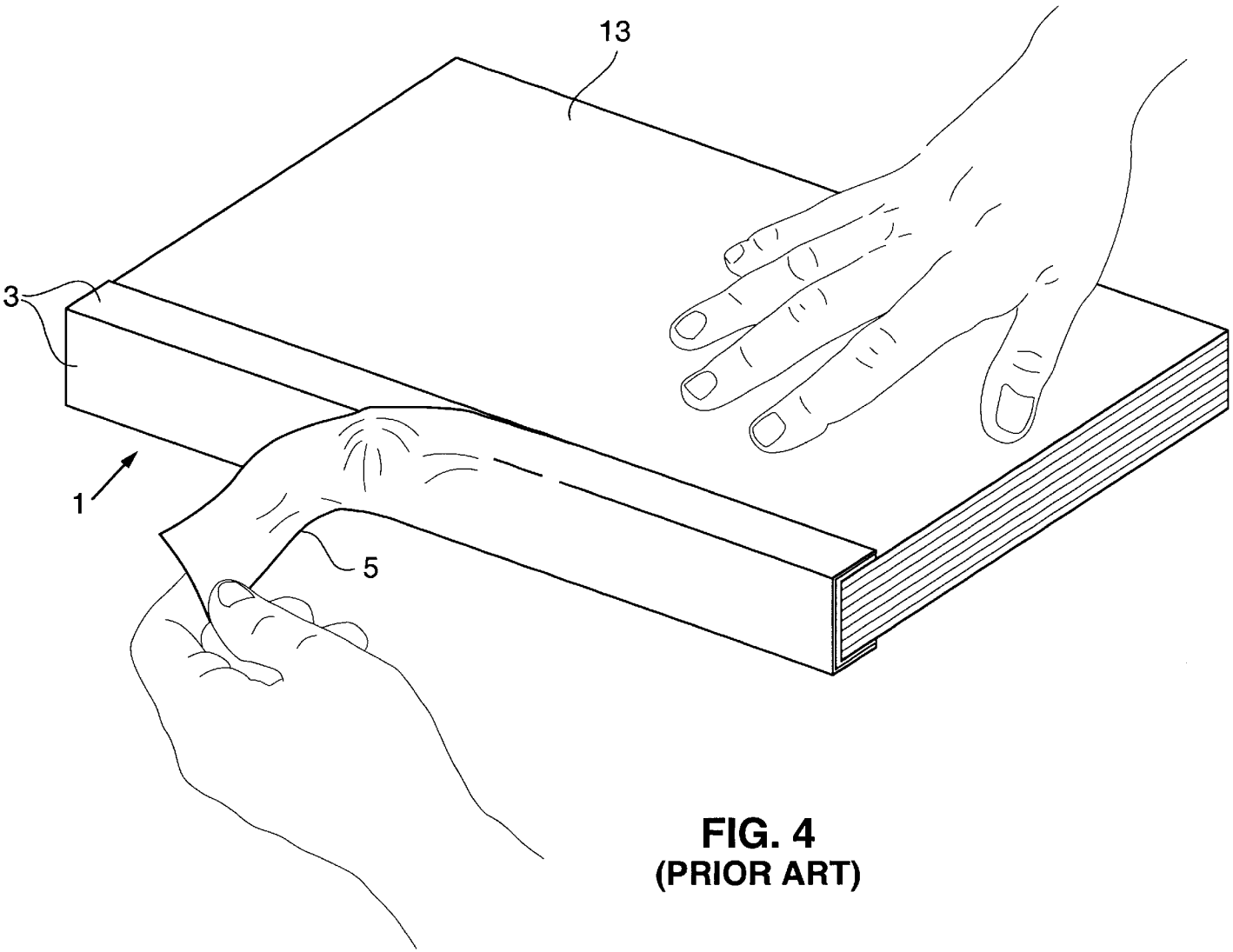
FIG. 4 (PRIOR ART)
FIG. 4 shows the release liner being peeled away from the pressure activated adhesive of the first embodiment conventional bookbinding structure after the book has been bound.
Figure 5:
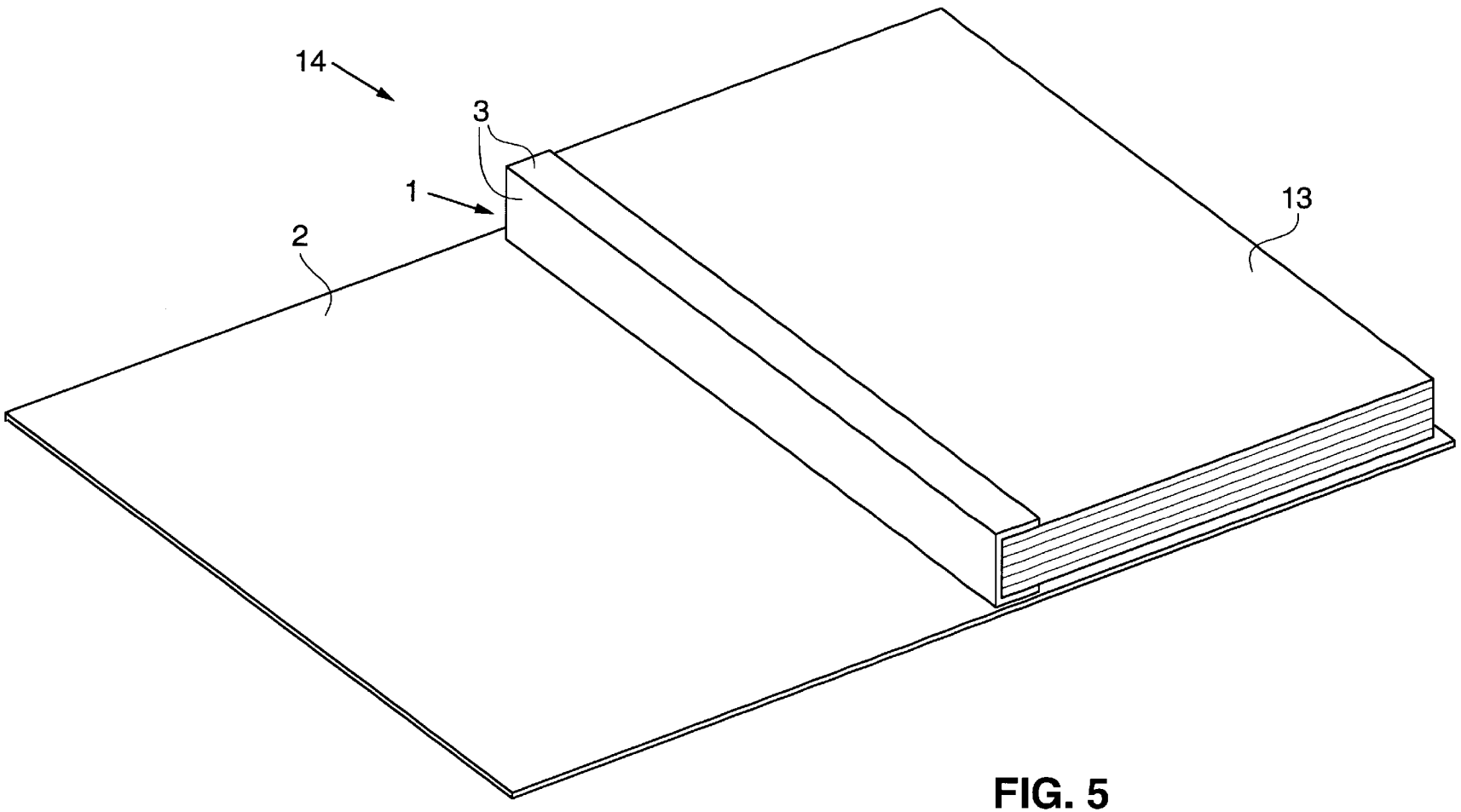
FIG. 5 (PRIOR ART)
FIG. 5 is a perspective view of the bound book positioned on a wraparound book cover prior to folding of the cover.

Before describing the mechanism for driving the male die 50, a general overall description of the operation of the subject bookbinding apparatus will be given. A stack of sheets are first bound using, for example, the binding structures shown in FIGS. 1A, 1B or 1C to create a bound, coverless, book or stack 13 such as shown in FIG. 4. A book cover 2 is printed with the desired information on the front and back covers and on the spine section. The book cover 2 is typically oversized so that, after being applied to the bound stack 13, the edges can be trimmed to fit. In the event the adhesive layer is heat activated, such as layer 7 of the FIG. 1B structure, the binding sequence will include steps similar to that shown in FIGS. 8A, 8B, 8C, 8D and 8E. In that event, the inks used in printing cover 2 must be resistant to heat.

The sequence for applying cover 2 to the bound stack includes the first step of measuring the thickness of the stack 13. A user positions an edge of the stack 13 between tabs 36A and 38A of the stop assembly (FIG. 10, for example). The user then moves tabs 36A and 38A together so that the tabs contact the first and last pages of the stack. This step adjusts the relative positions of the upper and lower stop members 36 and 38, as can best be seen in FIGS. 16A and 16B, so that the distance between stops 38B and 36D is equal to the thickness of the stack 13, as previously noted. Once the upper stop member 38 has been set relative to the lower stop member 36, the user will manipulate the stop assembly 28 using only tabs 36A and 36B connected to the lower stop member 36 so as not to disturb the relative positioning of the upper and lower members. The position of the lower stop member 36 relative to the upper stop member will tend to remain fixed due to the magnetic attraction between the two members.

After having measured the book 13 thickness, the book is set aside. Handle 56 is moved to lift the upper die holder 48 so that the cover 2 can be positioned on the cover receiving surfaces 22A and 22B of the base unit 22, intermediate the male and female die 50 and 52 (FIG. 17) of the scoring assembly 24. Preferably, the stop assembly 28 is moved using tabs 36A and 36B away from the scoring assembly 24 to allow the cover 2 to be more readily positioned. The lower portion of the cover is positioned abutting guide rails 32 and 34 so that the cover is orthogonal with respect to the die of the scoring assembly 24. The printed side of the cover 2 is facing up and with the front cover portion 2A generally overlying surface 22A and the back cover portion generally overlying surface 22B. The user then views the cover 2 through the transparent die holder 48 and aligns the male die 50 with the location where score X (FIG. 11) is to be formed. This location can, for example, be marked during the printing process by a reticule. If the cover 2 is to be trimmed after binding, satisfactory results can be achieved by simply approximating the position of the X score.

Figure 19A:
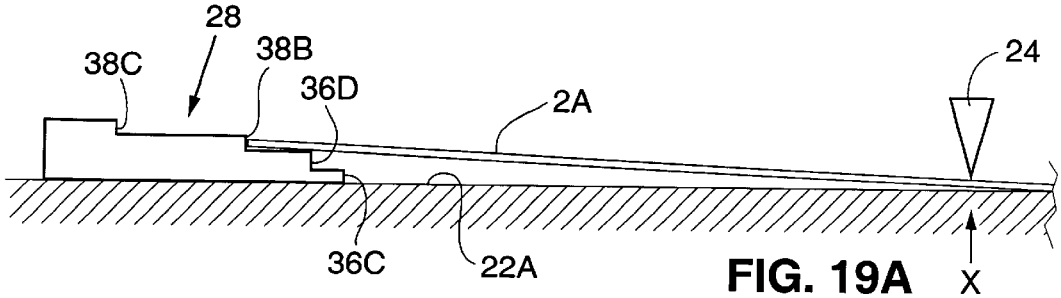
FIGS. 19A–19E are schematic representations of the sequence for scoring a soft cover and for folding a soft cover.

After the cover 2 has been properly positioned on the base unit 22, the user maintains the position by applying a slight downward force on the cover. The subsequent scoring operation will now be described in connection with FIGS. 19A–19E, which are not drawn to scale. During this sequence, the user should take care not to disturb the position of upper stop member 38 relative to lower stop member 36. Referring to FIG. 19A, the user first moves a portion of the stop assembly 28 back towards the scoring assembly 24, using tabs 36A and 36B, until the edge of the front cover portion abuts stop 38B. It is necessary to lift the edge slightly so that the cover can pass over stops 36C and 36D. The stop assembly 28 is now in the proper position and should not be moved until the sequence is completed. The magnetic components in the stop assembly 28 will be attracted to base unit 22 thereby tending to hold the assembly in place.

With the cover edge at stop 38D, the cover is correctly positioned to make score X. The user depresses and releases handle 56 thereby creating the first score. The user then moves the front cover portion 2A from the position shown in FIG. 19A abutting stop 38B to the position shown in FIG. 19B abutting stop 36D. Handle 56 is again depressed and released thereby forming score Y. The spacing between score X and score Y will be equal to the thickness of the stack 13. Next, the front cover is moved from the position shown in FIG. 19B to the position shown in FIG. 19C where the cover is abutting stop 36C. The user then creates score Z by depressing and releasing handle 56.

It has been found that when cover 2 is scored, the U shape of the score slightly distorts the linear dimensions of the cover. Thus, in order to insure that the spacing between scores X and Y corresponds very closely to the width of the stack 13, the spacing between stops 38B and 36D can be adjusted to be slightly greater the spacing between tab members 36A and 38A. The actual adjustment will be a function of the shape of the score, something that will vary depending upon various factors including the shape of die 50 and 52. The slight adjustment of the relationship between stop 38B and tab 38A and/or of the relationship between stop 36D and tab 36A will be a function of the order in which the scores X and Y are formed. In that case, the order should be maintained. In most application however, the distortion caused by the scores can be ignored so that the spacing between stops 38B and 36D can be made essentially equal to the spacing between tabs 36A and 38A. In that event, the order in which the scores are formed is not critical.

Figure 19B:
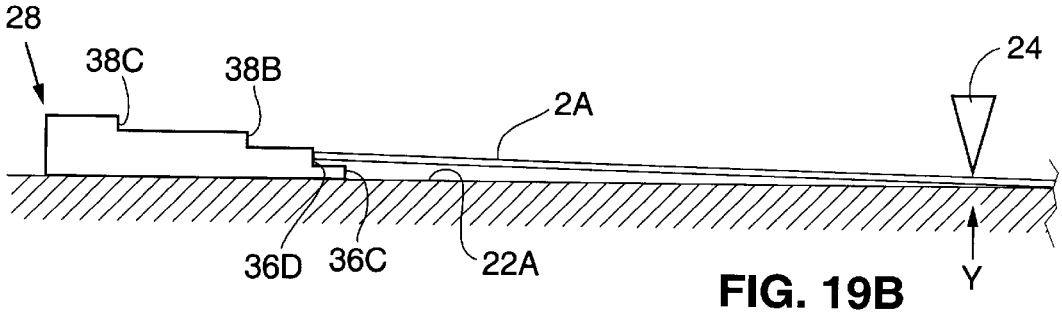
Figure 19C:
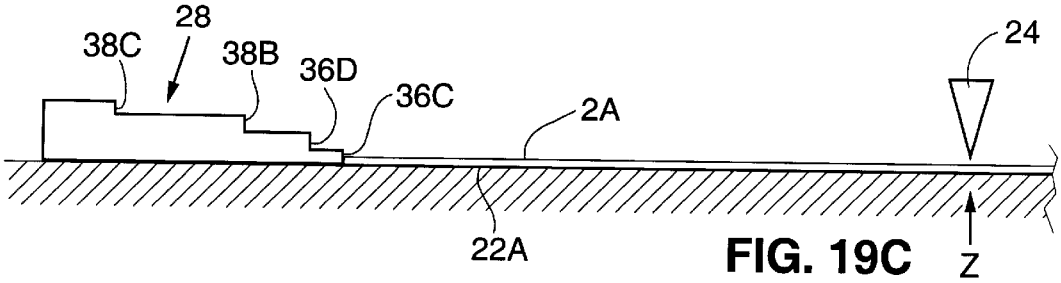
Figure 19D:
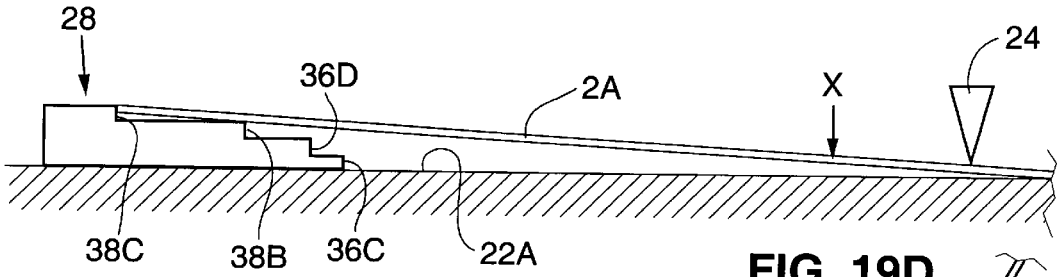

This concludes the scoring operation, with the remaining step relating to securing the cover 2 to the stack 13. The user then first moves the front cover portion 2A from the position shown in FIG. 19C to the position of FIG. 19D where the cover is positioned with the edge abutting stop 38C. The spacing between stop 38B in FIG. 19A, which is used to form score X, and stop 38C in FIG. 19D is a fixed value equal to the spacing between the male die 50 of the scoring assembly 24 and the outer edge of clamp bar 58 of the clamp assembly 26. Thus, when the front cover portion 2A is moved to the FIG. 19D position, score X will be directly below the outer edge of the clamp bar 58 of the clamp assembly 26.

Once the user has positioned the front cover portion 2A at stop 38C, the user actuates the clamp handle 60 thereby forcing the outer edge of clamp bar 58 down against the cover resting on cover receiving surface 22A. The user can then release the clamp handle 60, with the clamp assembly 26 remaining in the clamped position until the user moves handle 60 back to the original position shown in FIG. 10. As can best be seen in FIGS. 19E and 20, the user then folds the cover 2 up and over the clamp bar 58 thereby folding the cover along the X score.

Figure 1A:
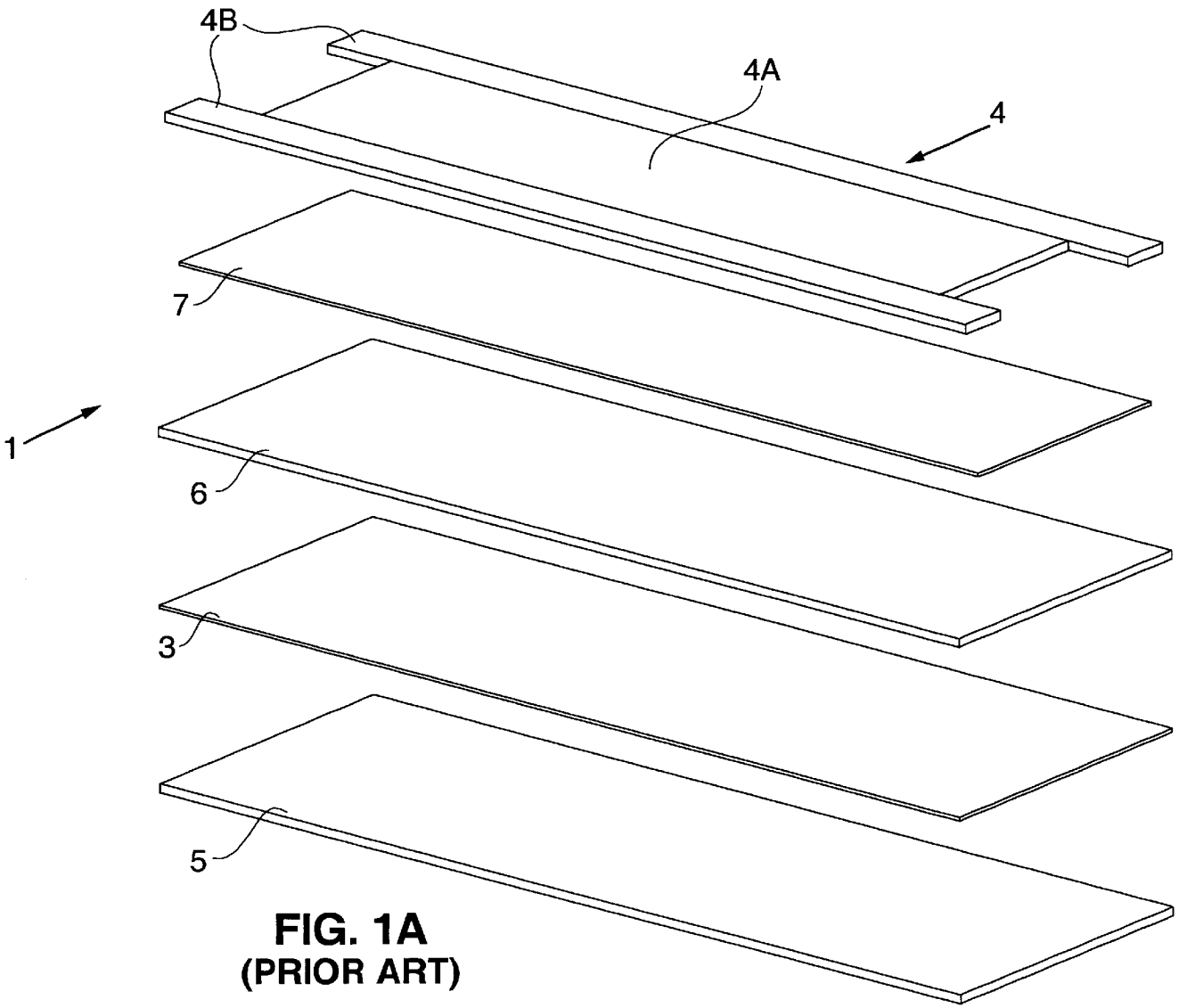
FIG. 1A (PRIOR ART)
FIG. 1A is an exploded view of the various layers of a first embodiment of a conventional bookbinding structure.
Figure 1B:
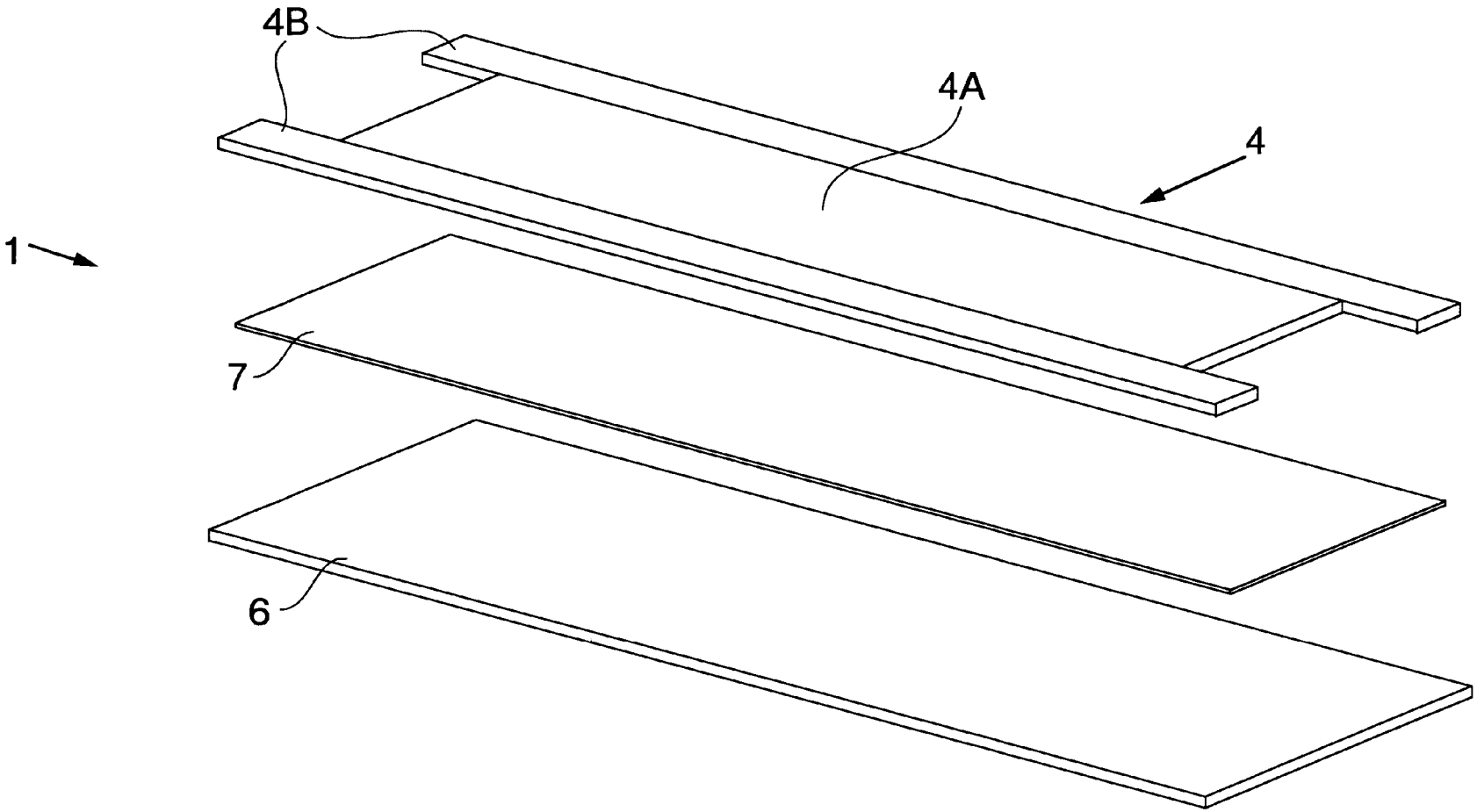
FIG. 1B (PRIOR ART)
FIG. 1B is an exploded view of a second embodiment of a conventional bookbinding structure.

Assuming that the stack 13 was bound using the FIG. 1A embodiment binding structure, the user removes the release liner 5 as shown in FIG. 4 so as to expose the pressure activated adhesive 3. The user then carefully positions the bound stack 13 on surface 22A, using rail 34 and the folded edge of cover 2 as a guide, with the back page of the stack resting on surface 22A and with the edge of the stack positioned adjacent the folded edge of the cover 2.

When the stack 13 has been properly positioned, the user carefully moves the cover 2 to a vertical position, forcing the spine cover portion 2C (FIG. 11) against the edge of the stack. Next, the cover 2 is folded along score Y so that the front cover portion 2A is flat against the front page of the stack 13. The user then releases clamp handle 60 and lifts the stack 13 and partially attached cover off of surface 22A and then manually folds the cover along score X until the back cover portion 2B is flat against the back page of the stack. The user then presses the cover 2 against stack 13 in the spine region to ensure that adhesive 3 is in full contact with the stack. The completed book can then be trimmed, if necessary, so that the cover 2 exactly matches stack 13. This latter step can be carried out with well know book cutting apparatus, sometimes referred to as a guillotine.

Figure 1C:
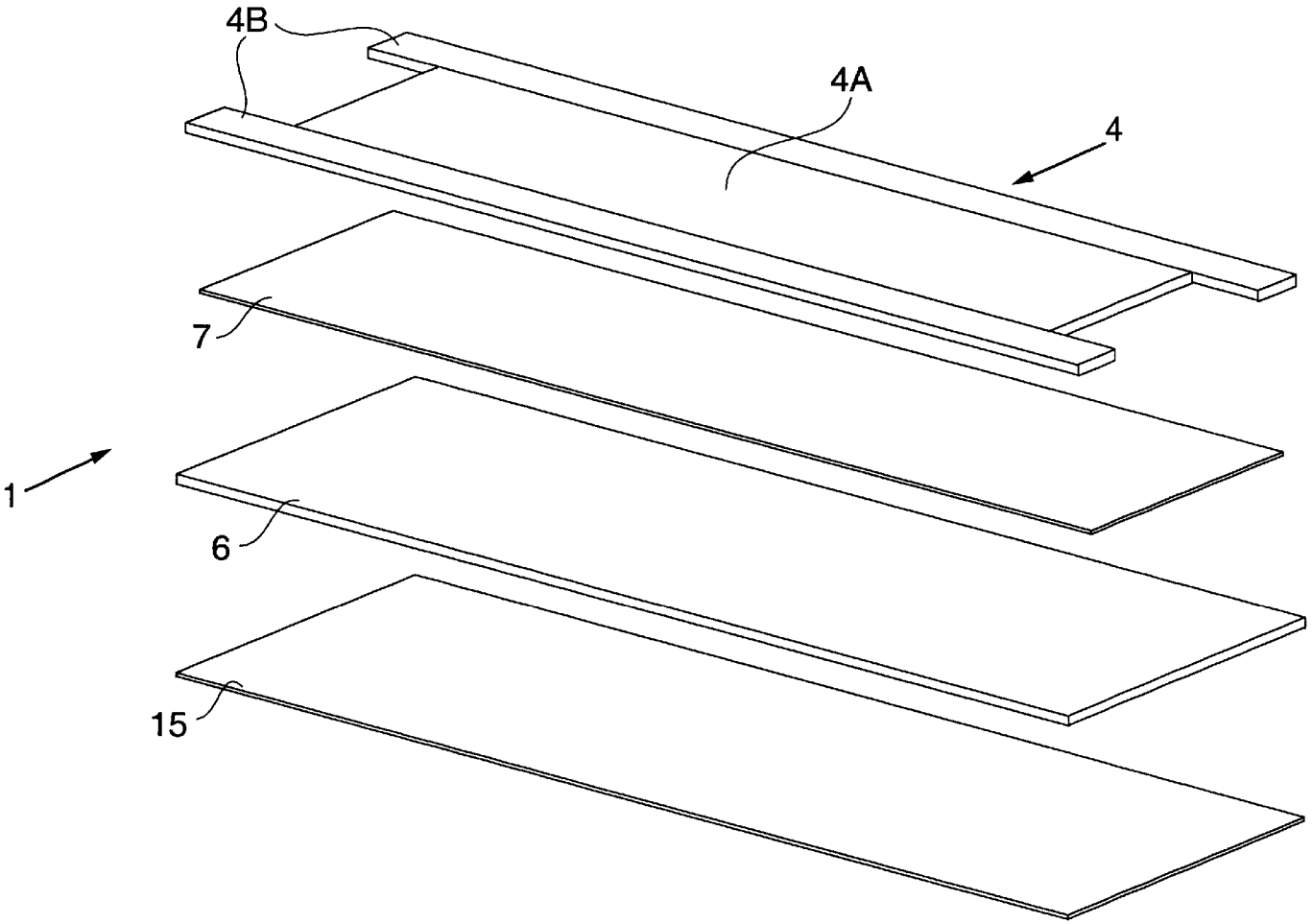
FIG. 1C (PRIOR ART)
FIG. 1C is an exploded view of a third embodiment of a conventional bookbinding structure.

The binding sequence is similar if the FIG. 1C bookbinding structure is used.

Figure 2:
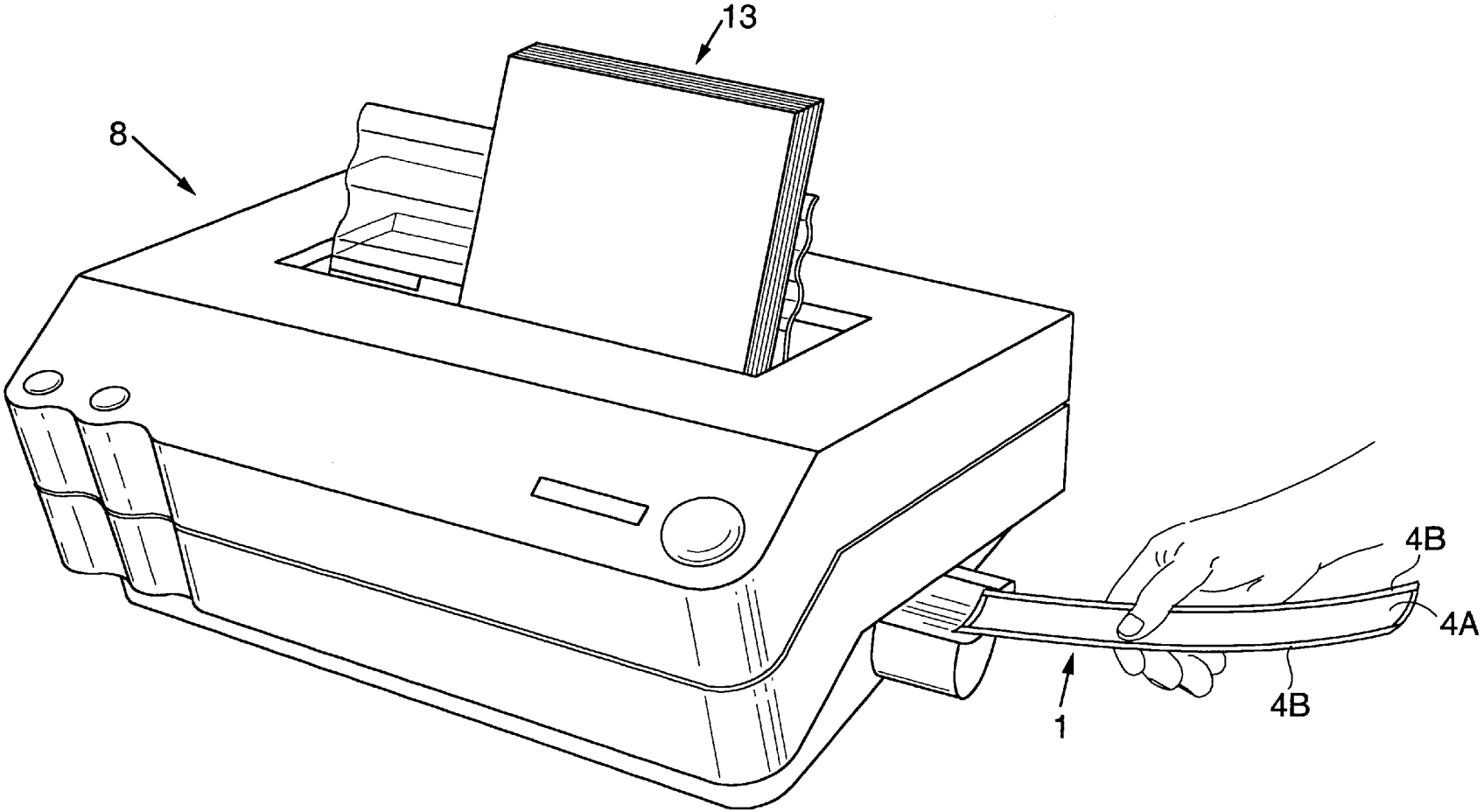
FIG. 2 (PRIOR ART)
FIG. 2 shows the conventional bookbinding structure being inserted into a conventional binding machine to bind the pages.
Figure 3A:
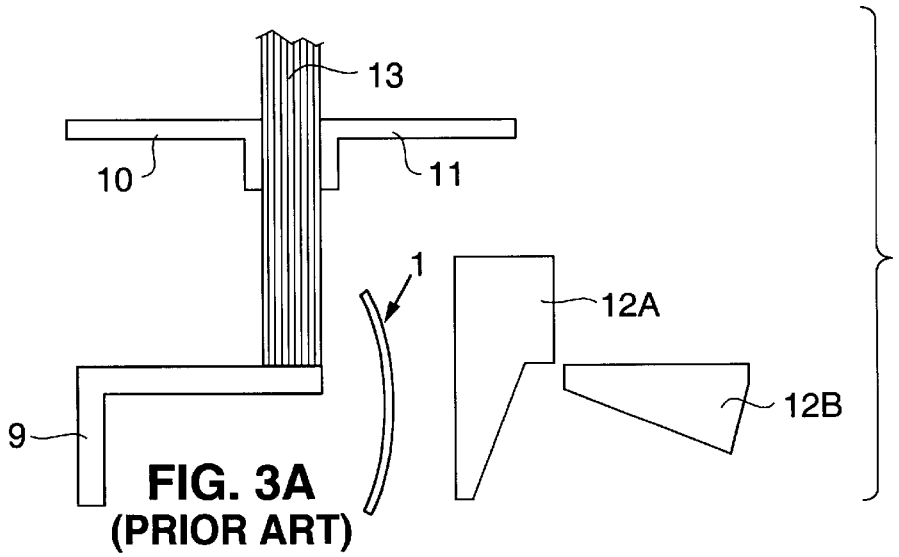
FIG. 3A (PRIOR ART)
FIGS. 3A–3E show the sequence of binding a stack using the conventional bookbinding apparatus and the binding machine of FIG. 2.
Figure 3B:
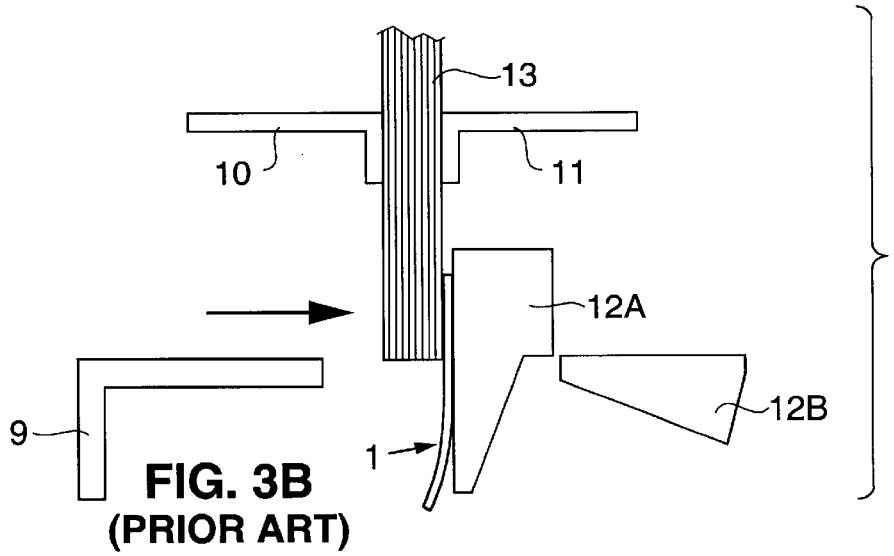
FIG. 3B (PRIOR ART)
Figure 3C:
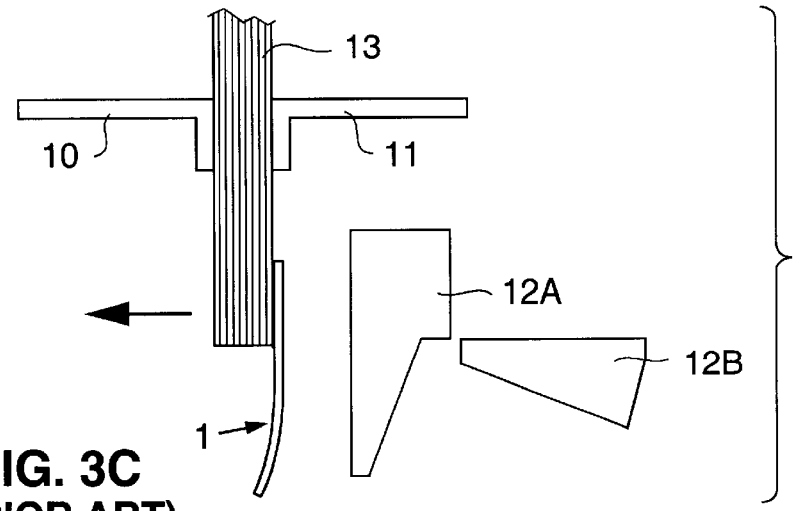
FIG. 3C (PRIOR ART)
Figure 3D:
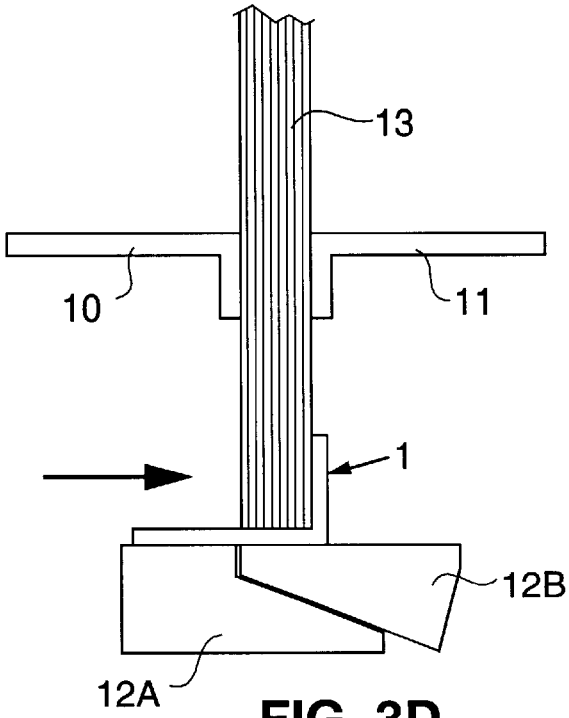
FIG. 3D (PRIOR ART)
Figure 3E:
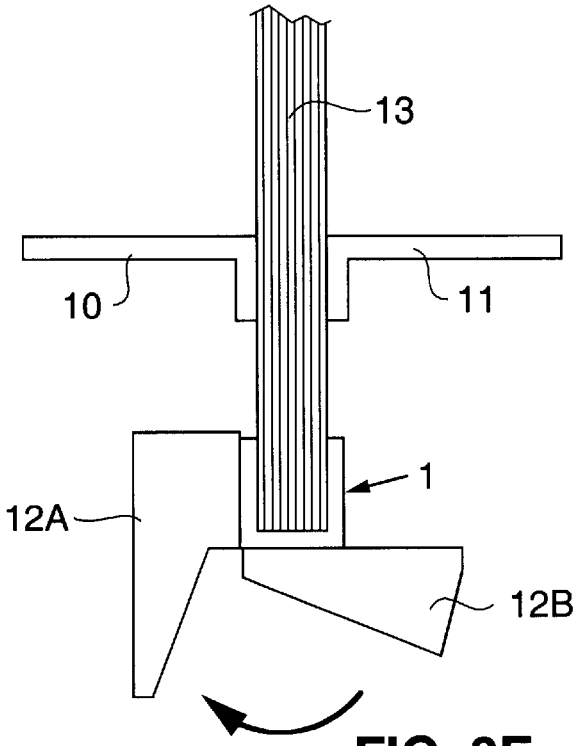
FIG. 3E (PRIOR ART)
Figure 20:
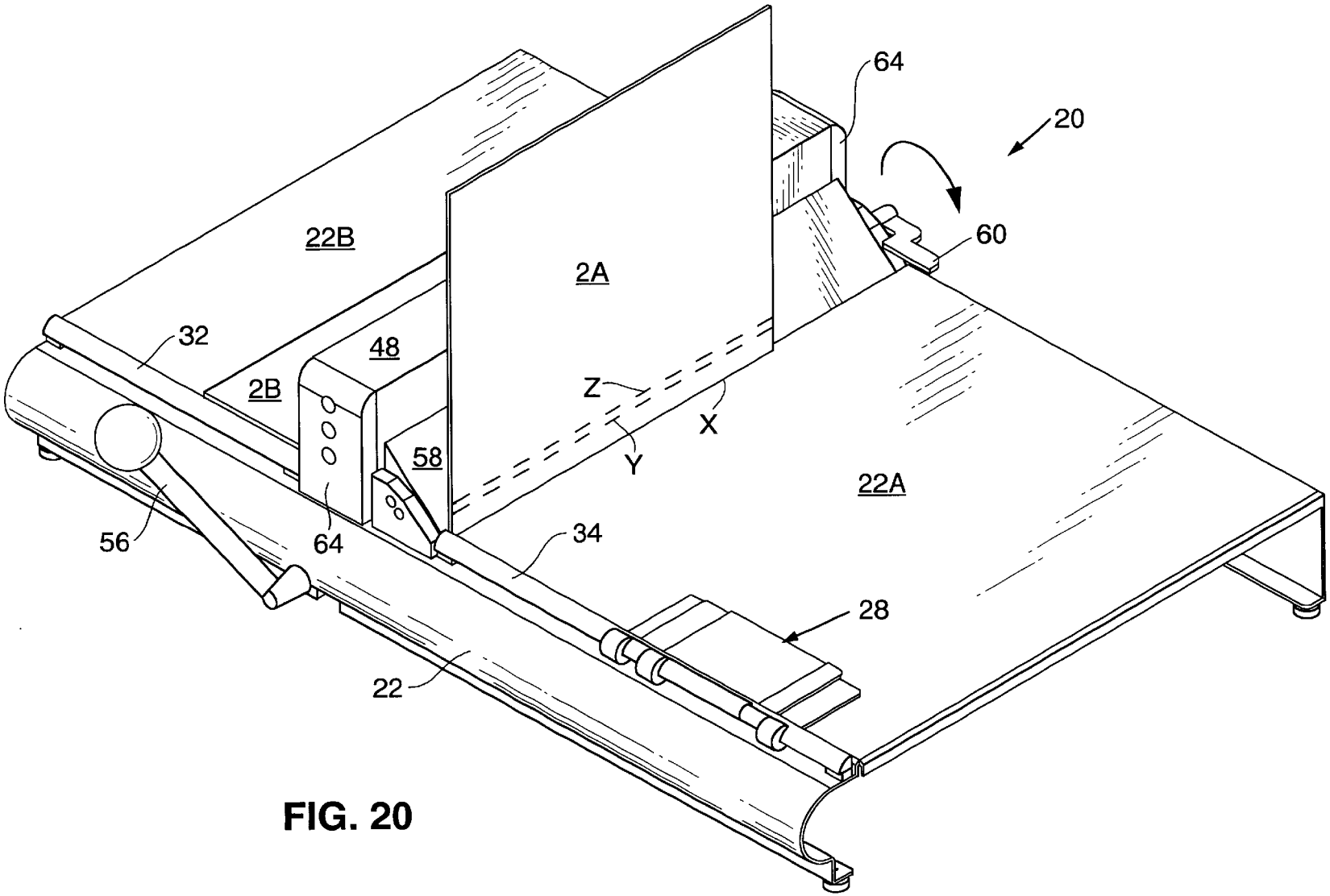
FIG. 20 is a perspective view of the subject binding apparatus, with the cover shown in a folded position.

Once the front cover portion has been folded as shown in FIG. 20, the user applies a solvent to the solvent-activated adhesive 15. The remaining portion of the binding sequence is then the same as previously described in connection with the FIG. 1A embodiment. If the adhesive is heat activated, such as used in the heat activated embodiment of FIG. 1B, the cover 2 is next removed from the binding apparatus 20. The substrate/release liner 6 is then manually removed from the stack 13 in a manner similar to removal of liner 5 of FIG. 4. Next, the user manually wraps the cover 2 around the stack 13, with the front cover portion 2A and the back cover portion 2B facing the first and last pages of the stack. The user then inserts the combination in a binding machine such as depicted in FIG. 2, with the binding sequence being depicted in FIGS. 8A–8E.

The construction and operation of the scoring assembly 24 will now be described in greater detail. In order to permit a user to have an unrestricted view of the male die 50 mounted on the transparent die holder 48, much of the drive mechanism is mounted on the underside of the scoring assembly 24. The underlying mechanism operates to pull the transparent die holder 48 down onto the fixed female die 52 so as to score a cover.

Figure 22:
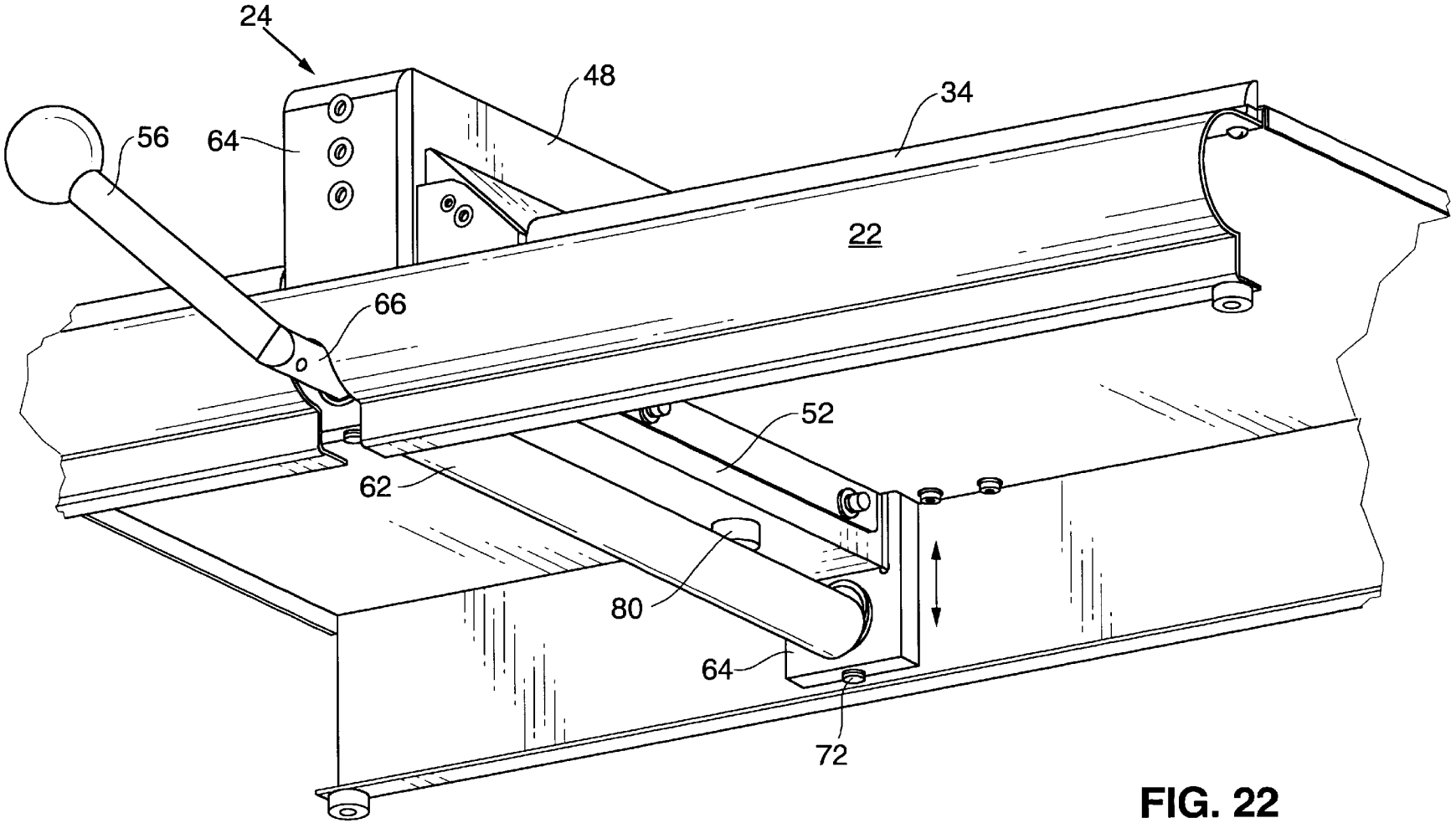
FIG. 22 is a partial cross-sectional view of the bottom of the subject binding apparatus showing some of the details of the scoring apparatus.
Figure 23:
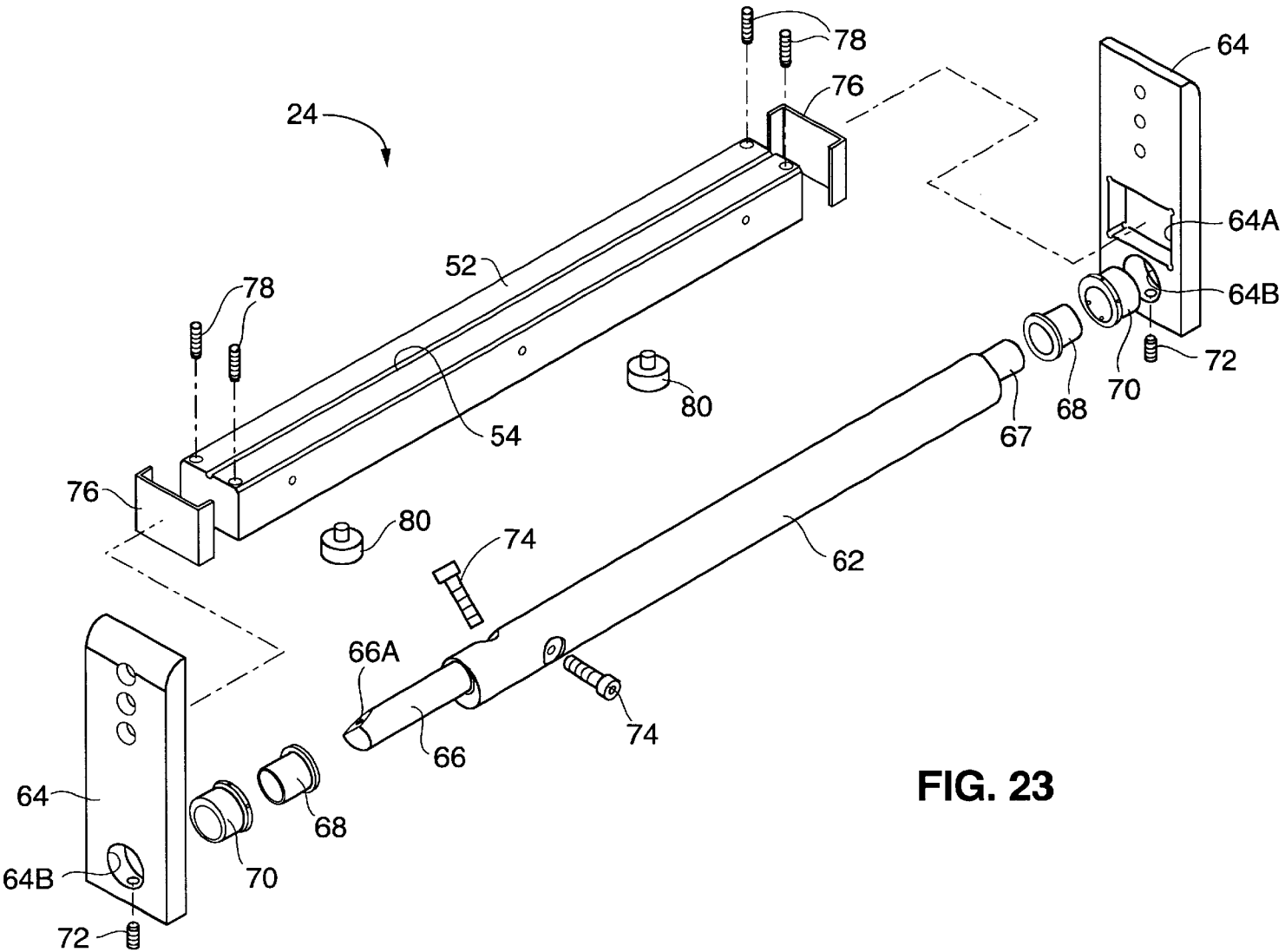
FIG. 23 is an exploded view of the scoring assembly.

As can best be seen in FIGS. 10 and 22, the transparent die holder 48 is supported on a pair of side plates 64. FIG. 23 is an exploded view of the primary components of the scoring assembly 24 without the transparent die holder 48. A camshaft 62 having a circular cross-section is supported between the side plates 64 and is driven by rotation of handle 56 (FIG. 22). Drive shafts 66 and 67 are integrally formed with cam shaft 62 and have a common longitudinal axis that is offset from the longitudinal axis of the cam shaft. The cam shaft 62 and drive shafts 66 and 67 are thus mounted for rotation about the longitudinal axis of the drive shafts 66 and 67 when handle 56 is rotated.

As previously noted, the lower die holder 52 is rigidly mounted on the base unit 22. The side plates 64 are rigidly secured to the transparent die holder 48 by way of three screws (not designated) that extend through each of the side plates into each end of the die holder. In addition, the cam shaft 62 and drive shafts 66 and 67 are also mounted on the side plates 64 by way of bearings 68 and bearing carriers 70. The bearing carriers 70 are disposed within openings 64B formed in the side plates 64 and held in place by set screws 72.

The side plates 64 each are provided with a rectangular shaped recess 64A for receiving the ends of the female die holder 52. A plastic bushing 76 is disposed in each of the recesses 64A, with the plastic bushings 76 being dimensioned to limit lateral movement of the side plates 64 with respect to the die holder 52 and to permit vertical movement of the side plates 64 with respect to the die holder. A pair of plastic cam pads 80 are secured to the underside of the die holder 52 for engaging the cam shaft 62. Thus, the transparent die holder 48, the side plates 64, the cam and drive shafts 62, 66 and 67 and associated components all form a common structure which can move vertically with respect to the die holder 52 and the remainder of the base unit 22.

Figure 27:
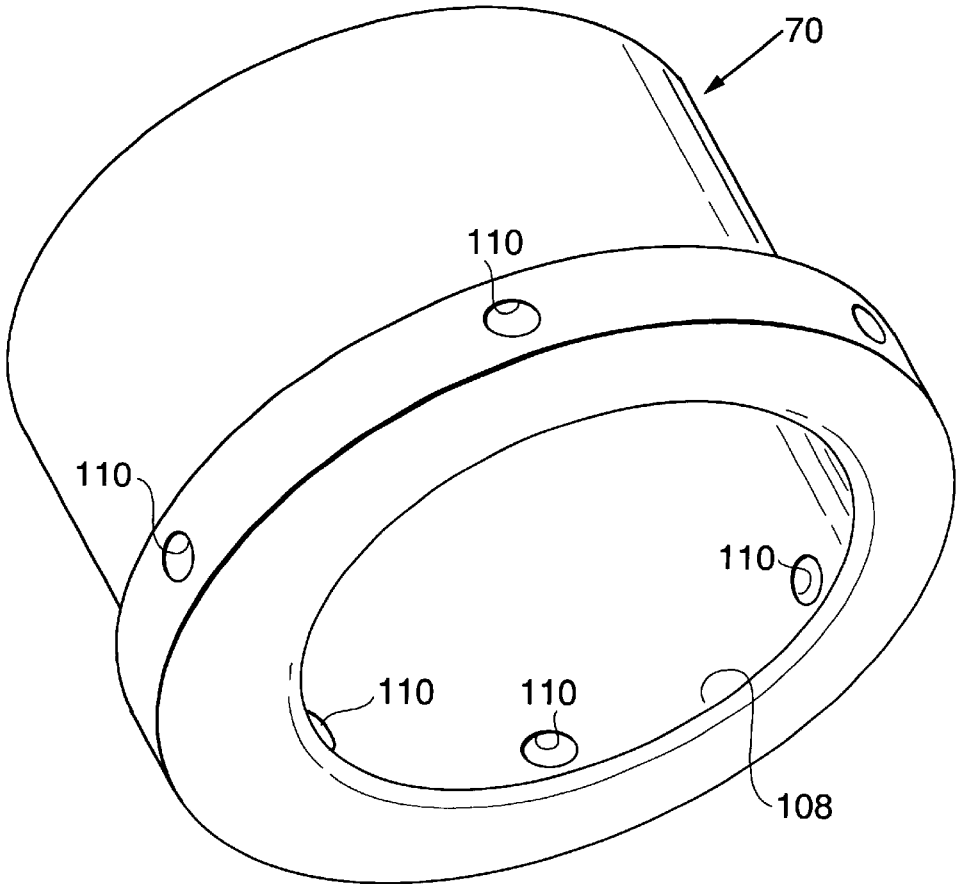
FIGS. 27 and 28 are various views of a bearing carrier which supports the drive shaft of the subject scoring apparatus.
Figure 28:
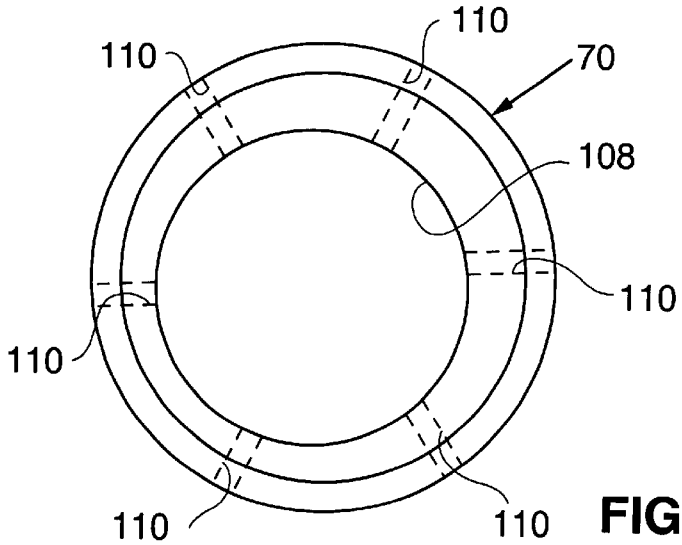

As can best be seen in FIGS. 27 and 28 (not to scale), the bearing carriers 70, which are disposed in circular openings in the side plates 64, have a central bore 108 for receiving drive shafts 66 and 67. The central bore 108 has a center which is offset from the center of the side plate 64 openings so that the axis of rotation of the drive shafts 66 and 67 may be moved by rotating the bearing carriers 70 within the side plate openings. The openings 110 formed around the periphery of the bearing carriers 70 permit that carriers to be rotated using a spanner wrench to adjust the rotational position of the carriers within the side plate openings. Set screws 72 (FIGS. 21, 22 and 23) secure the carriers 70 in place after adjustment. The center of the side plate opening and the center of the central bore 108 are typically offset by 1/32 of an inch so as to provide an adjustment in the position of the drive shafts 66 and 67 of up to 0.030 inches. This ability to adjust the drive shaft positions significantly reduces the tolerances needed for the drive shaft and related components.

As can best be seen in FIG. 23, the scoring handle 56 (FIG. 22) is secured to a truncated end 66A of the drive shaft 66. Four springs 78 (FIG. 23) 78 are disposed within recesses formed in the upper surface near the ends of die holder 52 and engage the upper inner surface of recess 64A formed in the side plate 64. Springs 78 tend to force the transparent die holder 48, side plates 64 and the cam shaft 62 upwards so that a space is formed between the male die 50 and female die 54 for receiving the cover 2 to be scored. The springs also cause the scoring handle 56 to return to the original position when the handle is released after forming a score.

Figure 21:
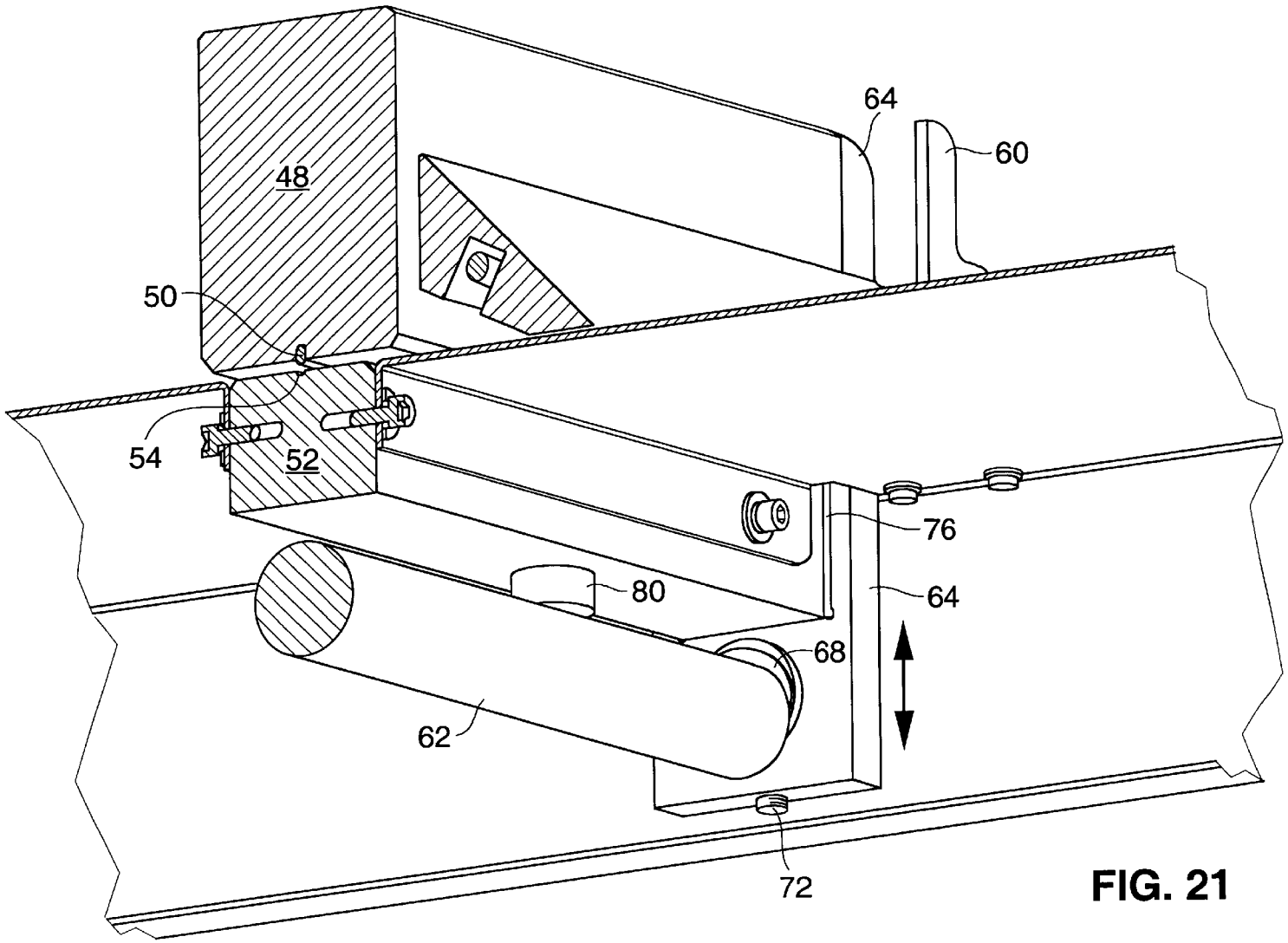
FIG. 21 is a partial cross-sectional view showing further details of the scoring assembly.
Figure 24A:
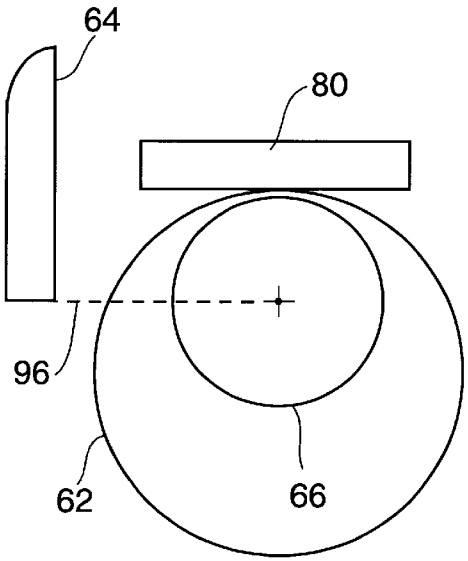
FIGS. 24A–24C are schematic representations of the rotation of the cam shaft of the scoring assembly.
Figure 24B:
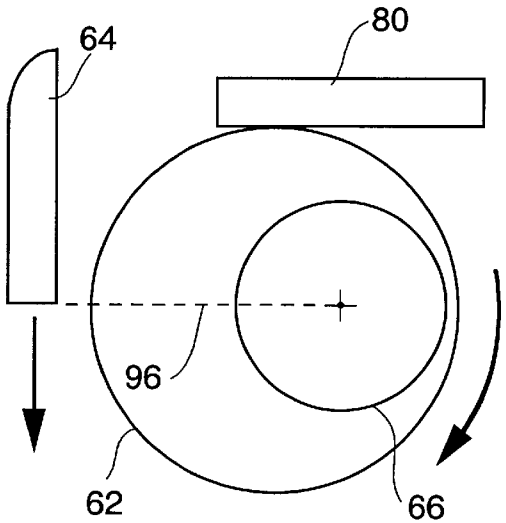
Figure 24C:
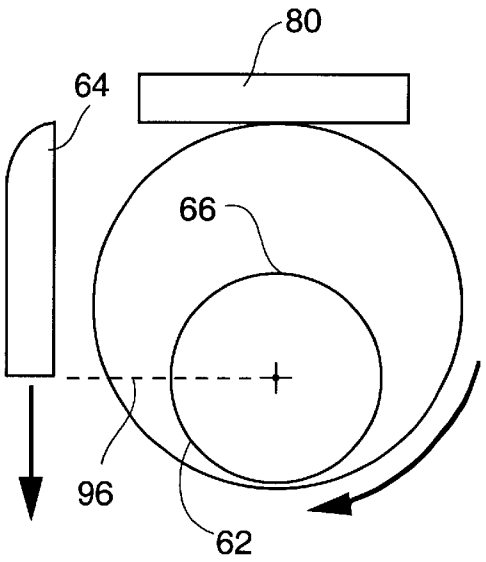

The rotational position of the cam shaft 62 at this point can best be seen in FIG. 21, with the cam shaft surface engaging the die 52 by way of the two cam pads 80. FIG. 24A is a schematic representation of the cam shaft 62 at this point, engaging the fixed cam pads 80. Line 96 represents the mechanical linkage between the drive shaft 66 and the side plates 64 which hold the transparent die holder 48. When the handle 56 is pressed downward, the drive shaft 66 is rotated in the clock-wise direction as shown in FIG. 24B. This rotation of the drive shaft 66 causes the drive shaft 66 to be forced downward together with the side plates 64. This causes springs 78 to start to compress. When handle 56 is rotated further as shown in FIG. 24C, the drive shaft 66 and side plates 64 move down further. Somewhere near the bottom of the stroke, the male die 50 mechanically connected to the side plates 64 will force the cover 2 down against the female die 54 thereby scoring the cover. Screws 74 shown in FIG. 23 disposed on the cam shaft 62 operate to limit the rotation of the drive shaft 62 through engagement of the screws 74 with the female die holder 52. The actual angle of rotation is less than the 180 degrees shown in FIGS. 24A–24C and is typically only 45 degrees.

Figure 25:
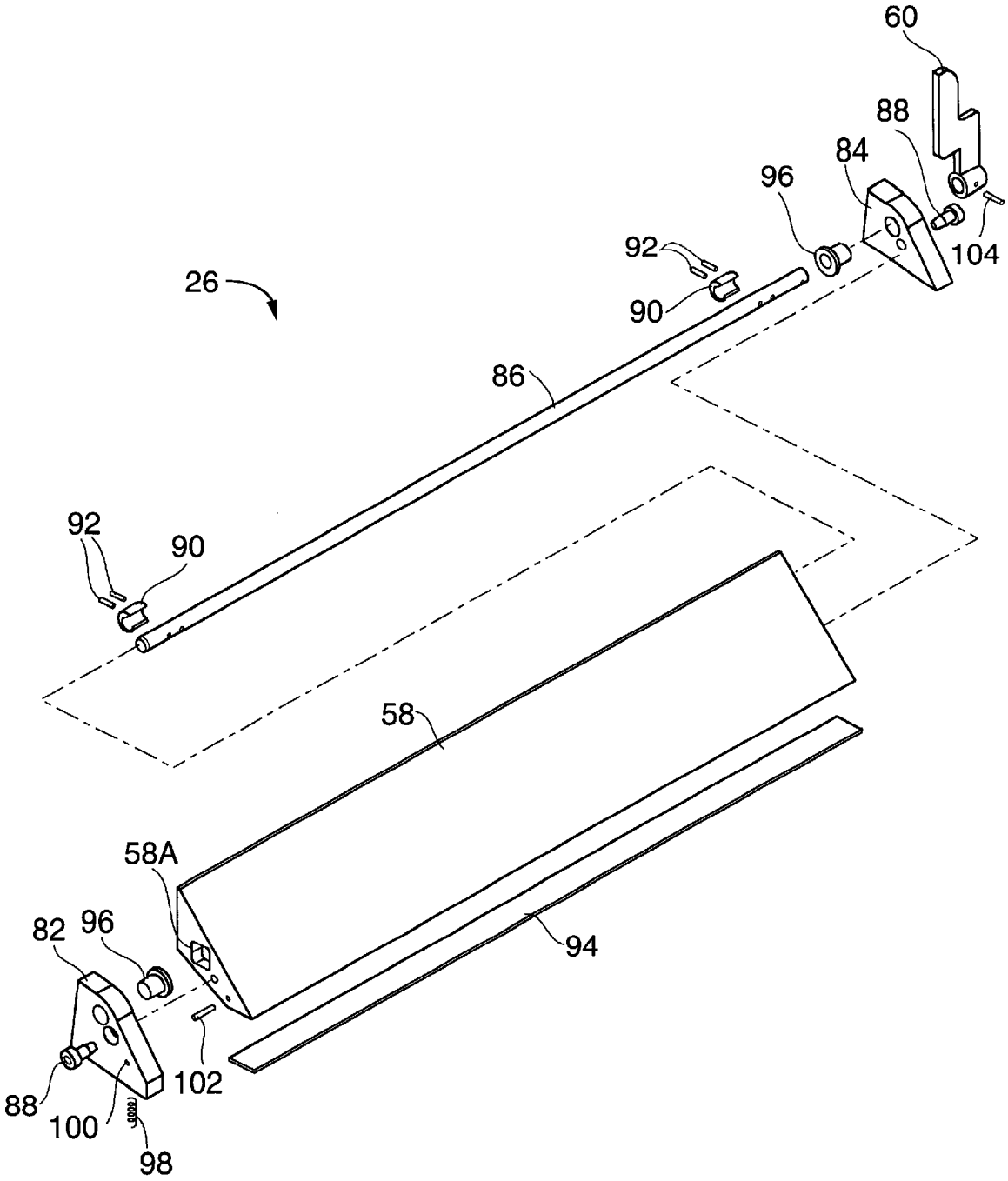
FIG. 25 is an exploded view of the clamp and hold assembly.
Figure 26A:
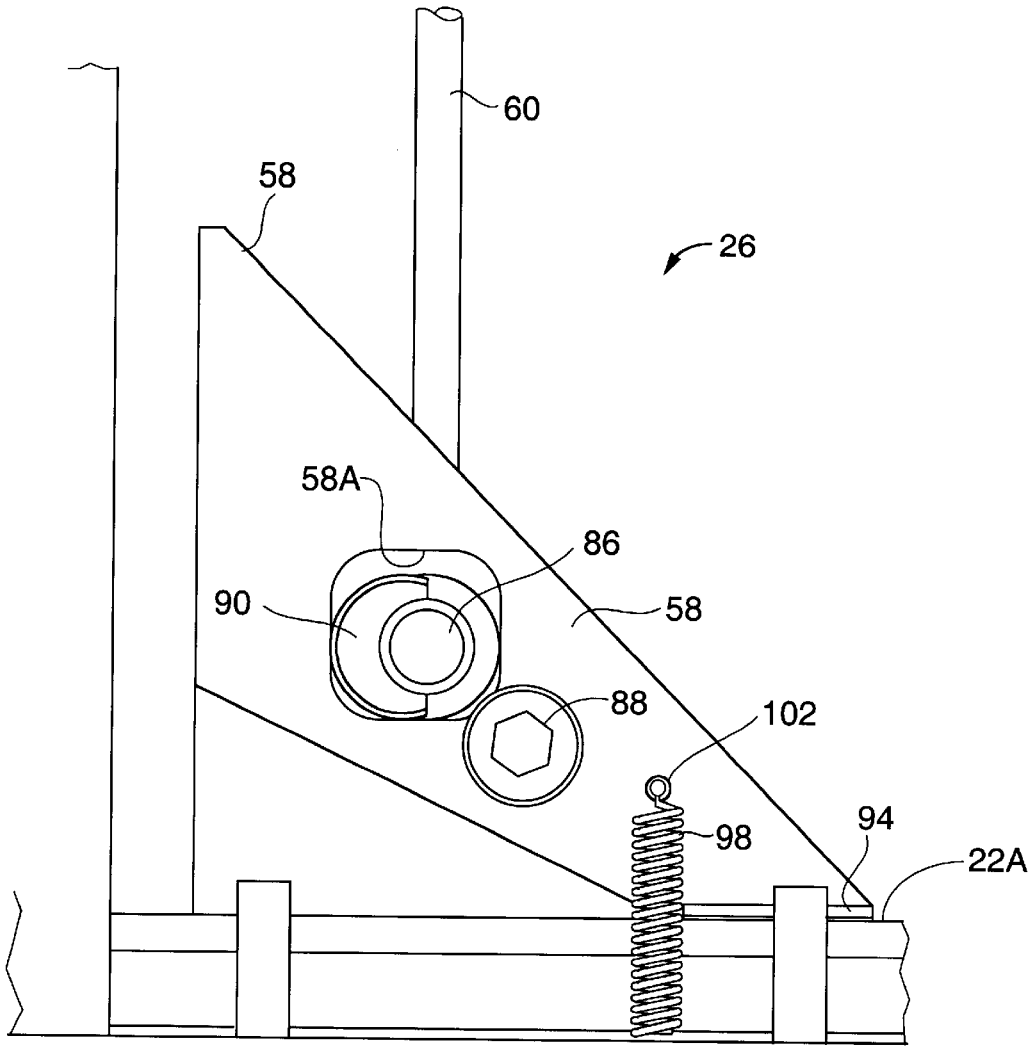
FIGS. 26A and 26B are partial cross-sectional view showing additional details of the clamp and hold assembly.
Figure 26B:
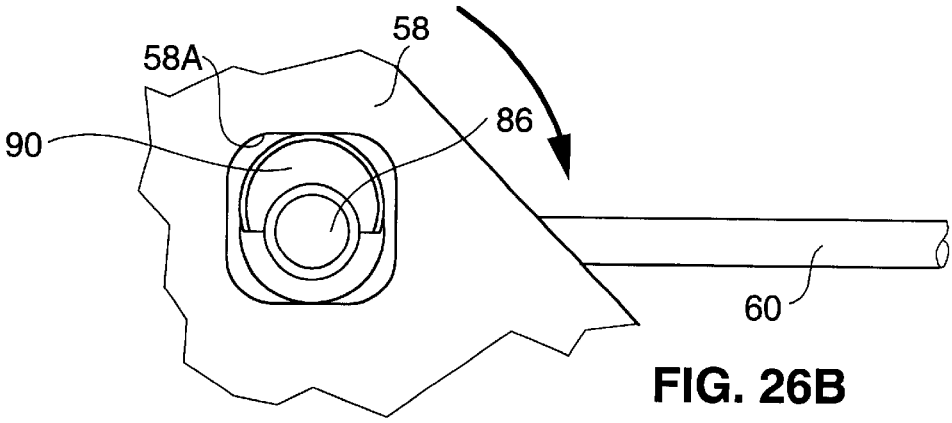

FIGS. 25, 26A and 26B further illustrate the construction and operation of the clamp assembly 26. The assembly 26 includes a pair of metal clamp brackets 82 and 84 which secure the assembly to the base unit 22. The transparent clamp bar 58 is pivotably mounted on brackets 82 and 84 by pivot pins 88. A cam shaft 86 extends through the length of the clamp bar 58 in opening 58A and is supported at the ends on the brackets 82 and 84 by way of bearings 96. A pair of cam members 90 are secured to the cam shaft by set screws 92. Bracket 82 has a recess for receiving a spring 98 which is connected to the clamp bar 58 by way of a pin 102. The spring 98 biases the clamp bar to an open position. A resilient pad 94, typically foam tape, extends along the underside of clamp bar 58 to assist in holding a cover 2 in place when the cover is clamped.

FIG. 26A is a cross-section of the clamp assembly 26 in the open position with clamp handle 60 being vertical. The opening 58A in the clamp bar 58 is rectangular shaped in the end regions of the bar, with the cam members 90 being in essentially a disengaged position. As can be seen in FIG. 18, the portion of opening 58A in the central portion of the bar is a slot rather than an opening. FIG. 26B shows the rotation of the cam shaft 86 and cam members 90 when the clamping handle is rotated 90 degrees to a clamping position. The cam members 90 engage the upper inner surface of the opening 58A thereby applying an upward force to the clamp bar 58. This upward force causes the clamp bar 58 to pivot about the pivot pins 88 so that the leading edge of the clamp bar 58 pivots down against the support surface 22A of the base unit 22. This will cause a cover 2 disposed on the surface 22A beneath the clamp to be held in place, without application of any sustaining force by the user.

Figure 33:
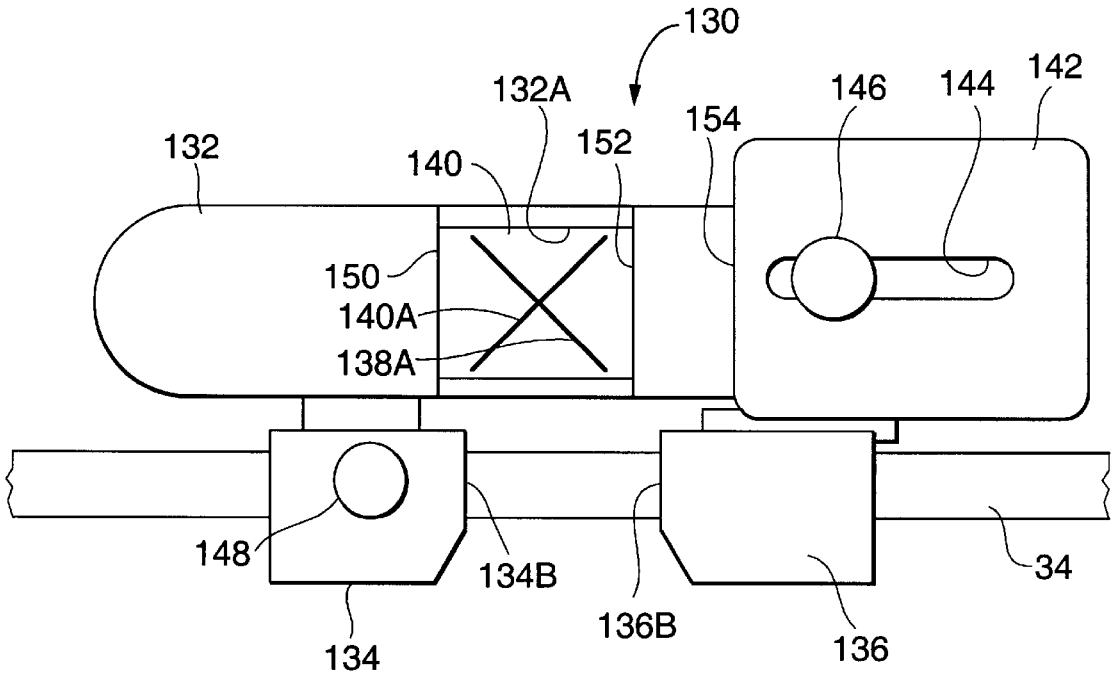
FIG. 33 is a plan view of an alternative embodiment stop assembly.
Figure 34:
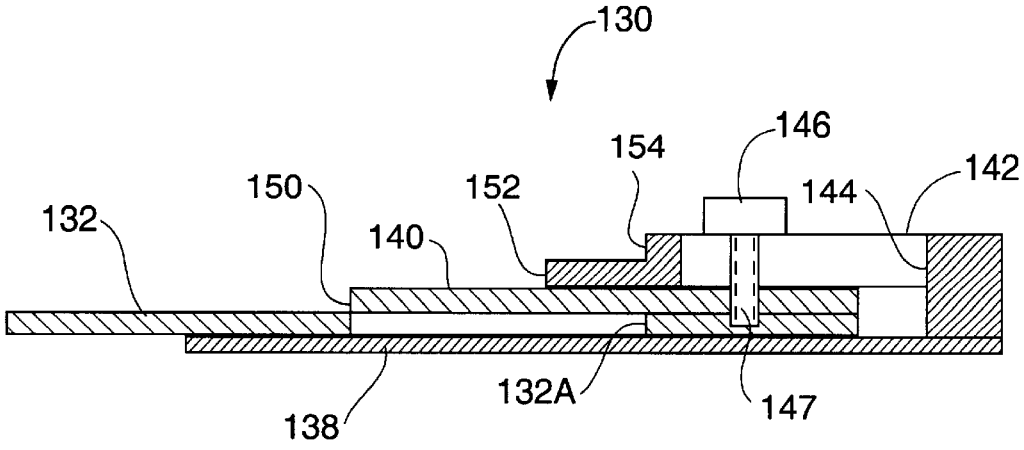
FIG. 34 is a schematic representation of a cross-section of the FIG. 33 stop assembly.

FIG. 33 is a plan view of an alternative stop assembly 130, with FIG. 34 being a schematic cross-section of the stop assembly. As is the case with stop assembly 28 (FIG. 10), stop assembly 130 is secured to guide rail 34 and is movable along the guide rail. Stop assembly 130 includes a metal base member 132 which supports the remainder of the assembly. A base member tab 134 is supported on the base member and extends partially around guide rail 34. A thumbscrew 148 extends through a threaded opening in tab 134 and engages rail 34 when tightened thereby securing the stop assembly in place. When screw 148 is untightened, stop assembly 130 can be moved along guide rail 34.

A metal adjustment member 142 is supported on the base member 132 and is moveable with respect to the base member. A threaded shaft 147 is mounted base member 132 which extends up through a slot 144 formed in the adjustment member 142. A knob 146 is provided having a threaded opening (not depicted) which receives the threaded shaft 147. When knob 146 is loose, the adjustment member 142 is free to move a short distance with respect to the base member 132, with shaft 147 moving along slot 144. When knob 146 is tightened, the adjustment member 142 is fixed with respect to the base member 132. A thin, opaque plastic lower cross hair member 138 is positioned below the base member and is secured at one end to the adjustment member 142. Thus, the lower cross hair member 138 will move with the adjust member 142. The lower cross hair member 138 has a cross hair indicia 138A printed on the upper surface, as will be explained.

A transparent plastic upper cross hair member 140 is supported on the base member 132 above the lower cross hair member 138. A rectangular opening 132A is formed in the base member 132 and is positioned such that the lower cross hair member can be viewed through the transparent upper cross hair member 140 and the opening. The upper cross hair member 140 includes a cross hair indicia 140A which overlaps the lower indicia 138A. The two indicia are at the same fixed acute angle with respect to the guide rail 34. When the adjustment member 142 is moved, the attached lower cross hair member 138 will move with it, thereby changing the point at which the two indicia 138A and 138B intersect.

The upper cross hair member 140 defines a stop 150, with stop 150 performing the same function as stop 36D of stop assembly 28 (FIG. 13). An edge of the adjustment member 142 defines a further stop 152 which performs the same function as stop 38B of stop assembly 28. A step in adjustment member 142 defines a further stop 154, with stop 154 performing the same function as stop 38C of stop assembly 28. Stop assembly 130 does not include a stop which corresponds to stop 36C of stop assembly 28, although one could be added to base member 132.

As can best be seen in FIG. 34, the lower cross hair member 138 is mounted on adjustment member 142 such that stop 152 and the lower cross hair member move together with guide tab 136. Similarly, the upper cross hair member 140 is mounted an base member 132 so that stop 150 and the upper cross hair member will move together with base member tab 134. As previously noted, cross hair indicia 138A and 140A are both mounted at the same fixed acute angle with respect to the guide rail 34 and are mounted such that the two indicia intersect at a point intermediate stops 150 and 152. The spacing between surfaces 134B and 136B on the base member and guide tabs, respectfully, is equal to the spacing between movable stops 150 and 152. Thus, when a stack of sheets 13 to be covered is positioned between surfaces 134B and 136B, and the guide tab 136 is moved towards the stack, the spacing between surfaces 134B and 136B will be equal to the thickness of the stack as will the spacing between stops 150 and 152.

Figure 35A:
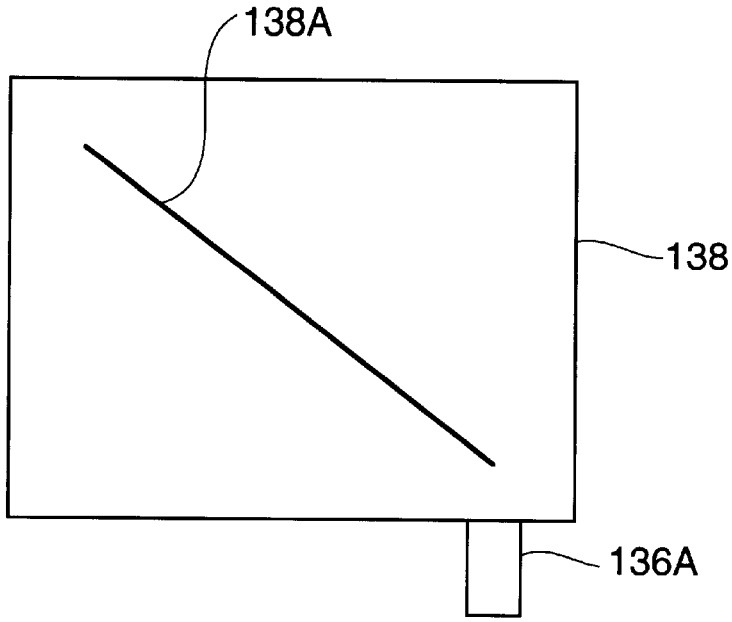
FIGS. 35A and 35B are schematic representations of the upper and lower respective crosshair members of the FIG. 33 stop assembly.
Figure 35B:
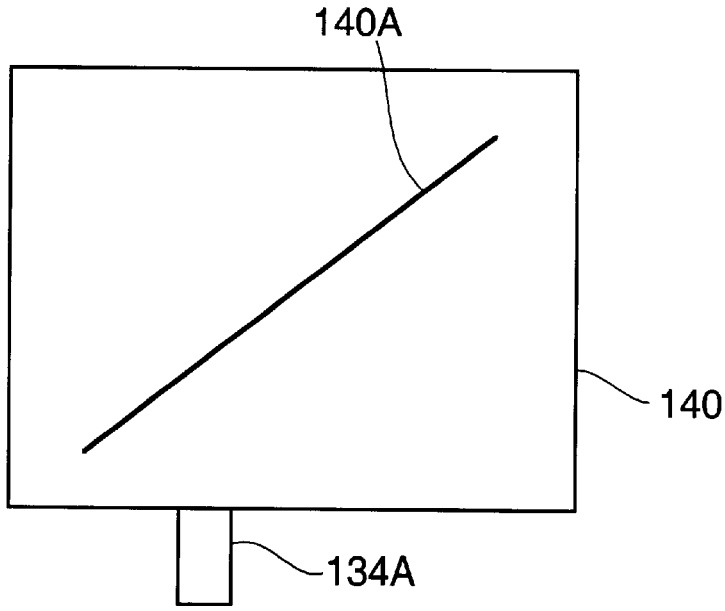
Figure 36A:
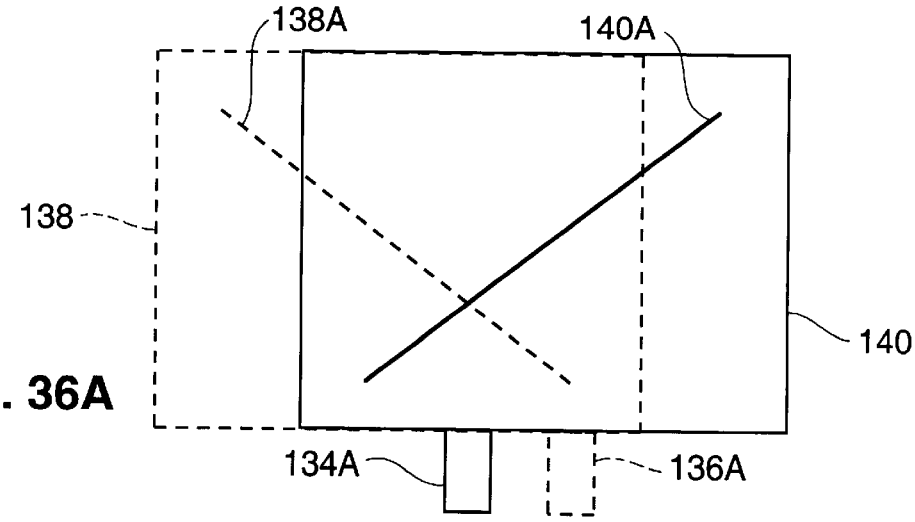
FIGS. 36A, 36B and 36C are schematic representations of overlying upper and lower cross hair members for relatively thin, medium and thick stacks of sheets, respectively.
Figure 36B:
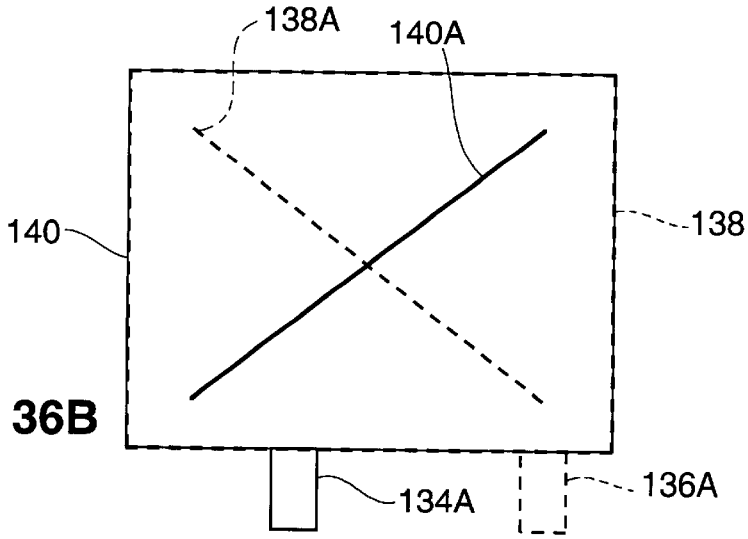
Figure 36C:
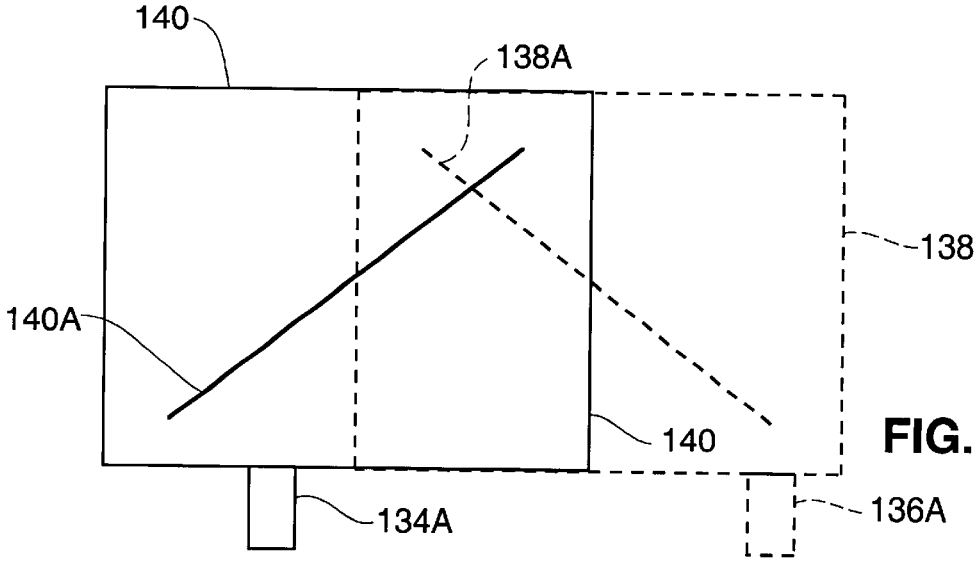

FIG. 35A is a schematic view of the lower cross hair member 138. Element 136A, which represents guide tab 136, is attached to member 138. FIG. 35B is a schematic view of upper cross hair member 140, with element 134A representing base member tab 134. FIGS. 36A, 36B and 36C depict the upper cross hair member 140 disposed over the lower cross hair member 138. As indicated by the spacing between elements 134A and 136A, the stop assembly of FIG. 36A is adjusted for a relatively thin stack. FIGS. 36B and 36C show the stop assembly adjusted for relatively medium and thick stacks, respectively.

Operation of the second embodiment stop assembly 130 will now be described. First, stops 150 and 152 are set to be equal to the stack to be bound. This is accomplished by first loosening knob 146. The stack 13 to be covered is then placed between surfaces 134B and 136B, with guide tab 136 being forced against the stack so that the spacing between surfaces 134B and 136B is equal to the stack thickness as is the spacing between stops 150 and 152. Knob 146 is then tightened so that this spacing will be maintained.

The next step is to position the stop assembly 132 correctly along guide rail 34. The cover 2 (FIG. 11) is first positioned on the cover receiving surfaces 22A and 22B of the binding apparatus 20 between the upper and lower die 50 and 54 (FIG. 17). The user then aligns the upper die 50 over the center of that part of the cover that will form the spine of the book. This is performed by viewing the upper die 50 and cover through the transparent upper die holder 48. If a title or the like had been previously printed on the spine cover and is to be centered on the spine, the cover can be positioned with the printed text centered below the upper die 50. Once the cover 2 has been positioned properly under the upper die 50 along guide rails 32 and 34, the cover is held in place, typically by actuating clamp handle 60. Thumbscrew 148 of the stop assembly 130 is then loosened so that the entire assembly can be moved along rail 34. The assembly is then positioned with the right edge of cover 2 aligned with the cross hair formed by the apparent intersection of the upper and lower cross hair indicia 140A and 138A. Thumbscrew 148 is then tightened so as to fix the position of the assembly 130 with respect to the guide rail 34.

As previously noted, the spacing between stops 150 and 152 is now equal to the thickness of what will be the spine of the bound stack. Further, the assembly 130 is now positioned so that the distance from the intermediate half-way point between stops 150 and 152 and upper die 50 is equal to the distance between the edge of the cover 2 and what will be the center of the spine. This means that stops 152 and 150 are positioned for forming score lines X and Y as depicted in FIGS. 19A and 19B. The clamp handle 60 can then be released so that the edge of cover 2 can be aligned with stop 152. Handle 56 is then depressed so that the cover is scored along line X. The cover is then repositioned so that the edge is aligned with stop 150. Cover 2 is then scored along line Y. As previously noted, stop assembly 130 does not have a stop for forming a score along line Z. However, as will be explained, a double die arrangement can be used to form two parallel score lines which replace the single scores along lines Y and Z. The cover 2 can then be attached to the stack 13 in the same manner as depicted in connection with FIG. 19E.

Figure 37:
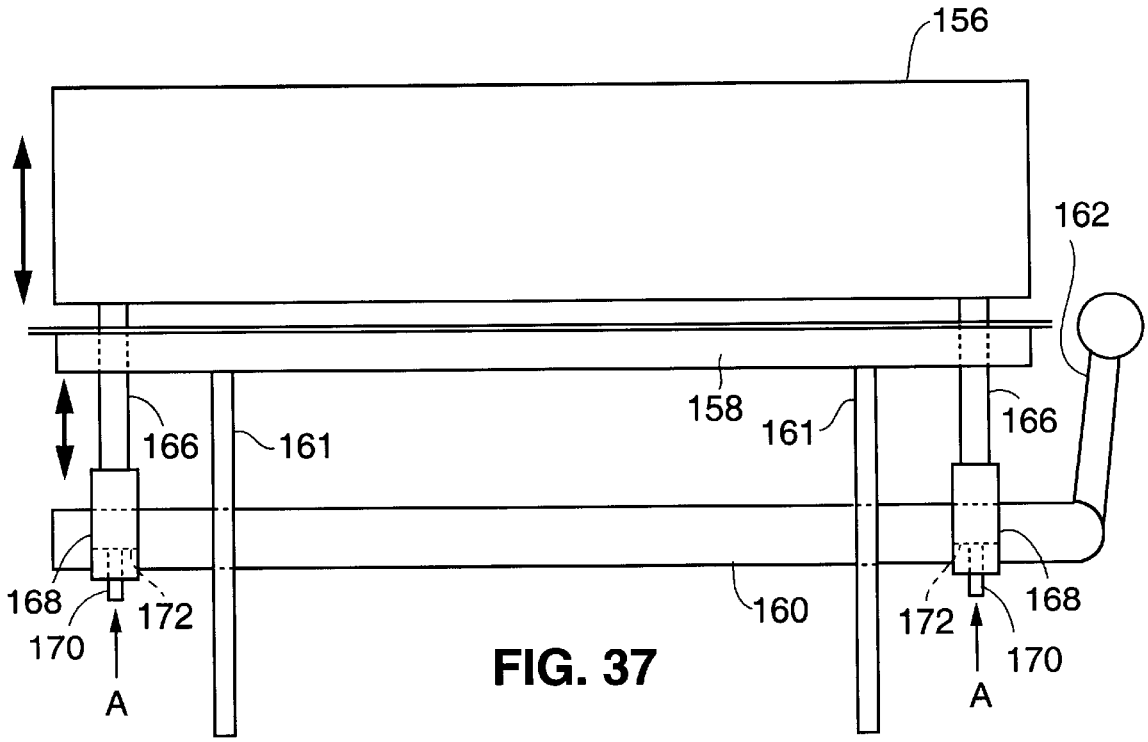
FIG. 37 is a schematic diagram of an alternative drive mechanism for the upper die holder.

FIG. 37 is a schematic diagram representing an alternative drive mechanism for actuating the upper die holder. Die holder 156 is similar to upper die holder 48 and is fabricated from a transparent material so that the upper die (not depicted in FIG. 37) and cover to be scored can be viewed through the die holder. This alternative drive mechanism may include a clamping mechanism that performs the function of clamp assembly 26 of the previously described embodiment. FIG. 37 does not show the clamping mechanism, the housing and other items not directly related to operation of the drive mechanism. The alternative drive mechanism includes a drive shaft 160 that is rotationally driven by a handle 162. Drive shaft 160 is mounted on spaced apart frame members 161 by way of bearings (not depicted). The frame members also support a lower die holder 158.

Figure 42:
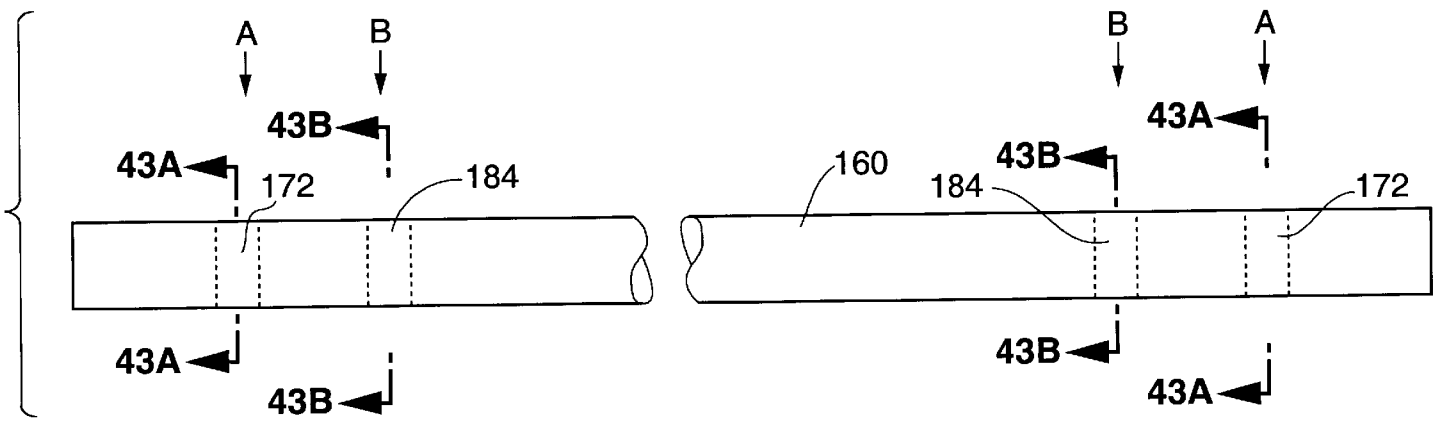
FIG. 42 is a schematic diagram of the drive shaft of the alternative drive mechanism showing the location of the dual cam surfaces for driving the scoring mechanism and the dual cam surfaces for driving the alternative clamping mechanism.

The drive shaft 160 is coupled to the upper die holder 156 by way of connecting rods 166 which extend through and are secured to the die holder. Rods 166 extend down from the upper die holder, through openings in the lower die holder 158, and down to the drive shaft 160. A cam roller bracket 168 is connected to the end of each of the connecting rods 166, with the roller brackets encircling the drive shaft 160 at locations A on the shaft. A cam surface 172 is formed in drive shaft 160 at the two locations A. FIG. 42 is a schematic diagram of drive shaft 160 showing surfaces 172 at the two locations A.

Figure 38A:
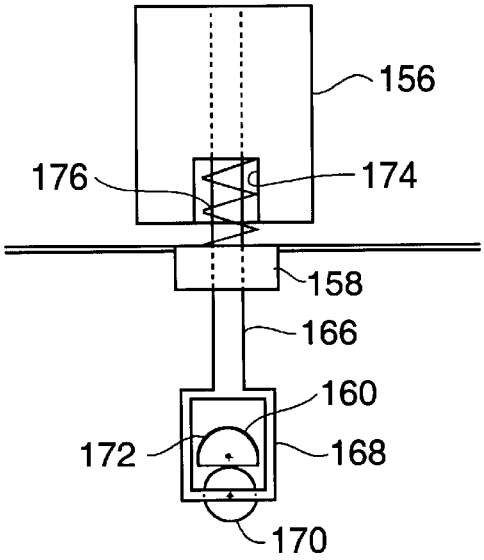
FIGS. 38A and 38B are schematic end views of the alternative drive mechanism of FIG. 37 showing the scoring apparatus in open and scoring positions, respectively.
Figure 43A:
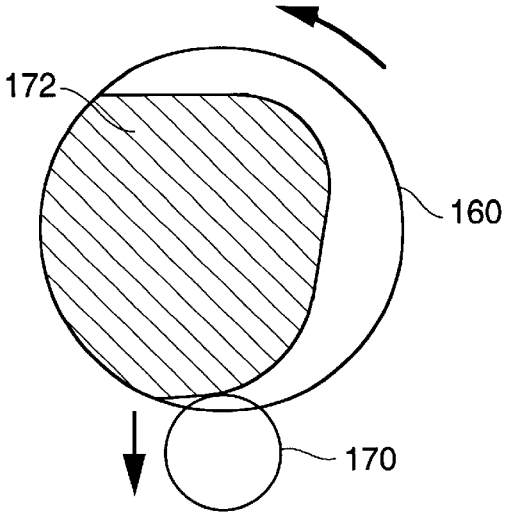
FIGS. 43A and 43B are cross-sectional views of the score and clamp cam surfaces, respectively, of the drive shaft of the alternative drive mechanism shown in a scoring position where a cover is being scored.
Figure 44A:
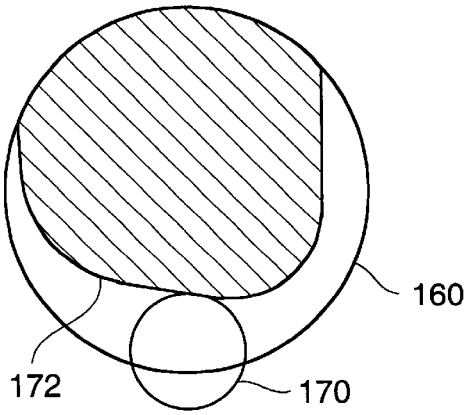
FIGS. 44A and 44B are cross-sectional views of the score and clamp cam surfaces, respectively, of the drive shaft of the alternative drive mechanism shown in a neutral position.
Figure 45A:
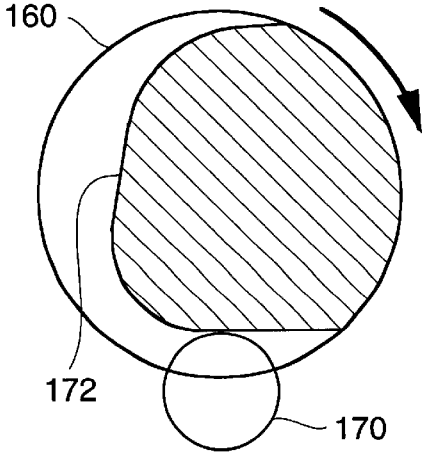
FIGS. 45A and 45B are cross-sectional views of the score and clamp cam surfaces, respectively, of the drive shaft of the alternative drive mechanism shown in a clamping position where a cover is being clamped prior to folding of the cover.

As can best be seen in FIG. 38A, the roller brackets 168 each support a cam roller 170 which is mounted for rotation on the bracket. The cam rollers 170 engage the cam surface 172 of the drive shaft 160. FIGS. 43A, 44A and 45A shows a cross section of drive shaft 160 at the two locations A, showing details of cam surface 172 engaging cam roller 170 at three different rotational positions of the drive shaft. A spring 176 (FIGS. 38A and 38B) is captured in each of two openings 174 formed in the underside of the upper die holder 156 at both ends of the holder. The springs 174, which encircle the connecting rods 166, operate to bias the upper die holder 156 away from the lower die holder 158. FIGS. 38A and FIG. 44A show the drive shaft in what is termed a neutral position where the upper and lower die are separated so that a cover 2 to be scored can be positioned between the two die. The cam surface 172 forces cam roller 170 down a minimum distance, with springs 176 functioning to maintain the upper die holder in a raised position. FIG. 44A shows details of a cross section of cam surface 172 engaging cam roller 170 in the neutral position of FIG. 38A.

Figure 38B:
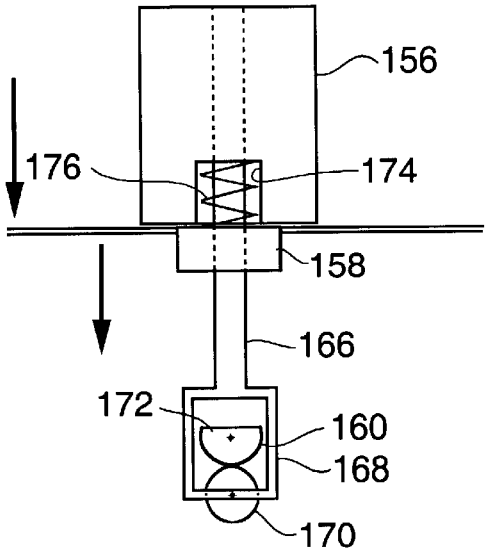

FIG. 38B shows the drive shaft 160 rotated by way of handle 162 to what can be termed a score position where the cam surface 172 forces cam roller 170 down thereby compressing springs 176 and forcing the upper die down towards the lower die so that a cover will be scored. FIG. 43A shows details of the cam surface 172 engaging roller 170 in the score position. Note that the drive shaft has been rotated 90 degrees from the neutral position of FIG. 44A for purposes of illustration. Rotation less than 90 degrees may actually be sufficient to score a cover.

Figure 39A:
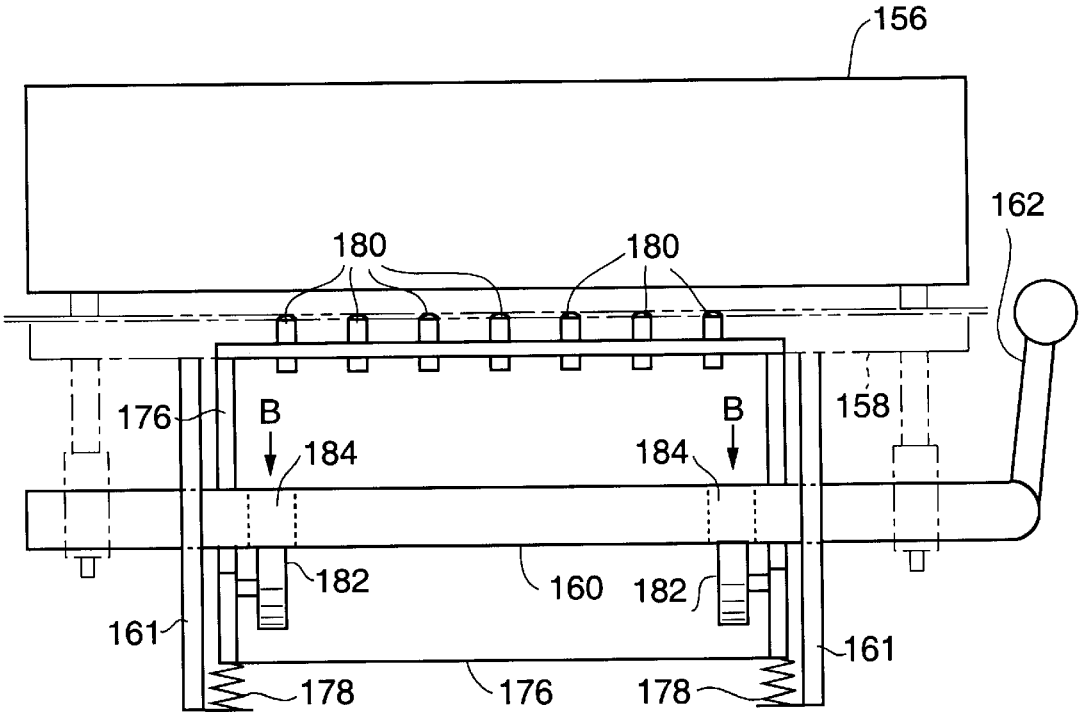
FIGS. 39A and 39B are schematic diagrams illustrating a front view of the cover clamping mechanism of the alternative drive mechanism of FIG. 37, with FIG. 39A showing the clamping mechanism in an open position and FIG. 39B showing the clamping mechanism in a clamping position.

FIGS. 39A, 39B, 40A and 40B illustrate an alternative to the clamp assembly 26 previously described. The alternative clamp mechanism is preferably implemented in combination with the alternative drive mechanism of FIGS. 37, 38A and 38B. In order to more clearly illustrate the construction and operation of the alternative clamping mechanism, much of the structure associated with the drive mechanism has not depicted in FIGS. 39A, 39B, 40A and 40B and what is depicted is shown in phantom. Similarly, in order to more clearly illustrate the construction and operation of the alternative drive mechanism in FIGS. 37, 38A and 38B, most of the clamp mechanism has not been depicted. Referring to FIG. 39A, the alternative clamp mechanism includes a clamp bracket 176 disposed below the upper die holder 156 and adjacent the lower die holder 158 and adjacent the drive shaft 160.

The upper portion of the clamp bracket 176 supports a plurality of spaced apart rubber grippers 180 which, as will be explained, grip the cover 2 between the grippers 180 and the lower surface of the upper die holder 156. The grippers 180 are supported in openings formed in the top side of bracket 176 and, when the mechanism is in a clamping position, the grippers extend upward through openings (not depicted) in the cover receiving surface so as engage the cover 2 and force the cover up against the lower surface of die holder 156.

Figure 40A:
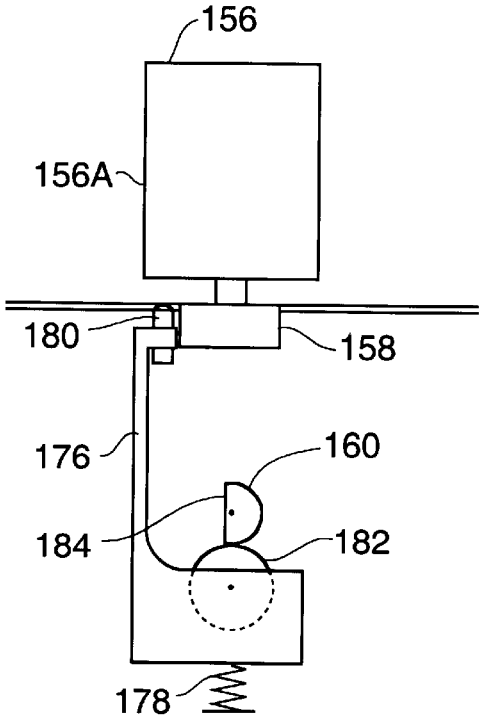
FIGS. 40A and 40B are schematic diagrams illustrating an end view of the cover clamping mechanism of the alternative drive mechanism of FIG. 37, with FIG. 40A showing the clamping mechanism in an open position and FIG. 40B showing the clamping mechanism in the clamping position.

Bracket 176 is supported on a pair of springs 178 that bias the bracket so that grippers 180 will be forced up into the gripping position. Bracket 176 supports a pair of cam rollers 182 at opposite ends of the bracket, with the cam rollers engaging a pair of cam surfaces 184 formed in drive shaft 160 at two locations B. As can be seen in FIG. 42, cam surfaces 184 at locations B are disposed on the drive shaft intermediate the outer drive mechanism cam surfaces 172 at locations A. FIG. 40A is a schematic end view of the alternative clamping mechanism further illustrating the manner in which the cam rollers 182 are supported on flanges located at opposite ends of clamp bracket 176. FIGS. 39A and 40A show the clamp bracket in a disengaged position where the drive shaft is positioned such that the cam surfaces 184 force the cam rollers 182 and the bracket 176 supporting the cam rollers down thereby compressing springs 178. The rubber grippers 180 do not extend through the openings in the cover receiving surface and thus will not grip a cover positioned under the upper die holder 156.

Figure 44B:
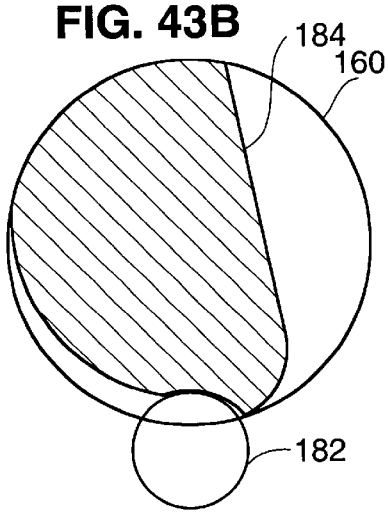

FIG. 44B shows a cross section at locations B of drive shaft 160 (FIG. 42) illustrating the interaction of cam surfaces 184 and cam rollers 182 when the drive shaft is at the same neutral rotational position as depicted in FIG. 44A. In this position, handle 162 is substantially vertical. Note that cam surfaces 184 each have a recess which receives cam roller 182 when the drive shaft is in the neutral position, with the force of springs 178 forcing the roller into the recess.

This action tends to hold the handle in place in the neutral position. A slight force applied to handle 162 in either direction will force the cam rollers 182 out of the recesses.

Figure 39B:
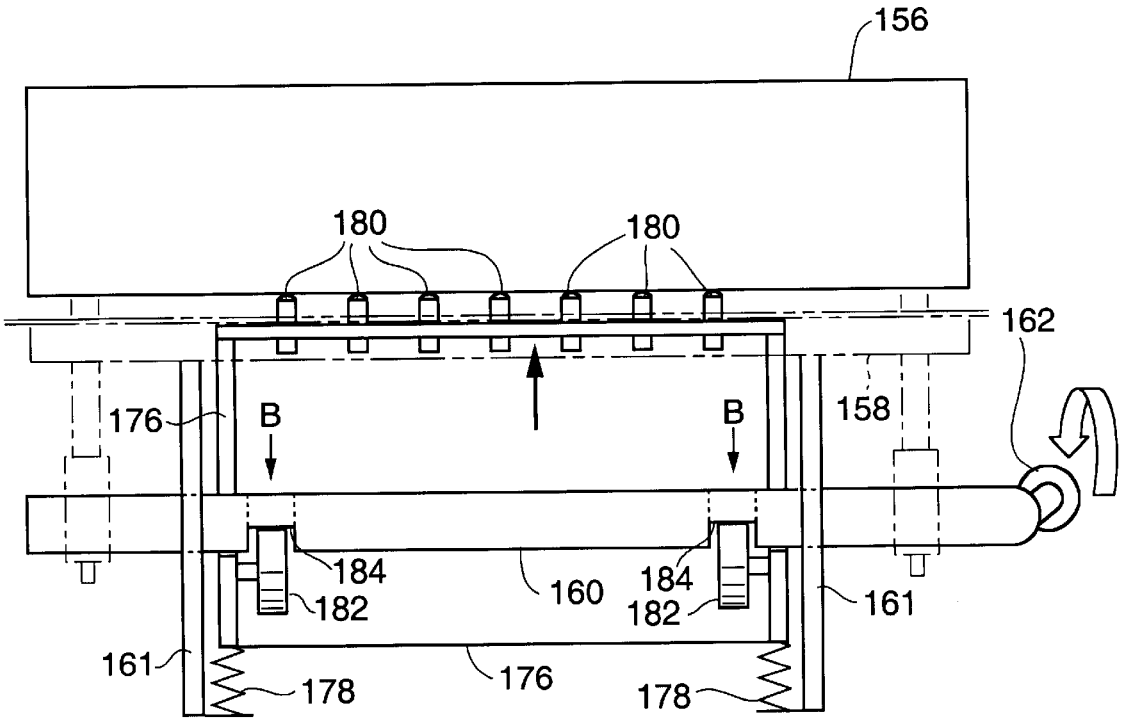
Figure 40B:
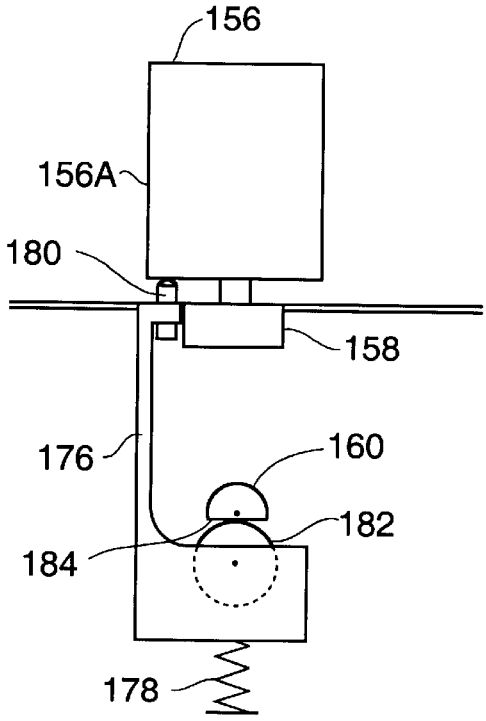
Figure 45B:
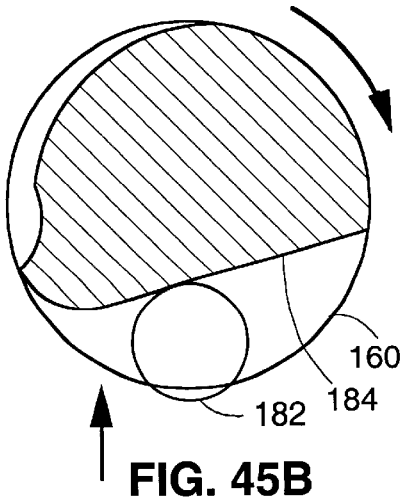

When the drive shaft 160 is rotated approximately 90 degrees, as shown in FIG. 45B, the drive shaft is moved to what is termed a clamping position. Note that the direction of rotation of drive shaft 160 is opposite that used to move the drive shaft from the neutral position to the scoring position illustrated in FIG. 43A. In the gripping position, cam surfaces 184 permit the cam rollers 182 and the clamp bracket 176 which supports the rollers to be forced upwards by springs 178. As shown in FIGS. 39B and 40B, the bracket and rubber grippers 180 will move up to grip or clamp a cover 2 between the grippers and the lower side of the upper die holder 156. The upward force provided by springs 178 is sufficient to grip and hold the cover 2 in place.

Figure 43B:
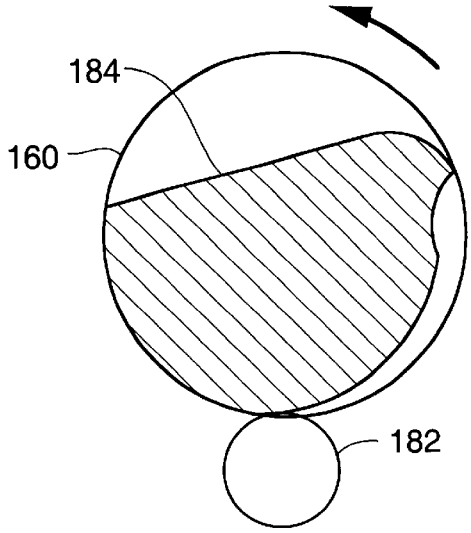

FIG. 45A shows the interaction between the cam roller 170 and cam surface 172 of the drive mechanism when the drive shaft 160 is in the clamping position of FIG. 45B. It can be seen that cam surface 172 forces cam rollers 170 down slightly so that the upper die holder 156 will move down slightly to engage the rubber grippers. This movement of the upper die holder will not be sufficient to cause the upper die 50 (FIG. 17) to engage the cover 2. The movement does facilitate the folding of the cover 2 about the edge 156A of the upper die holder 156, as will be described. FIG. 43B shows the relative position of the cam roller 182 and cam surface 184 of the clamping mechanism when the drive shaft is in the scoring position. As previously noted, FIG. 43A shows the orientation of the cam rollers 170 and the cam surfaces 172 associated with the drive mechanism when the drive shaft is in the scoring position. The cam surface 184 operates to force rollers 182 down, similar to that depicted in the neutral position of FIG. 44B, so that the rubber grippers 180 are retracted and do not interfere with the scoring operation.

The alternative clamping mechanism can be used to secure a cover 2 in place just after the cover has initially been positioned under the upper die holder 156. The stop assembly 130 can then be properly positioned along guide rail 34, with the edge of the cover located at the cross hair of stop mechanism 130. The alternative clamp mechanism can also be used to secure the cover in place when positioning stop assembly 28 along the guide rail.

Figure 19E:
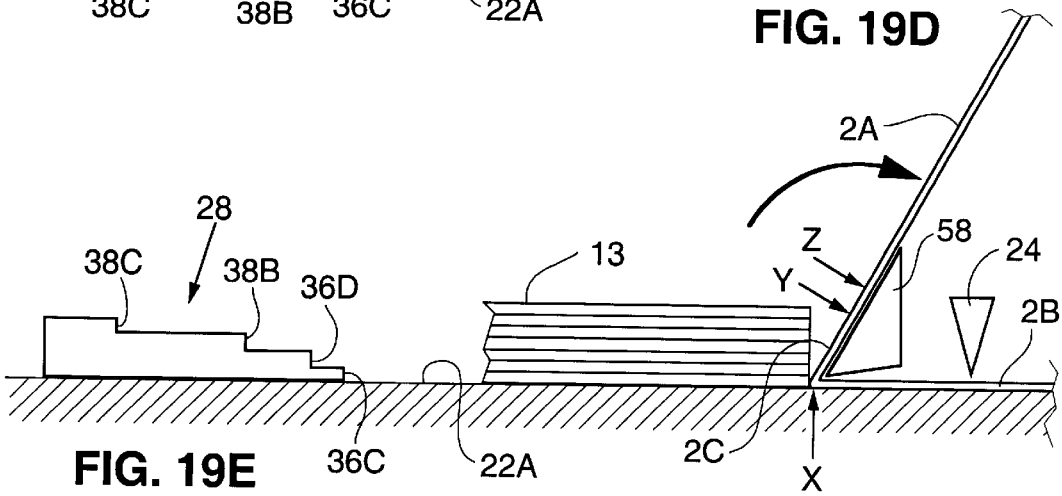

The alternative clamp assembly is also used to clamp the cover 2 at score line X in a manner similar to that shown in FIG. 19E of the original clamp assembly 26. The fixed distance between stops 152 and 154 (FIGS. 33 and 34) is equal to the distance between the upper die (not depicted) and edge 156A of the upper die holder 156 (FIG. 40B). Thus, when the cover 2 is clamped with the cover edge at stop 154, the scored fold line X will be disposed immediately below the edge 156A of the die holder. The cover can them be folded up along fold line X so that a stack 13 can be positioned on the cover receiving surface 22A similar to what is shown in FIG. 19E. Once the stack has been attached to the cover along at least one point by the adhesive, handle 162 is returned to the neutral position so as to release the cover. The cover 2 and stack 13 can then be lifted away from the surface and the cover can be wrapped around the remainder of the stack 13 as before.

Figure 41:
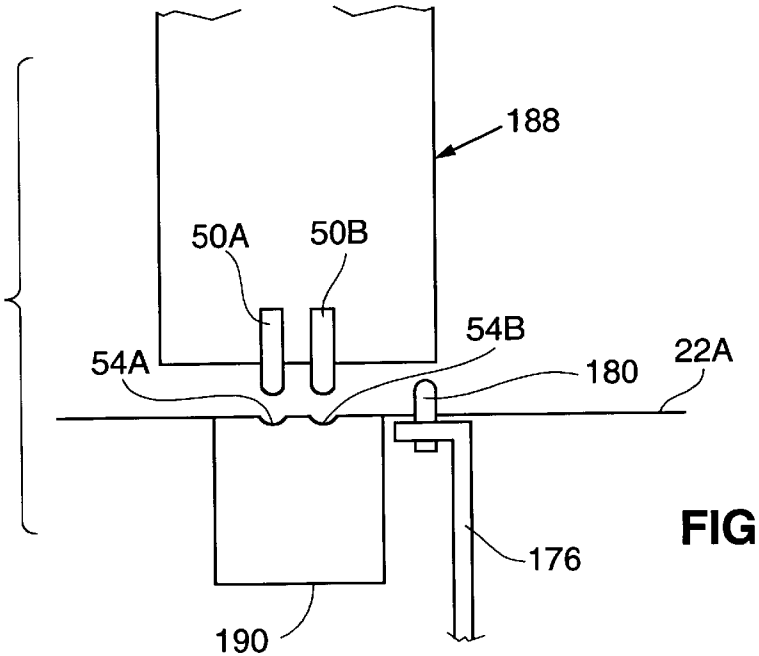
FIG. 41 is a schematic diagram of an alternative upper and lower die configuration showing twin die for producing double scoring lines on a cover.

FIG. 41 shows a modified upper die holder 188 and lower die holder 190 which produces a pair of adjacent score lines. The upper die holder supports two parallel upper male die 50A and 50B, with the lower die holder 190 supporting two corresponding lower female die 54A and 54B. The upper and lower die are typically spaced apart so that the score lines are 3/16 of an inch apart. The stop mechanism 130 is constructed so that the distance between the inner score lines corresponds to the thickness of the stack. Thus, the outer score lines will each perform a function similar to the score along line Z of the cover 2 shown in FIG. 11 which is to enhance the appearance of the bound book and to facilitate the folding of the cover when the bound book is opened.

Figure 46:
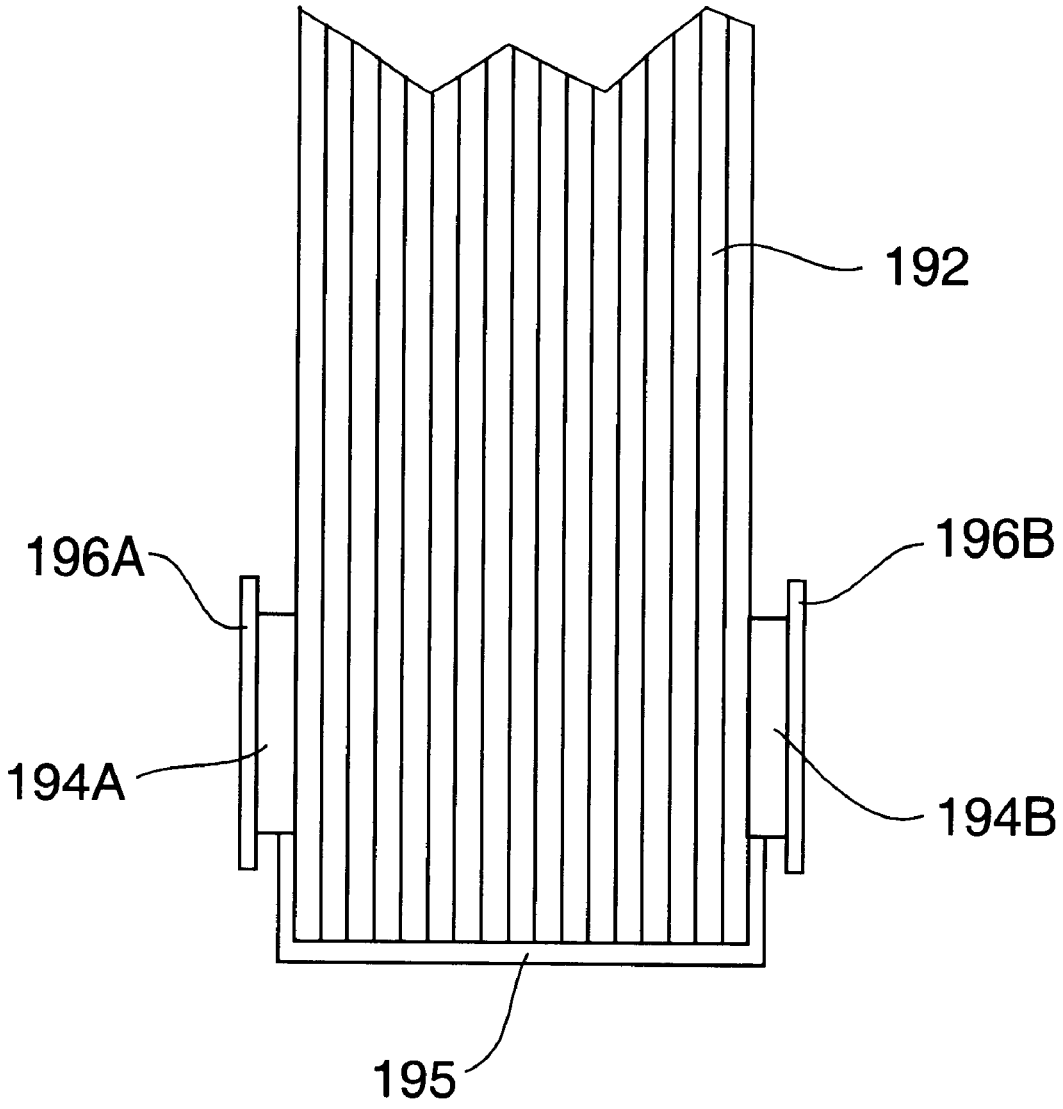
FIG. 46 is schematic end view of an alternative stack which can be covered in accordance with the present invention.

As previously described in connection with FIG. 4, the edge of the stack 13 is covered with a pressure activated adhesive 3 covered by a release liner 5. Adhesive 3 is disposed along the spine and along regions of the front and back sheets of the stack 13 near the spine. FIG. 46 is a schematic end view of an alternative bound stack 192 which has two strips 194A and 194B of pressure activated adhesive which are disposed only on the front and back sheets of the stack. The stack was previously bound as indicated by adhesive layer 195. The dimensions are exaggerated, with, for example, the adhesive strips 194A and 194B being shown relatively thick for purposes of illustration. The strips 194A and 194B extend along the full length of the stack along the spine. Each adhesive strip 194A and 194B is covered by a release liner 196A and 196B, respectively. Further details regarding the construction of the FIG. 46 stack are disclosed in U.S. patent application Ser. No. 09/684,582 filed on Oct. 6, 2000 and entitled "Bookbinding Structure and Method", with the contents of application Ser. No. 09/684,582 being fully incorporated into the present application by reference.

The manner in which a scored cover 2 is applied to the alternative stack 192 of FIG. 46 will now be described. The cover 2 is positioned as shown schematically in FIG. 19E, with the front cover 2A being folded upwards as shown. The stack 192 is positioned on surface 22A in the same manner as stack 13, with the release liners 196A and 196B in place. Assuming that adhesive strip 194B is applied to the first sheet of stack 192, the stack is positioned with strip 194B on the top. Since the release liners 196A and 196B are in place, there will be no tendency for the stack 192 to adhere to anything, including surface 22A. Once stack 192 is properly positioned on surface 22A, with the bottom edge of the stack adjacent score X, the upper release liner 196B is removed thereby exposing adhesive strip 194B. Front cover 2A is then folded down onto stack 192 so that the cover will be secured to the stack by way of adhesive strip 194B. The stack 192 and cover 2 are then removed together from the scoring apparatus. The remaining release liner 196A is then removed and the cover 2 carefully folded around the stack so that the cover is also secured to the stack by adhesive strip 194A thereby completing the process. The cover 2 will not be secured to the spine portion of the stack 192 due to the absence of adhesive at that location. Thus, when the book is opened for reading, the edge of the stack 192 at the spine is free to form a slight U shape, with the cover 2 being slightly separated from edge of the stack so as not to resist the opening.

Figure 32B:
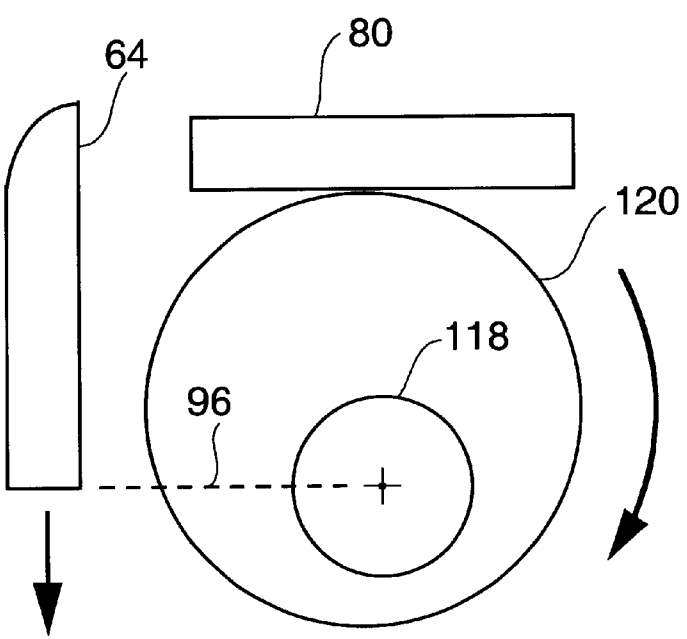
FIGS. 32A and 32B are schematic representations of the rotation of an alternative cam shaft of the scoring assembly.
Figure 32A:
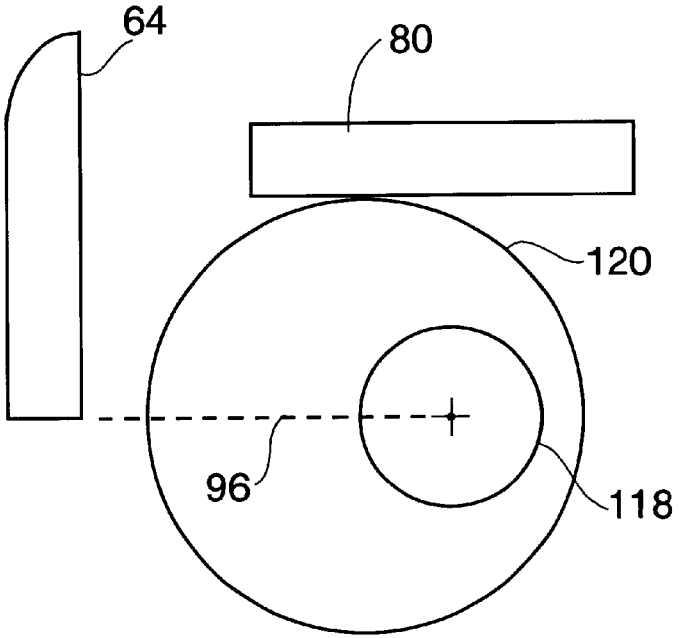

Thus, various embodiments of a novel apparatus and method of binding a soft cover book have been described. Although these embodiments of the subject apparatus has been described in some detail certain changes can be made without departing from the scope and spirit of the invention as defined by the appended claims. By way of example, FIGS. 32A and 32B are schematic representations of a second type of cam shaft 120 and drive shaft 118. This arrangement differs from that previously described in connection with FIGS. 24A–24C in that the drive shaft 118 is not positioned tangentially with respect to the cam shaft 120.

Rather, the drive shaft 118 is positioned inward. The result is that the force necessary to depress the scoring handle 56 is made more uniform throughout the 45 degree stroke. Among other things, this arrangement enables the springs 78 to more easily return the scoring handle 56 to the original position after scoring. Further, the scoring apparatus can be used to score a sheet of cover stock such as used for greeting cards and the like.

What is claimed is:

1. Apparatus for scoring a sheet of cover stock, said apparatus comprising:

a base unit with a receiving surface for receiving the sheet of cover stock to be scored;

a lower die holder disposed below the receiving surface and which extends across a width of the receiving surface;

a lower die which extends across the width of the receiving surface and which is supported at an upper surface of the lower die holder;

an upper die holder disposed above the receiving surface and which extends across a width of the receiving surface;

an upper die which extends across the width of the receiving surface and which is supported at a lower surface of the upper die holder, with the upper die holder being fabricated of a material having optical characteristics which permit a user to view the upper die through the upper die holder; and an actuating structure configured to move the upper die holder between an open position so that a sheet to be scored resting on the receiving surface can be inserted between the upper and lower die and a scoring position where the upper and lower die engage the sheet for scoring.

2. The apparatus of claim 1 wherein the upper die holder material includes transparent plastic.

3. The apparatus of claim 1 wherein the actuating structure includes a drive shaft disposed below the receiving surface, with rotation of the drive shaft causing the upper die holder to move between the open and scoring position.

4. The apparatus of claim 3 wherein the actuating structure includes a first side plate that couples a first end of the upper die holder to the drive shaft and a second side plate that couples a second end of the upper die holder to the drive shaft.

5. The apparatus of claim 4 wherein rotation of the drive shaft causes an axis of rotation of the drive shaft to shift relative to the receiving surface.

6. The apparatus of claim 5 wherein lower die holder is fixed relative to the receiving surface and wherein the drive shaft includes a cam surface which engages a cam bearing surface, with the cam bearing surface being fixed relative to the receiving surface.

7. The apparatus of claim 6 wherein the actuating structure includes at least one cam pad mounted on the lower die holder, with the at least one cam pad having the cam bearing surface.

8. The apparatus of claim 7 wherein the actuating structure includes a pair of the cam pads which are spaced apart from one another.

9. The apparatus of claim 6 wherein the first side plate includes an opening which receives a first end of the drive shaft and the second side plate includes an opening which includes a second end of the drive shaft.

10. The apparatus of claim 9 wherein the opening of the first side plate extends through the first side plate and wherein the actuating structure includes an actuation handle which is attached to the first end of the drive shaft with the actuation handle and the first end of the drive shaft being connected by way of the opening in the first side plate and wherein the actuation handle is mounted relative to the drive shaft so that manual depression of the actuation handle causes rotation of the drive shaft.

11. Apparatus for scoring a sheet of cover stock comprising:

a base unit with a receiving surface for receiving the sheet to be scored;

a lower die holder disposed below the receiving surface and which extends across a width of the receiving surface and which is fixed relative to the receiving surface;

a lower die which extends across the width of the receiving surface and which is supported at an upper surface of the lower die holder;

an upper die holder disposed above the cover receiving surface and which extends across a width of the receiving surf ace;

an upper die which extends across the width of the receiving surface and which is supported at a lower surface of the upper die holder;

a drive shaft disposed below the receiving surface and mounted on the base unit so that rotation of the drive shaft around an axis of rotation causes the axis of rotation to move between first and second differing positions relative to the receiving surface; and a first connecting element connecting one end of the upper die holder to the drive shaft and a second connecting element connecting another end of the upper die holder to the drive shaft so that rotation of the drive shaft to the first position will cause the upper die holder to move to an open position so that a sheet may be placed on the receiving surface between the upper and lower die and so that rotation of the drive shaft to the second position will cause the upper die holder to move to a scoring position so that the upper and lower die will engage the sheet.

12. The apparatus of claim 11 wherein the first and second connecting elements comprise first and second end plates, respectively.

13. The apparatus of claim 11 wherein the drive shaft includes a cam surface which engages a cam bearing surface, with the cam bearing surface being fixed relative to the receiving surface.

14. The apparatus of claim 12 further including first and second spaced apart cam pads, with each of the cam pads having the cam bearing surface.

15. The apparatus of claim 13 wherein the first and second cam pads are mounted on a lower surface of the lower die holder.

16. The apparatus of claim 11 further including an actuation handle which is attached to the drive shaft and mounted relative to the drive shaft so that depression of the actuation handle by a user will cause the drive shaft to move from the first position to the second position.

17. The apparatus of claim 11 wherein the upper die holder is fabricated from materials which have optical properties which permit the user depressing the actuation handle to view the sheet to be scored through the upper die holder so that the user can align the upper die with a selected location on the sheet.

18. The apparatus of claim 17 further including a second upper die supported on the lower surface of the upper die holder and a second lower die supported on the upper surface of the lower die holder.

19. Apparatus for scoring a cover to be applied to a book, said apparatus comprising:

a base unit with a cover receiving surface for receiving a cover to be scored;

a lower die holder disposed below the cover receiving surface and which extends across a width of the cover receiving surface and which is fixed relative to the cover receiving surface;

a lower die which extends across the width of the cover receiving surface and which is supported at an upper surface of the lower die holder;

an upper die holder disposed above the cover receiving surface and which extends across a width of the cover receiving surface;

an upper die which extends across the width of the cover receiving surface and which is supported at a lower surface of the upper die holder;

a drive shaft disposed below the cover receiving surface and rotatably mounted on the base unit; and a first connecting element connecting the upper die holder at a first location on the upper die holder to the drive shaft and a second connecting element connecting the upper die holder at a second location on the upper die holder, spaced apart from the first location, to the drive shaft, with the drive shaft including first and second cam surfaces, with the first connecting element including a cam bearing surface which engages the first cam surface and with the second connecting element including a cam bearing surface which engages the second cam surface, with the first and second cam surfaces shaped so that rotation of the drive shaft to a first position will cause the upper die holder to move to an open position so that a cover may be placed on the cover receiving surface between the upper and lower die and so that rotation of the drive shaft to a second position will cause the upper die holder to move to a scoring position so that the upper and lower die will engage the cover.

20. The apparatus of claim 19 further including a clamping mechanism disposed below the cover receiving surface and coupled to the drive shaft, with the clamping mechanism including a gripper section which engages a cover located on the cover receiving surface, and with rotation of the drive shaft causing the gripper section to move upward towards the cover receiving surface and to move downward away from the cover receiving surface.

21. The apparatus of claim 20 wherein the drive shaft includes a third cam surface which engages a first cam bearing surface on the clamping mechanism.

22. The apparatus of claim 21 wherein a plurality of openings are formed in the base unit at the cover receiving surface and wherein the gripper section includes a plurality of gripping elements which extend through respective ones of the plurality of openings when the gripper section moves upward towards the cover receiving surface.

23. The apparatus of claim 22 wherein the plurality of openings are disposed below the upper die holder so that a cover will be clamped between the gripping elements and the upper die holder when the gripper section moves upwards towards the cover receiving surface.

24. The apparatus of claim 23 where the third cam surface is shaped such that when the drive shaft is in the second position, the gripping elements are displaced from the cover receiving surface.

25. The apparatus of claim 24 wherein the third cam surface is shaped so that when the drive shaft is in a third position, the clamping mechanism is in a clamping position where the gripping elements extend up through the plurality of openings so as to engage a cover located on the cover receiving surface.

26. The apparatus of claim 25 wherein the first and second cam surfaces are shaped so that when the drive shaft is in the third position, the upper and lower die are spaced apart so that the upper die will not engage a cover located on the cover receiving surface.

27. The apparatus of claim 26 wherein the first and second cam surfaces are shaped so that when the drive shaft is in the first position the upper die holder is in a retracted position, and when the drive shaft is rotated from the first position to the third position, the upper die holder will move downward from the retracted position towards the cover receiving surface.

28. The apparatus of claim 27 where the third cam surface is shaped such that when the drive shaft is in the first position, the gripping elements are displaced from the cover receiving surface.

29. The apparatus of claim 28 wherein the drive shaft includes a fourth cam surface, spaced apart from the third cam surface, with the first and second cam surfaces being substantially similar and with the third and fourth cam surfaces being substantially similar.

30. The apparatus of claim 28 wherein rotation of the drive shaft from the first position in a first direction of rotation causes the drive shaft to be in the second position and wherein rotation of the drive shaft from the first position in a second direction of rotation, opposite the first direction of rotation, causes the drive shaft to be in the third position.

31. The apparatus of claim 19 further including a second upper die supported at the lower surface of the upper die holder and a second lower die supported at the upper surface of the lower die holder and wherein the upper die holder is fabricated with materials that include transparent materials so that a user can view both upper die through the upper die holder.

32. Apparatus for scoring and folding a cover to be applied to a stack of sheets, said apparatus comprising:

a base unit with a cover receiving surface for receiving a cover to be scored;

a scoring structure mounted on the base unit and configured to score a cover disposed on the cover receiving surface along a scoring axis of the cover receiving surface; and a cover alignment mechanism positioned on the base unit and movable with respect to the base unit along an alignment axis normal to the scoring axis, said cover alignment mechanism including a first member which defines a first stop and a second member, supported on the first member, which defines a second stop, with the first and second members being movable with respect to one another, with the first and second stops being positioned so as to be capable of engaging an edge of the cover when the cover is positioned on the cover receiving surface for scoring.

33. The apparatus of claim 32 wherein the first member and the second member are coupled together by way of magnetic force.

34. The apparatus of claim 33 wherein the first and second members are coupled to the base unit by way of magnetic force.

35. The apparatus of claim 32 wherein the scoring structure includes materials which are transparent so that a user can view at least part of a cover along the scoring axis.

36. The apparatus of claim 32 further including a clamp element mounted on the base unit and having an edge parallel to the scoring line which defines a cover folding line along the cover receiving surface and wherein the second member further defines a third stop for receiving the edge of the cover, with the second stop being positioned intermediate the first and third stops, with a spacing between the second and third stops being substantially equal to a spacing between the scoring axis and the cover folding line.

37. The apparatus of claim 36 wherein the clamp element is moveable between on open position where a cover may be inserted between the clamp element and the cover receiving surface and a clamping position where the edge of the clamp element engages the cover along the cover folding line.

38. The apparatus of claim 37 wherein the clamp element includes a folding surface which extends upward from the edge of the clamp element.

39. The apparatus of claim 38 wherein the folding surface of the clamp element defines an angle with the cover receiving surface which is substantially less that 90 degrees.

40. The apparatus of claim 39 wherein the first member further defines a fourth stop for receiving an edge of the cover, with the fourth stop being disposed intermediate the first stop and the scoring axis.

41. The apparatus of claim 32 wherein the first member includes a first tab and the second member includes a second tab, with the first and second tabs defining a stack receiving region there between for accepting an edge of the stack so that the first and second stops can be positioned apart a distance which is related to a thickness of the stack.

42. The apparatus of claim 32 wherein the cover alignment mechanism further includes a visual indicia mechanism which provides a visual indicia of a point halfway between the first and second stops.

43. The apparatus of claim 42 wherein the visual indicia mechanism includes a first alignment element fixed with respect to one of the first and second members and a second alignment element fixed with respect to another one of the first and second members.

44. The apparatus of claim 43 wherein a portion of the first and second alignment elements include a first and second respective alignment indicia, with a portion of the first alignment element overlying a portion of the second alignment element, with the first alignment element being fabricated of material so that an apparent intersection between the first and second alignment indicia can be viewed by a user through the first alignment element.

45. The apparatus of claim 44 wherein the first and second indicia each include a linear indicia so that the apparent intersection between the first and second alignment indicia produce a cross hair, with the first and second linear indicia being disposed at a same acute angle with respect to the alignment axis.

46. Apparatus for scoring and folding a cover to be applied to a stack of sheets, said apparatus comprising:

a base unit with a cover receiving surface for receiving a cover to be scored;

a scoring structure mounted on the base unit and configured to score a cover disposed on the cover receiving surface along a scoring axis of the cover receiving surface;

a clamping mechanism mounted on the base unit and movable between an open position where a cover may be positioned on the cover receiving surface and a clamping position where the clamping mechanism secures a cover on the cover receiving surface;

a fold member having an edge parallel with the scoring line which extends at least substantially across an entire width of the cover receiving surface along a cover folding line on the cover receiving surface when the clamping mechanism is in the clamping position; and a cover alignment mechanism on the base which includes a first stop for receiving an edge of a cover and a second stop for receiving an edge of the cover, with the first and second stops positioned relative to one another a distance substantially equal to a distance between the cover folding line and the scoring axis.

47. The apparatus of claim 46 wherein scoring structure includes an upper die supported by an upper die holder and wherein the upper die holder includes the fold member.

48. The apparatus of claim 47 wherein the upper die holder includes transparent material so that a user can view the upper die.

49. The apparatus of claim 48 wherein the cover alignment mechanism is moveable along an alignment axis normal to the scoring axis, with the cover alignment mechanism including a first member having the first and second stops and a second member having a third stop for receiving an edge of the cover, with the first and second member being movable with respect to one another.

50. The apparatus of claim 49 wherein the first member includes a first tab and the second member includes a second tab, with the first and second tabs defining a stack receiving region there between for accepting an edge of the stack so that the second and third stops can be positioned apart a distance which is related to a thickness of the stack.

51. The apparatus of claim 50 wherein the first and second members and the base unit are coupled together by magnetic force.

52. The apparatus of claim 46 wherein the clamp element is disposed below the cover receiving surface when the clamping mechanism is in the open position and wherein the clamp element moves upward to engage a cover when the clamping mechanism is in the clamping position.

53. The apparatus of claim 52 further including a support element disposed above the cover receiving surface and wherein the clamp element forces a cover against the support element when the clamping mechanism is in the clamping mechanism.

54. The apparatus of claim 53 wherein the support element includes the fold member.

55. The apparatus of claim 54 wherein the base unit includes a plurality of openings in the cover receiving surface below the support element and wherein the clamp element includes a plurality of gripping elements which extend up respective ones of the openings when the clamping mechanism is in the clamping position.

56. The apparatus of claim 55 wherein the scoring structure includes upper and lower die disposed along the scoring axis and wherein the support element supports the upper die.

57. The apparatus of claim 56 further including a drive shaft, with rotation of the drive shaft causing the upper and lower die to engage and disengage and the clamping mechanism to move between the open and clamping position.

58. Apparatus for scoring and folding a cover to be applied to a stack of sheets, said apparatus comprising:

a base unit with a cover receiving surface for receiving a cover to be scored;

a scoring structure mounted on the base unit and configured to score a cover disposed on the cover receiving surface along a scoring axis on the cover receiving surface;

a cover alignment mechanism positioned on the base unit and movable with respect to the base unit along an alignment axis normal to the scoring axis, said cover alignment mechanism including a first member having a first guide for positioning an edge of the cover and a second member having a second guide for positioning the edge of the cover, with the first and second members being movable with respect to one another; and a clamp element mounted on the base unit and having an edge parallel to the scoring line which coincides with a cover folding line on the cover receiving surface and wherein the second member further includes a third guide for positioning the edge of the cover, with the second guide being positioned intermediate the first and third guides, with a spacing between the second and third guides being substantially equal to a spacing between the scoring axis and the cover folding line.

59. The apparatus of claim 58 wherein the clamp element is moveable between on open position where a cover may be inserted between the clamp element and the cover receiving surface and a clamping position where the edge of the clamp element engages the cover along the cover folding line.

60. The apparatus of claim 59 wherein the clamp element includes a folding surface which extends upward from the edge of the clamp element.

61. The apparatus of claim 60 wherein the folding surface of the clamp element defines an angle with the cover receiving surface which is substantially less that 90 degrees.

62. The apparatus of claim 59 wherein the first member further defines a fourth guide for positioning an edge of the cover, with the fourth guide being disposed intermediate the first guide and the scoring axis.

63. Apparatus for scoring and folding a cover to be applied to a stack of sheets, said apparatus comprising:

a base unit with a cover receiving surface for receiving a cover to be scored;

a scoring structure mounted on the base unit and configured to score a cover disposed on the cover receiving surface along a scoring axis on the cover receiving surface; and a cover alignment mechanism positioned on the base unit and movable with respect to the base unit along an alignment axis normal to the scoring axis, said cover alignment mechanism including a first member having a first guide for positioning an edge of the cover and a second member having a second guide for positioning the edge of the cover, with the first and second members being movable with respect to one another and wherein the first member includes a first tab and the second member includes a second tab, with the first and second tabs defining a stack receiving region there between for accepting an edge of the stack so that the first and second guides can be positioned apart a distance which is related to a thickness of the stack.

64. A method of folding a cover to be applied to a stack of sheets, said method comprising:

providing a score apparatus having a cover receiving surface and capable of scoring the cover along a score axis on the cover receiving surface and including a cover alignment mechanism which includes a first guide and a second guide movable with respect to the first guide;

positioning the first and second guides so that a distance between the first and second guides is related to a thickness of the stack of sheets;

positioning the cover on the cover receiving surface so that the cover is at a selected position relative to the score line;

positioning the cover alignment mechanism and the cover so that an edge of the cover coincides with a selected location on the alignment mechanism;

actuating the score apparatus when the edge of the cover coincides with the first guide so that the cover is scored along a desired first fold line;

after the actuating, moving the cover so that the edge of the cover coincides with the second guide;

actuating the score apparatus so that the cover is scored along a desired second fold line, with a spacing between scores of the desired first and second fold lines corresponds to the thickness of the stack; and folding the cover along the desired first and second fold lines.

65. The method of claim 64 wherein the selected location on the alignment mechanism is intermediate the first and second guides.

66. The method of claim 65 where, subsequent to the actuations and prior to the folding, the method further comprises:

repositioning the cover so that the desired second fold line is positioned over a fold axis on the cover receiving surface, with the fold axis being displaced from the score axis and with the desired second fold line being disposed intermediate the desired first fold line and the score axis;

folding the cover along the desired second fold line in a direction such that a portion of the cover between the desired second fold line and the edge of the cover is lifted away from the cover receiving surface;

positioning the stack of sheets on the cover receiving surface with an edge of the stack being located along the fold axis abutting that portion of the cover between the desired first and second fold lines.

67. The method of claim 66 wherein the cover alignment mechanism includes a third guide displaced a distance from the second guide which corresponds to a distance between the score axis and the fold axis and wherein the repositioning includes repositioning the cover so that the edge of the cover coincides with the third guide.

68. The method of claim 66 wherein the score apparatus includes a support element above the cover receiving surface and having a support element edge disposed over the fold axis and wherein the cover is folded around the support element edge during the folding that occurs subsequent to the repositioning the cover.

69. The method of claim 66 wherein the support element includes a clamp element movable from the engaged position where the clamp element engages the cover to a displaced position away from the receiving surface and wherein prior to the repositioning, the method further includes moving the clamp element to the displaced position.

70. The method of claim 66 wherein an adhesive is disposed on the stack and wherein, subsequent to the positioning the stack, pressing the stack and cover together so that the stack is adhered to the cover by way of the adhesive.

71. The method of claim 70 wherein, prior to the folding the cover along the desired first and second fold lines, the method includes lifting the stack and cover away from the cover receiving surface.

72. The method of claim 68 wherein the score apparatus includes upper and lower die and wherein the upper die is supported by the support element and wherein the actuating the score apparatus includes moving the support element downward towards the cover receiving surface.

73. A method of applying a cover to a stack of sheets, with the stack of sheets having an adhesive for securing the cover to the stack of sheets, said method comprising:

placing the cover on a cover receiving surface;

scoring the cover on the cover receiving surface along desired first and second fold lines, with a distance between the first and second fold line corresponding to a thickness of the stack of sheets;

subsequent to the scoring, supporting the cover along the second fold line;

during the supporting, folding the cover along the second fold line so that the cover is moved away from the cover receiving surface at the first desired first fold line;

positioning the stack of sheets on the receiving surface, with the edge of the stack of sheets contacting the lifted cover in a region intermediate the first and second desired fold lines;

pressing the stack of sheets and cover together so that the cover is at least partially secured to the stack by the adhesive;

subsequent to the pressing, removing the stack of sheets and the cover from the receiving surface; and folding the cover along the desired first and second fold lines so that the cover wraps around the edge of the stack.

74. Apparatus for scoring and folding a cover to be applied to a stack of sheets, said apparatus comprising:

a base unit with a cover receiving surface for receiving a cover to be scored;

a scoring structure mounted on the base unit and configured to score a cover disposed on the cover receiving surface along a scoring axis of the cover receiving surface; and a cover alignment mechanism positioned on the base unit and movable with respect to the base unit along an alignment axis normal to the scoring axis, said cover alignment mechanism including a first member which defines a first guide for receiving an edge of the cover and a second member which defines a second guide for receiving the edge of the cover, with the first and second members being movable with respect to one another, and a third guide for receiving an edge of the cover intermediate the first and second guides, with the third guide operating to locate the edge of the cover one-half a distance between the first and second guides and with the third guide including first visual indicia mounted on the first member and a second visual indicia mounted on the second member, with the first and second visual indicia overlying one another to form a cross hair.

75. The apparatus of claim 74 wherein the first and second guides include first and second respective steps formed the first and second members, respectively.

* * * * *